US012116179B2

(12) United States Patent
Yajko et al.

(10) Patent No.: US 12,116,179 B2
(45) Date of Patent: Oct. 15, 2024

(54) STORAGE CONTAINER

(71) Applicant: SWIMC LLC, Cleveland, OH (US)

(72) Inventors: Michael P. Yajko, Peninsula, OH (US); Eugene M. Merrill, Brunswick, OH (US)

(73) Assignee: SWIMC LLC, Cleveland, OH (US)

( * ) Notice: Subject to any disclaimer, the term of this patent is extended or adjusted under 35 U.S.C. 154(b) by 0 days.

(21) Appl. No.: 17/696,958

(22) Filed: Mar. 17, 2022

(65) Prior Publication Data

US 2022/0306353 A1 Sep. 29, 2022

Related U.S. Application Data

(60) Provisional application No. 63/299,063, filed on Jan. 13, 2022, provisional application No. 63/167,362, filed on Mar. 29, 2021.

(51) Int. Cl.
*B65D 43/02* (2006.01)
*B65D 1/02* (2006.01)
(Continued)

(52) U.S. Cl.
CPC ..... *B65D 43/0229* (2013.01); *B65D 1/0246* (2013.01); *B65D 21/0201* (2013.01);
(Continued)

(58) Field of Classification Search
CPC ..... B65D 43/0229; B65D 1/0246; B65D 21/0201; B65D 21/023; B65D 23/06; B65D 23/102; B65D 23/104; B65D 51/242; B65D 2543/00092; B65D 2543/0049; B65D 2543/00546; B65D 2313/04; B65D 25/20; B65D 25/2811; B65D 2525/285;
(Continued)

(56) References Cited

U.S. PATENT DOCUMENTS 109,090 A * 11/1870 Wilson ..... B65D 25/20 220/698
2,114,137 A * 4/1938 Conner ..... B65D 7/06 220/619
(Continued)

FOREIGN PATENT DOCUMENTS

BR 202015011442 U2 * 4/2017 ..... B44D 3/14
DE 102010048477 A1 * 4/2012 ..... B65D 5/4604
(Continued)

OTHER PUBLICATIONS

English translation of BR 202015011442 (previous PTO-892 reference) (Year: 2017).*

*Primary Examiner* — Nathan J Jenness
*Assistant Examiner* — Eric C Baldrighi
(74) *Attorney, Agent, or Firm* — Tucker Ellis LLP

(57) ABSTRACT

Provided is a storage container for storing a material, the storage container including a lid and a container body having a first portion for holding the material and a second portion to which the lid is configured to be attached. The second portion is spaced from the first portion in a longitudinal direction by a collar defining a gap between the first and second portions. The first portion has a wall with a closed bottom portion defining a cavity for the material and the second portion has a wall defining an opening for accessing the cavity.

15 Claims, 39 Drawing Sheets

(51) Int. Cl.
*B65D 21/02* (2006.01)
*B65D 23/06* (2006.01)
*B65D 23/10* (2006.01)
*B65D 51/24* (2006.01)

(52) U.S. Cl.
CPC ..... *B65D 21/023* (2013.01); *B65D 23/06* (2013.01); *B65D 23/102* (2013.01); *B65D 23/104* (2013.01); *B65D 51/242* (2013.01); *B65D 2543/00092* (2013.01); *B65D 2543/0049* (2013.01); *B65D 2543/00546* (2013.01)

(58) Field of Classification Search
CPC ..... B65D 21/0213; B65D 25/2808; B65D 25/2832; B65D 2543/00277; B65D 2543/00296; B65D 2543/00509; B65D 2543/00851; B65D 7/06; B65D 11/10; B65D 15/22; B65D 25/28; B65D 25/32; B65D 77/0426; B65D 1/14; B44D 3/127; B44D 3/14
USPC ..... 215/44
See application file for complete search history.

(56) References Cited

U.S. PATENT DOCUMENTS 3,361,290 A * 1/1968 Matthews ..... B65D 1/12 220/296
4,014,465 A * 3/1977 Ritter ..... B65D 25/48 220/699
4,478,450 A * 10/1984 Picozza ..... B65D 25/2867 220/759
4,834,438 A * 5/1989 Haidet ..... A47G 23/0241 294/169
5,092,481 A * 3/1992 Skelton ..... B65D 25/28 220/94
5,269,438 A * 12/1993 Kelsey ..... B65D 11/10 220/768
5,307,982 A * 5/1994 Swindell ..... B65D 5/248 229/172
5,377,858 A * 1/1995 Morris, Sr. ..... B65D 50/046 206/508
5,390,888 A * 2/1995 Rogers ..... E06C 7/14 248/318
5,765,888 A * 6/1998 Stack ..... B65D 23/108 215/396
5,775,483 A * 7/1998 Lown ..... B65D 21/0219 206/508
5,896,993 A * 4/1999 Nask ..... B65D 43/0212 206/508
6,983,862 B2 * 1/2006 Nottingham ..... B65D 25/48 206/508
7,337,901 B2 3/2008 Phillips
8,157,122 B2 * 4/2012 Dale ..... B65D 21/022 220/773
10,494,145 B2 12/2019 Hudson et al.
10,537,168 B1 * 1/2020 Littleton ..... A45F 5/00
10,717,580 B2 7/2020 Hudson et al.
11,345,186 B1 * 5/2022 Franklin ..... B44D 3/123
2002/0125385 A1 * 9/2002 Tweed ..... B65D 25/28 248/214
2002/0145001 A1 * 10/2002 Morelock ..... B65D 25/10 220/755
2004/0188377 A1 * 9/2004 Balade ..... A45F 5/10 215/396
2008/0054030 A1 * 3/2008 Diaz ..... B44D 3/14 248/314
2008/0290099 A1 * 11/2008 MacDonald ..... B65D 6/00 220/660
2013/0306497 A1 * 11/2013 Llewellyn ..... B65D 25/32 206/1.7
2014/0124520 A1 * 5/2014 Allan ..... B65D 25/28 220/752
2017/0233160 A1 * 8/2017 Hudson ..... B65D 77/062 222/183
2018/0127181 A1 * 5/2018 Warren ..... B44D 3/127
2020/0008563 A1 * 1/2020 Wang ..... A45F 5/1026
2020/0085219 A1 * 3/2020 Barczyk ..... A47G 23/0208
2020/0148432 A1 * 5/2020 Davies ..... B65D 47/0876
2023/0257163 A1 * 8/2023 Fleherty ..... B65D 81/38 220/592.2

FOREIGN PATENT DOCUMENTS

EP 0356147 B1 * 6/1993 ..... A45F 5/10
EP 0596839 A2 * 5/1994 ..... A45F 3/02
EP 0721894 A1 * 7/1996 ..... B65D 21/046
EP 1792834 A2 * 6/2007 ..... B05C 11/10
FR 2890381 A3 * 3/2007 ..... B44D 3/127
GB 2262929 A * 7/1993 ..... B65D 11/00
GB 2413266 A * 10/2005 ..... B44D 3/14
KR 101452264 B1 * 10/2014 ..... B65D 21/0233
WO WO-9928196 A1 * 6/1999 ..... B29C 49/0073
WO 03047982 A2 6/2003

* cited by examiner

STORAGE CONTAINER

RELATED APPLICATIONS

This application claims the benefit of U.S. Provisional Application No. 63/167,362 filed Mar. 29, 2021 and U.S. Provisional Application No. 63/299,063 filed Jan. 13, 2022, which are hereby incorporated herein by reference.

TECHNICAL FIELD

In general, the present invention relates to a storage container, and in particular to a storage container for a coating material.

BACKGROUND OF THE INVENTION

The most common way to store coating materials (e.g., paints, stains, varnishes, chemicals, etc.) is a metal can having a metal removable lid, wherein the can has a circular shape. In use, a prying tool is used to remove the lid and the paint is stirred and dispensed from the can. Alternatively, a brush can be dipped directly into the can and the brush is used to apply the coating material to an object. Most metal cans, such as steel paint cans, are moved and carried using a bail made from a steel wire and mounted on opposite sides of the container.

Conventional paint cans have numerous drawbacks. First, removal of the lid can be difficult because a prying tool is required. A lid removal tool is fairly efficient, but often a screwdriver is used instead making the task more difficult. Replacement of the lid is also difficult in that a hammer or mallet is required to reseat opposed mating grooves on the lid and container.

SUMMARY OF THE INVENTION

In accordance with an embodiment of the present invention, a storage container for storing a coating material is provided. The storage container includes a lid, and a container body having a first portion for holding the coating material and a second portion to which the lid is configured to be attached, the second portion being spaced from the first portion in a longitudinal direction by a collar defining a gap between the first and second portions, the first portion having a wall with a closed bottom portion defining a cavity for the coating material and the second portion having a wall defining an opening for accessing the cavity.

The second portion may additionally include an outer wall that is polygonal in shape, and wherein the wall is an inner wall radially inwardly spaced from the outer wall and being circular in shape.

A pour spout may be defined in at least one corner of the second portion between the inner and outer walls.

The pour spout may be defined in at least one corner includes a pour spout defined in two corners diagonal from one another.

A drip edge may be in the form of a recess in the outer wall is provided at each corner with a spout.

The lid may be configured to be attached to the second portion below a top of the outer wall providing a recessed closure.

The lid may include a base, an annular wall extending upward from the base, and a handle extending between sides of the annular wall defining a cavity between the handle and the base.

The lid may include at least two channels on an outer surface of the annular wall and the container body includes at least two protrusions projecting radially inwardly from the inner wall, or wherein the lid includes at least two protrusions projecting radially outwardly from the annular wall and the container body includes at least two channels in the inner wall, wherein the at least two protrusions are configured to be received in a respective one of the at least two channels.

The lid may include at least two channels on an outer surface thereof, and the container body includes at least two protrusions configured to be received in a respective one of the at least two channels to secure the lid to the container body.

Each channel may include a first leg having an open end opening towards a bottom of the lid and a second leg substantially perpendicular to the first leg and having a closed end, and wherein the protrusions are received in the open end of the respective first leg and moved to the closed end of the respective second leg by rotation.

The lid may include a plurality of evenly circumferentially spaced channels and the container body includes a plurality of evenly circumferentially spaced protrusions.

The closed bottom portion may include a base, a projection at each corner of the bottom portion, and a channel between each projection and the base.

The container body additionally may include a third portion for holding the material, the third portion configured to be disposed in and extend above the first portion for attaching to the second portion.

The collar may include threads that mate with corresponding threads on a collar of the third portion to removably attach the second portion to the third portion.

The first portion may be formed from a corrugated structure and the second and third portions are formed from plastic.

The storage container in combination with an attachment configured to be removably coupled to the storage container in the gap between the first and second portions.

The attachment may include an attachment strap configured to be coupled to the second portion, and a functional attachment configured to be coupled to the handle attachment strap.

The attachment strap may have a first end with an opening and a second end with a projection configured to be received in the opening, and one or more other projections extending above an upper surface of the attachment strap to engage in respective anchor points in the second portion.

The functional attachment may include an attachment portion for attaching to the container and the attachment strap, and a functional portion.

The attachment may have an attachment portion with a pair of arms each having an inner surface corresponding to an outer surface of the inner wall for at least partially surrounding the outer wall, and a protrusion projecting upward from each arm for engaging an inner surface of the outer wall.

In accordance with another embodiment of the present invention, a storage assembly may be provided including a storage container including a lid and a container body having a first portion and a second portion to which the lid is configured to be attached, the second portion being spaced from the first portion in a longitudinal direction by a collar defining a gap between the first and second portions, the first portion defining a cavity for the material and the second portion having a wall defining an opening for accessing the cavity, and an attachment configured to be removably coupled to the storage container in the gap between the first and second portions.

The attachment may have an attachment portion with a pair of arms each having an inner surface corresponding to an outer surface of the inner wall for at least partially surrounding the outer wall, and a protrusion projecting upward from each arm for engaging an inner surface of the outer wall.

The attachment may include a first bar, a second bar projecting from a top of the first bar substantially perpendicular to the first bar serving as a handle, the attachment portion projecting from the first bar below the second bar substantially perpendicular to the first bar, and a second attachment portion projecting from a bottom of the first bar substantially perpendicular to the first bar, the second attachment portion having a protrusion projecting upward therefrom for being received in a channel at a corner of a bottom of the first portion.

The attachment may include a first bar, a second bar projecting from a top of the first bar substantially perpendicular to the first bar serving as a handle, and the attachment portion projecting from the first bar below the second bar substantially perpendicular to the first bar and in a direction opposite the second bar.

The attachment portion may include a first attachment portion for engaging the storage container and a second attachment portion for engaging another storage container, and wherein the attachment includes a handle projecting above the first and second attachment portions.

The attachment may include a bar, the attachment portion projecting from the bar below a top of the bar substantially perpendicular to the bar, and a second attachment portion projecting from a bottom of the bar substantially perpendicular to the bar, the second attachment portion having a protrusion projecting upward therefrom for being received in a channel at a corner of a bottom of the first portion.

The attachment may include a bail rotatably attached to the attachment portion.

The attachment may include an attachment strap configured to be coupled to the second portion, and a functional attachment configured to be coupled to the attachment strap.

The attachment strap may have a first end with an opening and a second end with a projection configured to be received in the opening, and one or more other projections extending above an upper surface of the attachment strap to engage in respective anchor points in the second portion.

The functional attachment may include an attachment portion for attaching to the container and the handle attachment strap, and a functional portion.

In accordance with yes another embodiment of the present invention, a method of coupling an attachment having a handle attachment strap and a handle attachment to a container having first and second portions spaced from one another in a longitudinal direction to define a gap may be provided. The method includes attaching the handle attachment to a corner of the handle attachment strap, advancing the first and second ends of the handle attachment strap around the container in the gap, coupling the first and second ends of the handle attachment strap together, and rotating the handle attachment strap and container relative to one another until corners of the handle attachment strap are proximate or abutting respective corners of the container and protrusions projecting upward at the corners of the handle attachment strap are positioned at anchor points at the respective corners of the container in the gap thereby removably coupling the handle attachment strap and handle attachment to the container.

In accordance with still another embodiment of the present invention, a method of coupling an attachment having a base with a pair of arms extending from the base to a container having first and second portions spaced from one another in a longitudinal direction to define a gap may be provided. The method includes the method advancing the attachment toward the container until the base is proximate or abutting a side of the container and the arms are received in the gap, and rotating the attachment and container relative to one another until the base is proximate or abutting a corner of the container and protrusions projecting upward from the arms are positioned at anchor points at opposite corners of the container in the gap thereby removably coupling the attachment to the container.

In accordance with yet another embodiment of the present invention, a coating material kit may be provided that includes a shipping lid, a storage container, and a receptacle that receives the shipping lid and storage container, wherein in a shipping configuration, the shipping lid is attached to the third portion and disposed in the receptacle and the second portion is disposed in the receptacle, and in a use configuration, the second portion is attached to the third portion.

In accordance with a further embodiment of the present invention, a coating material kit may be provided that includes a shipping lid, a storage container including a lid and a container body having a first portion, a second portion to which the lid attaches, and a third portion for holding a coating material, the third portion being disposed in the first portion for attaching to the second portion and the shipping lid, and a receptacle that receives the shipping lid and storage container, wherein in a shipping configuration, the shipping lid is attached to the third portion and disposed in the receptacle and the second portion is disposed in the receptacle, and in a use configuration, the second portion is attached to the third portion.

The kit may include one or more accessories disposed in the receptacle.

The one or more accessories may include one or more of a roller, roller cover, brush, and stir stick.

The receptacle may include a flap having one or more foldable portions and/or perforated regions.

The flap may include perforated regions defining removable functional attachments for use with the storage container.

The functional attachments may include a handle portion and a loop.

The flap may include first and second foldable portions that are foldable relative to a body of the receptacle to define a tray for coating material.

The first portion and the receptacle may be formed from a corrugated structure and the lid, second portion, and third portion are formed from plastic.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
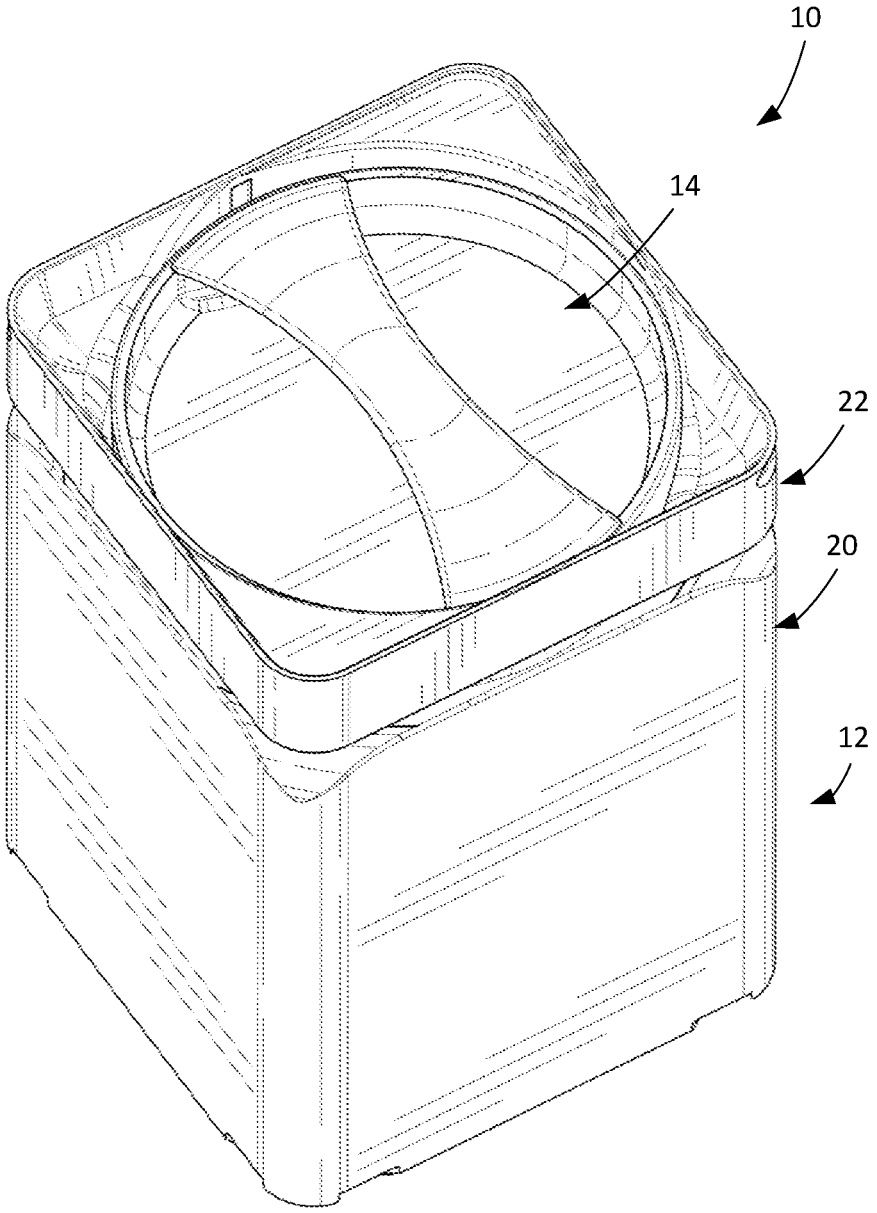
FIG. 1 is a perspective view of an exemplary storage container.
Figure 2:
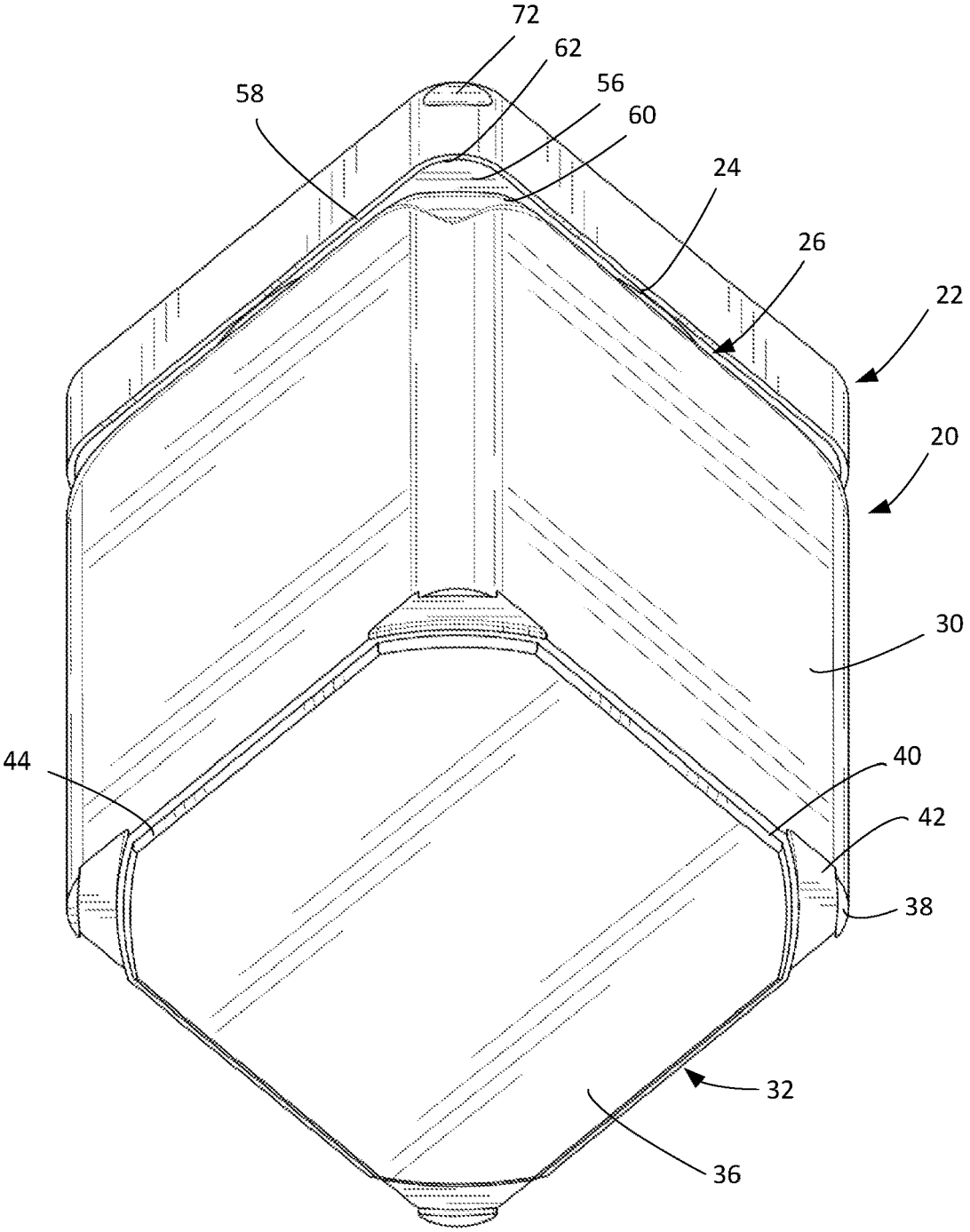
FIG. 2 is another perspective view of the storage container.
Figure 3:
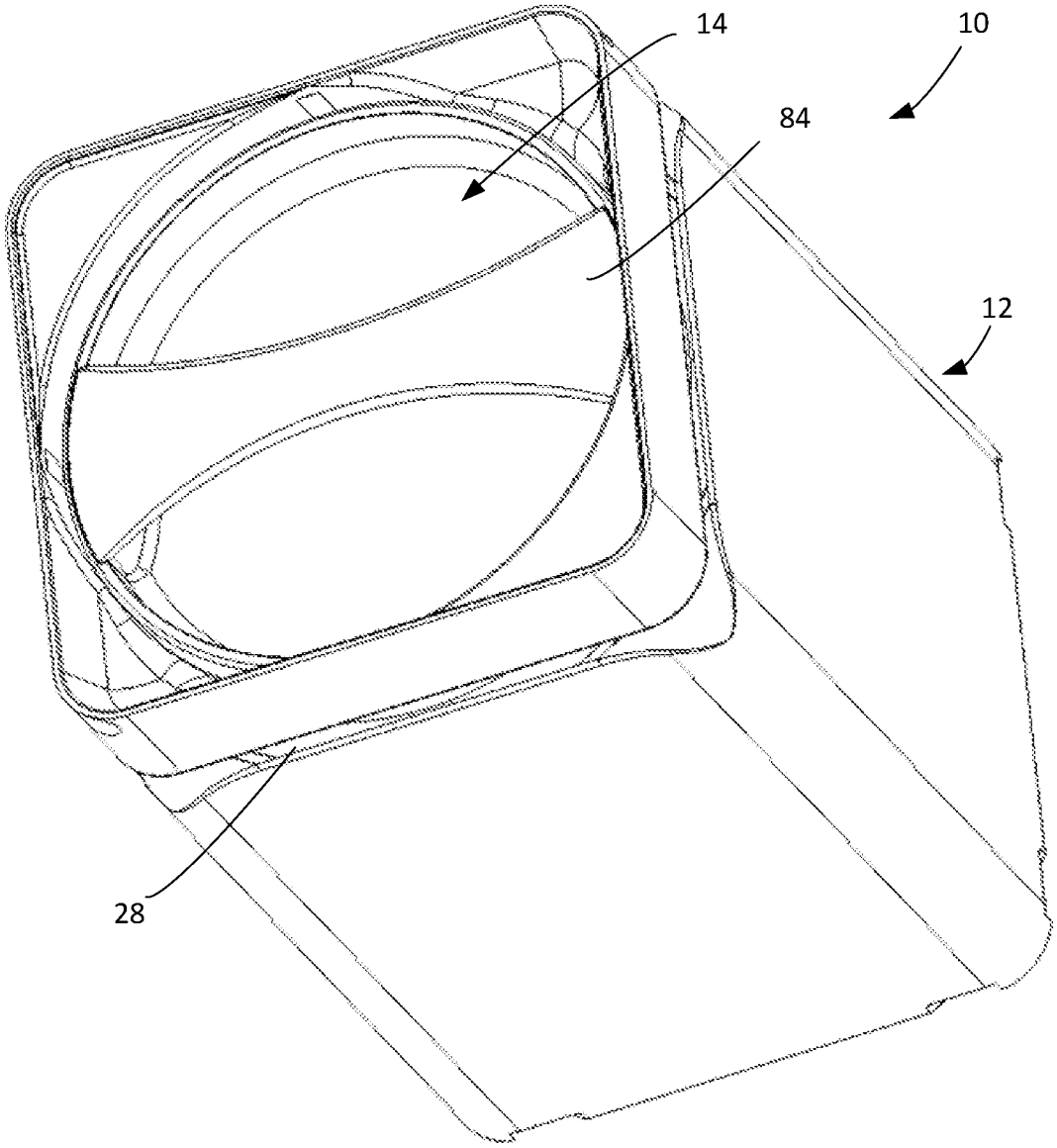
FIG. 3 is still another perspective view of the storage container.
Figure 4:
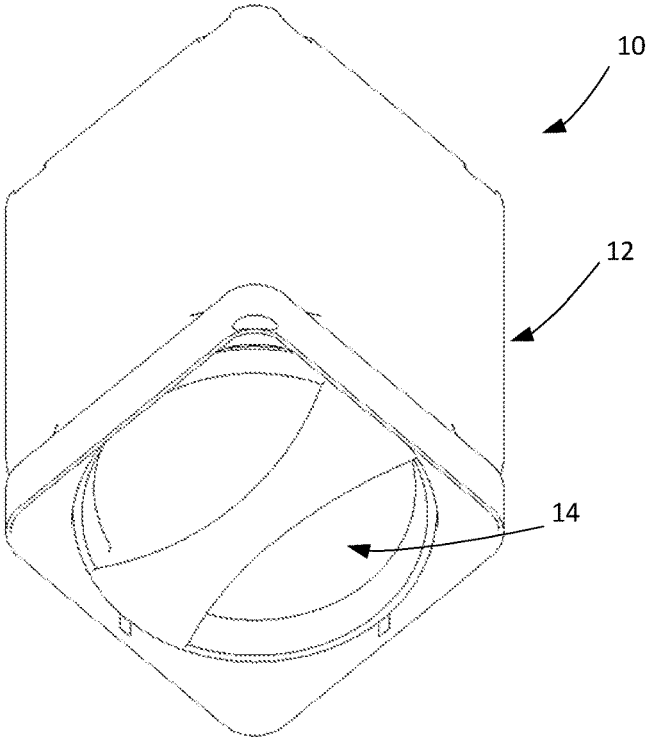
FIG. 4 is yet another perspective view of the storage container.
Figure 5:
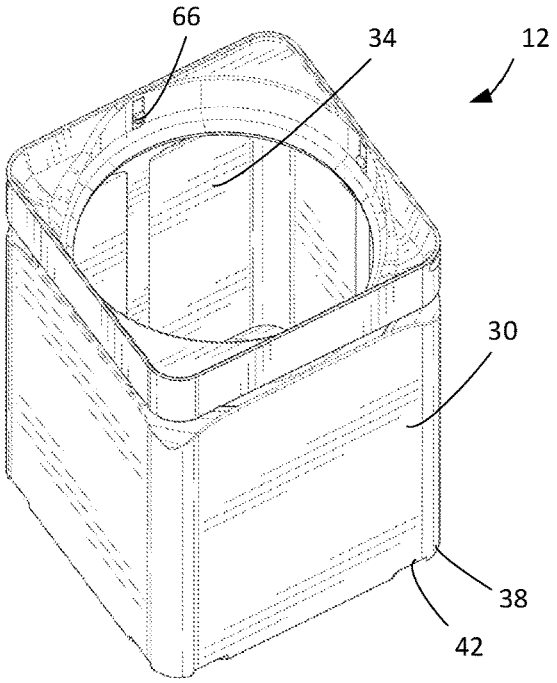
FIG. 5 is a perspective view of a container body of the storage container.
Figure 6:
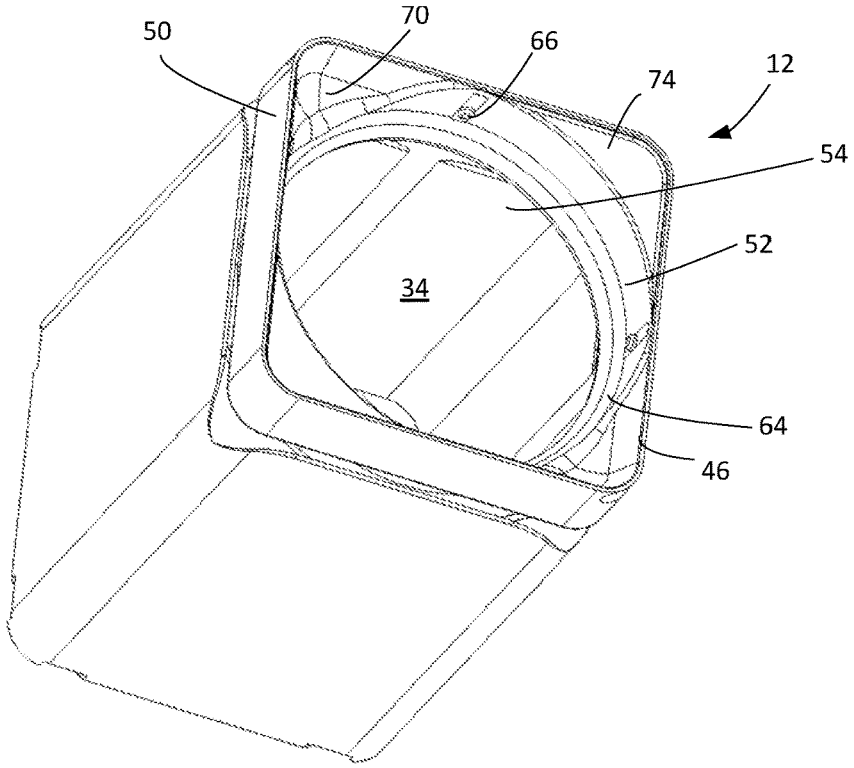
FIG. 6 is another perspective view of the container body.
Figure 7:
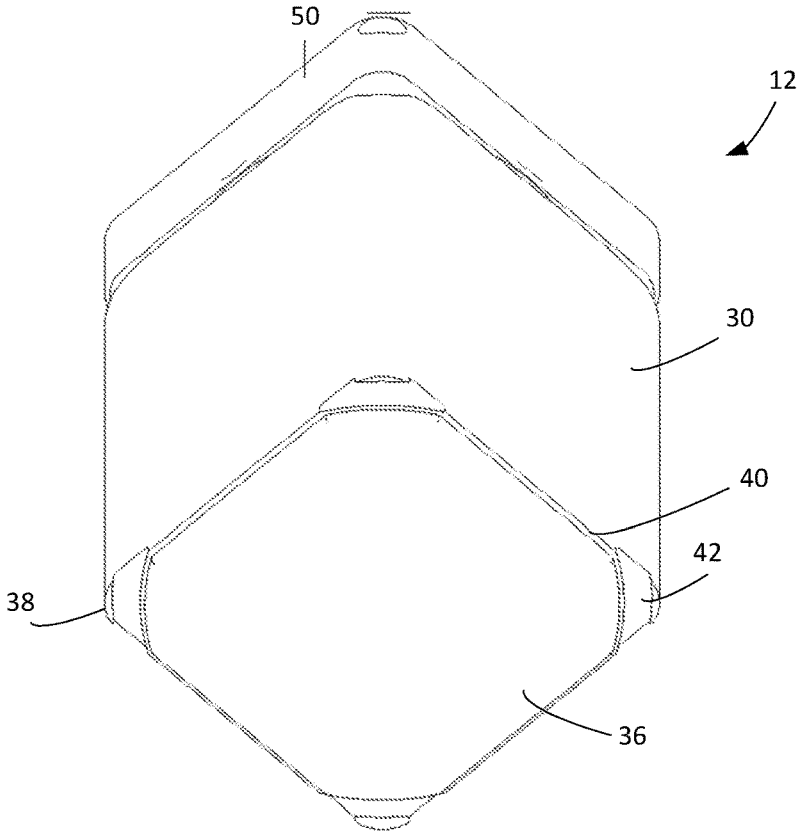
FIG. 7 is still another perspective view of the container body.
Figure 8:
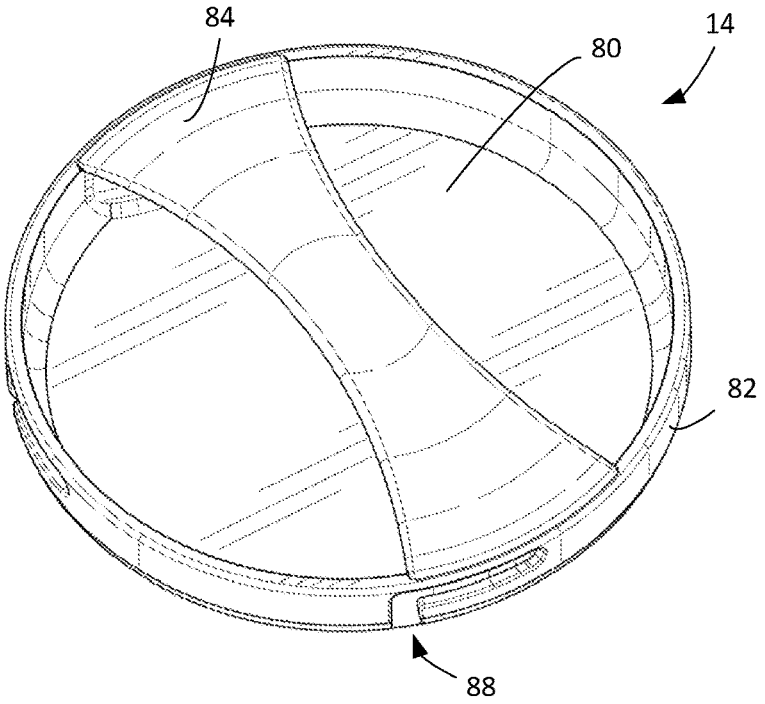
FIG. 8 is a perspective view of a lid of the storage container.
Figure 9:
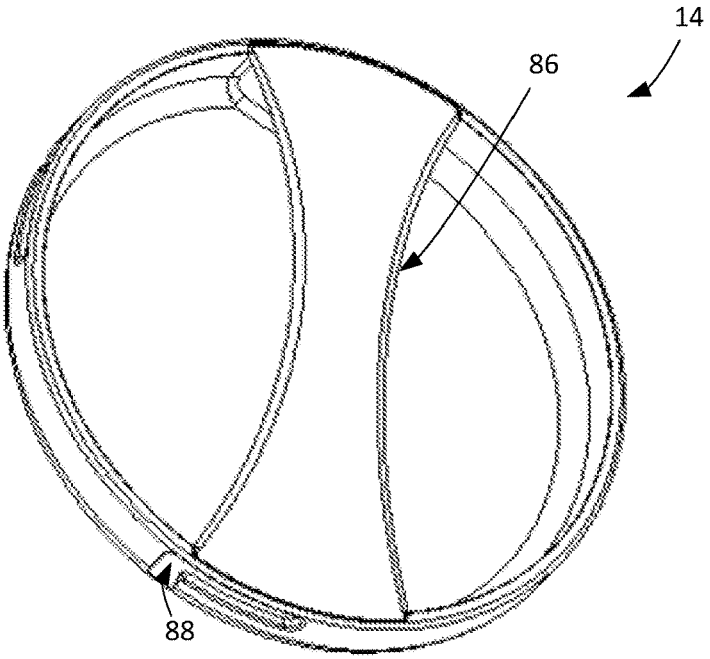
FIG. 9 is another perspective view of the lid.
Figure 10:
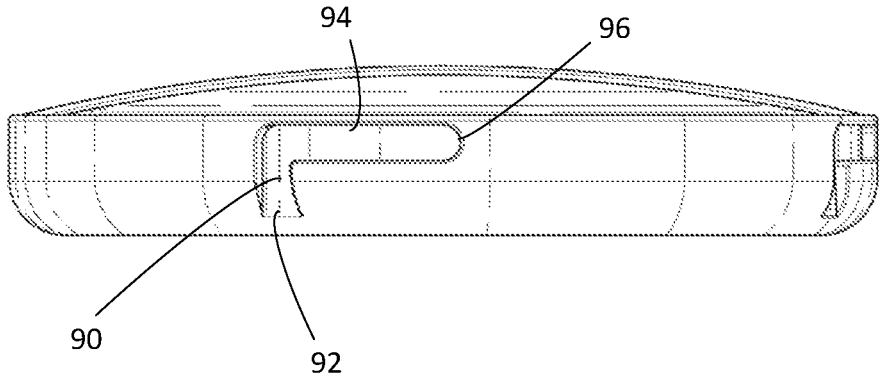
FIG. 10 is a side view of the lid.
Figure 11:
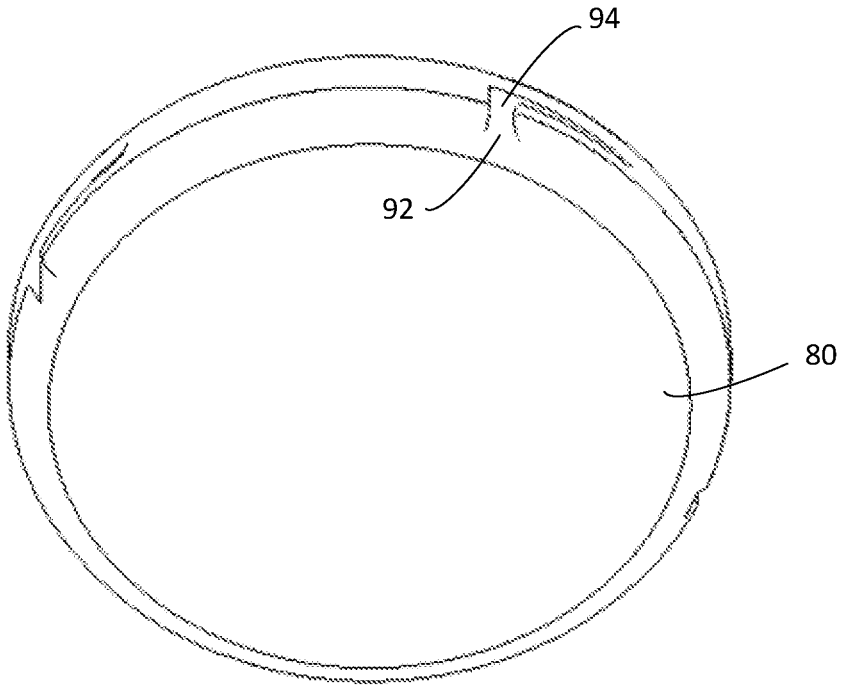
FIG. 11 is yet another perspective view of the lid.

Embodiments of the invention relate to methods and systems that relate to a storage container for storing a coating material. The storage container including a lid and a container body having a first portion for holding the coating material and a second portion to which the lid is configured to be attached. The second portion is spaced from the first portion in a longitudinal direction by a collar defining a gap between the first and second portions. The first portion has a wall with a closed bottom portion defining a cavity for the coating material and the second portion has an outer wall, and an inner wall radially inwardly spaced from the outer wall and defining an opening for accessing the cavity.

With reference to the drawings, like reference numerals designate identical or corresponding parts throughout the several views. However, the inclusion of like elements in different views does not mean a given embodiment necessarily includes such elements or that all embodiments of the invention include such elements. The examples and figures are illustrative only and not meant to limit the invention, which is measured by the scope and spirit of the claims.

Turning initially to FIGS. 1-11, an exemplary storage container is illustrated at reference numeral 10. The storage container includes a container body 12 that may hold a suitable coating material, such as paints, stains, varnishes, chemicals, etc., and a lid 14 removably attached to the container body 12. The container body 12 may be a suitable shape, such as a substantially rectangular shape, and as shown a substantially square shape, and the lid 14 may be a suitable shape, such as a substantially circular shape as shown. It will be appreciated that the container body 12 may have other suitable shapes, such as other suitable polygonal shape, such as an octagonal shape. The container body 12 and the lid 14 may be made out of a suitable material, such as plastic, metal, etc., and may be made in a suitable manner, such as by injection molding, etc. In another embodiment, the container body may be made out of a suitable corrugated structure such as cardboard, plastic, metal, etc. and may include a suitable coating such as a RPET laminate or UV varnish. The storage container may be suitably dimensioned, for example, the storage container 10 may have the same or substantially the same height and width of a traditional paint can allowing the storage container 10 to fit in existing paint shakers and tinting machines/areas. The square shape of the storage container 10 minimizes dead space in shipping boxes and the integrated handled and lack of bail allows for easy removal of the storage container 10 from the shipping box.

The container body 12 includes a first portion 20 for holding the coating material and a second portion 22 for attaching to the lid 14. The second portion 22 is spaced from the first portion 20 in a longitudinal direction by a collar 24 defining a gap 26 between the first and second portions 20 and 22. The gap 26 may extend around a periphery of the container 10 and receive attachments as discussed below. The first and second portions 20 and 22 can be formed as one piece or can be formed as separate pieces that are connected together, for example after the first portion 20 has been filled with a coating material.

The first portion 20 has a wall 30 with an open top end and a closed bottom end that is closed by a bottom portion 32 coupled to, formed with, or otherwise held in position relative to the bottom of the wall 30. The wall 30 and bottom portion 32 define a cavity 34 for receiving the coating material. The first portion can include a top portion 28 coupled to, formed with, or otherwise held in position relative to the wall having an opening into the cavity 34, for example a circular opening from which the collar 24 extends. In an embodiment, a receptacle may be received in the cavity 34, such as a bag of any suitable number of layers, which may be made of any suitable material, such as plastic, and may have a suitable coating such as a metallic coating. In an embodiment, the container body can include one or more nodules or ears, for example projecting from opposite sides of the wall 30. The nodules are configured to couple to a bail-type handle to facilitate carrying or lifting of the container. The bail-type handle can be removably attached in an embodiment and can include a connector that can be used to attach to a ladder or other stepping device and/or connect to a bail hook. Additionally or alternatively, in an embodiment the first portion 20 can include an integrated handled that is formed with an aperture through the container body.

Figure 12:
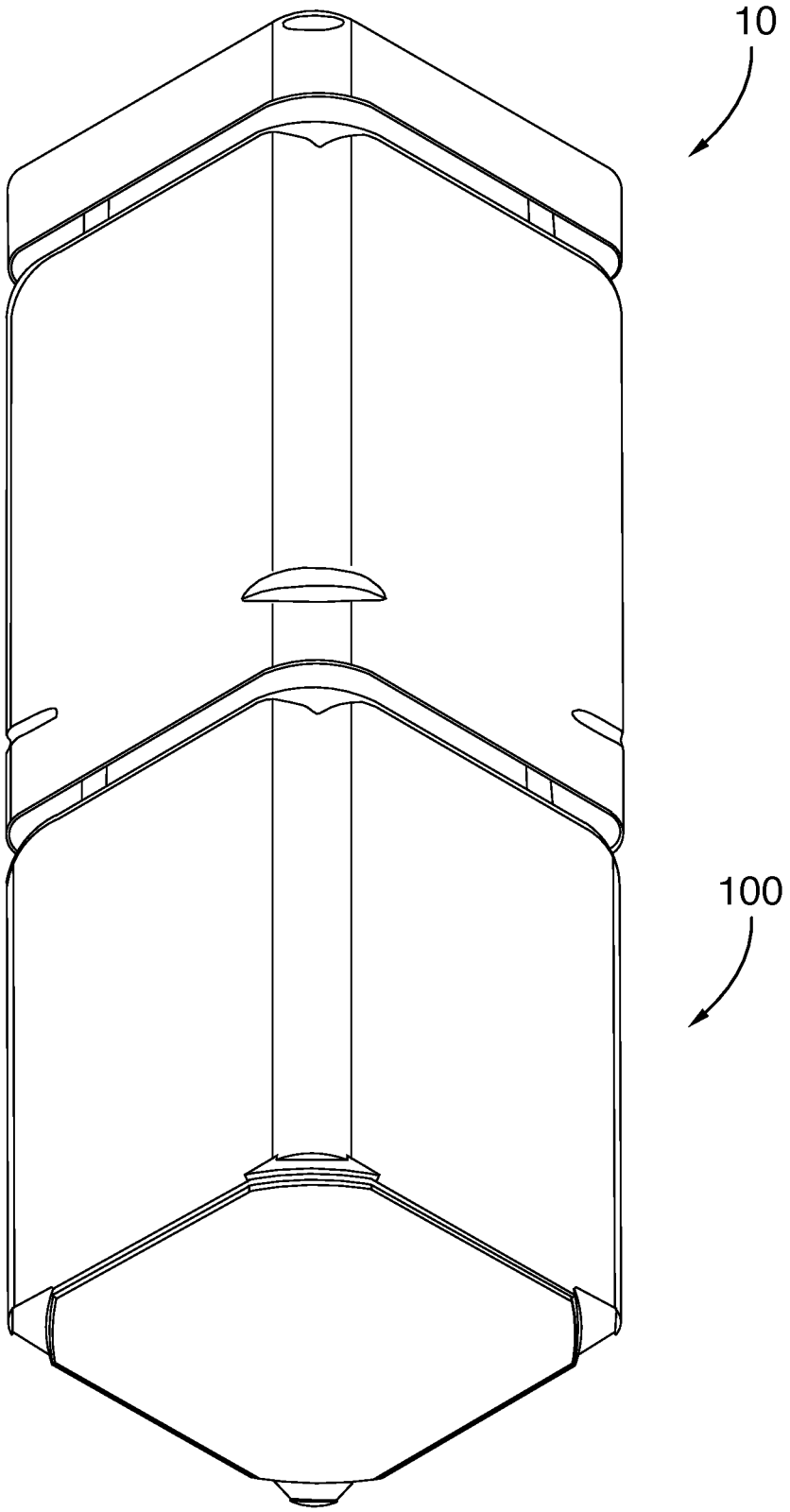
FIG. 12 is a perspective view of a first storage container stacked on a second storage container.

The bottom portion 32 of the first portion 20 includes a base 36 having a periphery radially inwardly spaced from the wall 30, a projection 38 at each corner of the bottom portion 32, a ledge 40 extending around the periphery of the base 36, a respective channel 42 between the ledge and each projection 38 that opens to adjacent sides of the wall 30, and a wall 44 formed between the ledge 40 and the base 36. Each channel 42 defines an anchor point or attachment zone for one of the attachments discussed below. The projections 38 and the ledge 40 may terminate at a first height and the base 36 at a second height below the first height for the base 36 to contact a surface and support the container 10. To securely stack the container 10 onto an identical second container 100 as shown in FIG. 12, the base 36 is positioned within the second portion 22 of the second container with the ledge 40 abutting a lip 46 of the second portion 22, the wall 44 of the bottom portion 32 abutting an inner surface of the lip 46, and the projections 38 abutting the corners of the top of the second portion 22.

Turning now to the second portion 22 in detail, the second portion 22 has an outer wall 50 that is substantially rectangular, and as shown substantially square, and an inner wall 52 that is substantially circular and that defines an opening 54 for access to the cavity 34 in the first portion 20. The opening 54 is a suitably wide opening allowing for the container 10 to be filled through the opening 54, allowing the container 10 to be tinted through the opening 54, and allowing a user to insert an apparatus, such as a paintbrush into the opening 54 for painting from the container 10. A cavity 56 is formed between an inner surface 58 of the outer wall 50 and an outer surface 60 of the inner wall 52 above the gap 26. An anchor point or attachment zone 62 for securing to one of the attachments is defined by interior corners of the outer wall 50 in the cavity 56.

The second portion 22 includes the lip 46 extending upward around the outer wall 50, and a ledge 64 extending radially inwardly from a bottom of the inner wall 52 to define a seat for the lid 14. The second portion 22 also includes at least one protrusion 66 that extends radially inwardly from the inner wall 52 above the ledge 64, and as shown a plurality of circumferentially spaced radially inwardly extending protrusions 66. The plurality of circumferentially spaced radially inwardly extending protrusions 66 each may have a suitable shape, such as a generally cylindrical shape.

A pour spout 70 may be defined in a corner of the second portion 22 in the area between the square outer wall 50 and the circular inner wall 52, and as shown, a pour spout 70 is defined in two corners diagonal from one another. It will be appreciated that the container 10 could be designed to include a pour spout in each of the corners of the container 10. The pour spouts 70 are curved from the lip 46 to the ledge 64 to allow the coating material to be poured from the cavity 34 in the first portion 20 and to allow the coating material to drip back into the cavity 34. A drip edge 72 in the form of a recess in the outer wall 50 may be provided at each corner with a spout 70. The remaining corners may include respective planar portions 74 extending outward from the top of the inner wall 52 and below the lip 46. In an embodiment, the container may include at the pour spout or other suitable area a plurality of scraper regions projecting therefrom oriented in a chevron pattern for scraping paint off of a painting apparatus.

Turning additionally to FIGS. 8-11, the lid 14 will be described in detail. The lid 14, which is substantially circular in shape, includes a base 80, an annular wall 82 extending upward from the base 80, and a handle 84 extending between sides of the annular wall 82 defining a cavity 86 between the handle 84 and the upper surface of base 80 for a user's hand to be received. The base 80 may concave on its bottom side such that when the lid is removed and inverted, residual paint on the bottom side of the lid will collected toward the center of the concave portion to eliminate paint spill over the sides of the lid. The handle 84 may have a suitable shape, for example, the handle 84 may include substantially parallel sides or the handle 84 may include concave sides providing an ergonomic gripping surface for the user's hand. The handle 84 may be substantially flush with a top of the annular wall 82 or curve above or below the top of the annular wall 82. In an embodiment where the handle is curved above the top of the annular wall 82, the handle 84 remains at a height that when the lid 14 is attached to the container body 12, the handle 84 does not extend above the lip 46 of the second portion 22 to not interfere with stacking of the container 10.

The lid 14 also includes at least one channel 88 in an outer surface of the annular wall 82 opening toward the base 80, and as shown a plurality of circumferentially spaced channels 88 corresponding in number to the plurality of circumferentially spaced protrusions 66. The embodiment shown includes four evenly spaced channels 88 corresponding to four evenly spaced protrusions 66. Each channel 88 includes a first or vertical leg 90 having an open end 92 that opens to the base 80 of the lid 14 and a second or horizontal leg 94 having a closed end 96 that extends from and is substantially perpendicular to the first leg 90. As shown, each channel 88 is substantially "L" shaped, with the first leg 90 having a length less than a length of the second leg 94. In an embodiment, the lid 14 may also include a groove in an outer surface thereof for receiving a suitable seal for sealing the lid 14 to the container body 12. Alternatively, the inner wall 52 of the container body 12 may include a groove for receiving a suitable seal for sealing the lid 14 to the container body 12.

The lid 14 is configured to be attached to the second portion 22 of the container body 12 in a manner that allows the lid 14 to be attached to and removed from the container body 12 without using a tool and without using a threaded connection or a chime-type connection utilized by standard coating containers. In an embodiment, a twist and lock attachment is provided allowing the lid 14 to be attached to the second portion 22 of the container body 12 below the lip 46 providing a recessed closure that eliminates headspace and does not interfere with stacking. To lock the lid 14 to the container body 12, the lid 14 is lowered over the opening 54 in the second portion 22 with the open end 92 of the each first leg 90 being aligned with one of the respective protrusions 66 projecting from inner wall 52. The protrusions 66 are received in the open end 92 of the channels 88 and the lid 14 lowered until the protrusions 66 bottom out on the respective channel 88 at the intersection between the first and second legs 90 and 94. The lid 14 is then rotated relative to the container body 12 thereby advancing the protrusions 66 through the respective second legs 94 of the channels 88. For example, the lid 14 may be rotated in a clockwise direction until the protrusions 66 abut the closed end 96 of the respective second leg 94 thereby locking the lid 14 to the container body 12.

Figure 13:
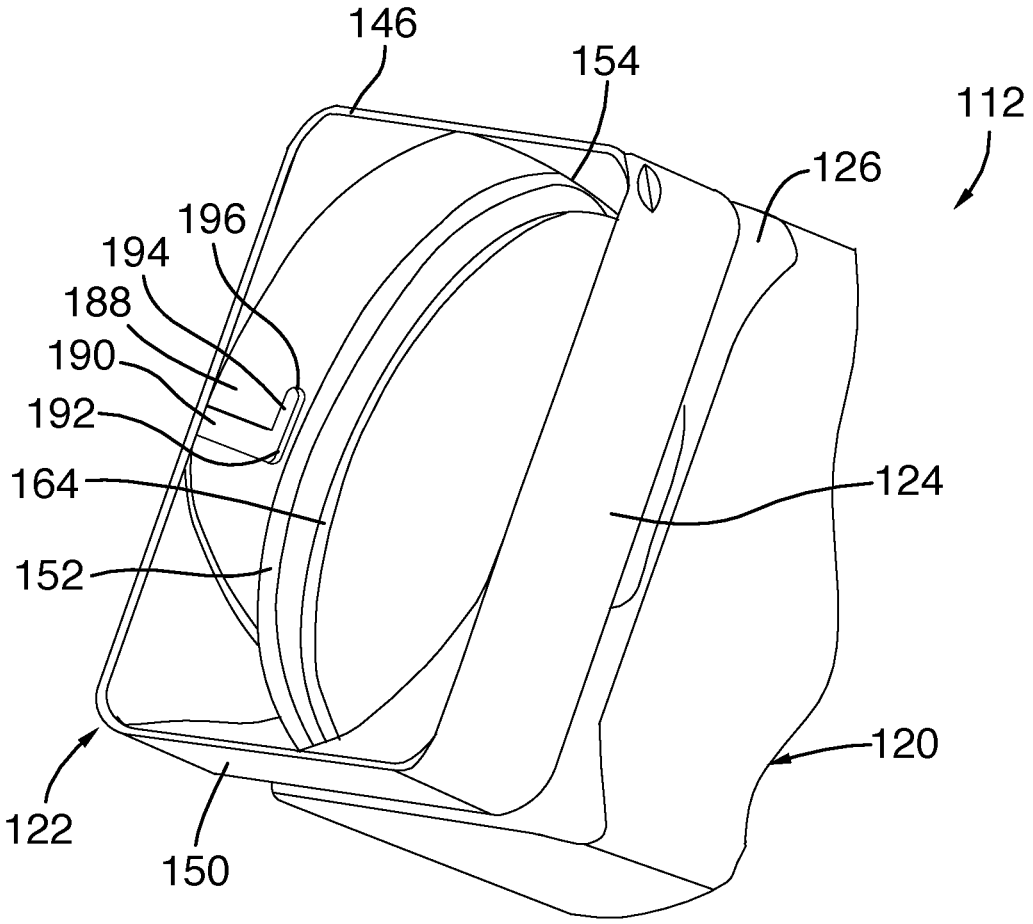
FIG. 13 is a partial perspective view of another exemplary container body.
Figure 14:
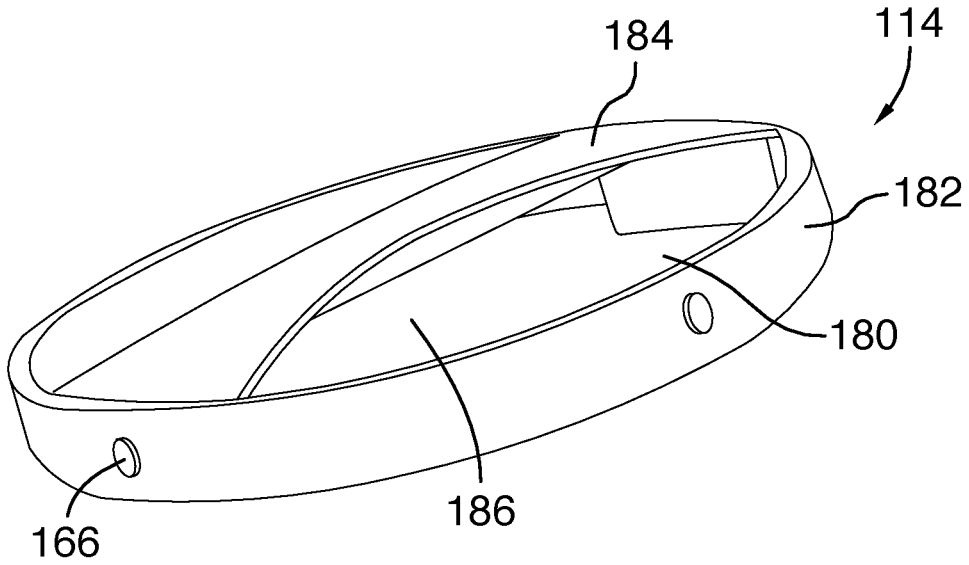
FIG. 14 is a perspective view of another exemplary lid.

Turning now to FIGS. 13 and 14, an exemplary embodiment of the container body and lid are shown at 112 and 114 respectively. The container body 112 and lid 114 are substantially the same as the above-referenced container body 12 and lid 14, and consequently the same reference numerals but indexed by 100 are used to denote structures corresponding to similar structures in the container bodies and lids. In addition, the foregoing description of the container body 12 and lid 14 is equally applicable to the container body 112 and lid 114 except as noted below.

The container body 112 includes a first portion 120 for holding the coating material and a second portion 122 for attaching to the lid 114. The second portion 122 is spaced from the first portion 120 in a longitudinal direction by a collar 124 defining a gap 126 between the first and second portions 120 and 122. The second portion 122 has an outer wall 150 that is substantially rectangular, and as shown substantially square, and an inner wall 152 that is substantially circular and that defines an opening 154 for access to the cavity in the first portion 120. The second portion 122 includes the lip 146 extending upward around the outer wall 150, and a ledge 164 extending radially inwardly from a bottom of the inner wall 152 to define a seat for the lid 114.

The second portion 122 also includes at least one channel 188 in the inner wall 152 opening to a top of the inner wall 152, and as shown a plurality of circumferentially spaced channels 188. Each channel 188 includes a first or vertical leg 190 having an open end 192 that opens to the top of the inner wall 152 and a second or horizontal leg 194 having a closed end 196 that extends from and is substantially perpendicular to the first leg 190. As shown, each channel 188 is substantially "L" shaped.

The lid 114 includes a base 180, an annular wall 182 extending upward from the base 180, and a handle 184 extending between sides of the annular wall 182 defining a cavity 186 between the handle 184 and the upper surface of base 180 for a user's hand to be received. The lid 114 also includes at least one protrusion 166 that extends radially outwardly from the annular wall 182, and as shown a plurality of circumferentially spaced radially outwardly extending protrusions 166 corresponding in number to the plurality of circumferentially spaced channels 188.

The lid 114 is configured to be attached to the second portion 122 of the container body 112 via a twist and lock attachment. To lock the lid 114 to the container body 112, the lid 114 is lowered over the opening 154 in the second portion 122 with the protrusions 166 being aligned with a respective one of the open ends 192 of the first legs 190 of the channels 188. The protrusions 166 are received in the open ends 192 of the channels 188 and the lid 114 lowered until the protrusions 166 bottom out on the respective channel 188 at the intersection between the first and second legs 190 and 194. The lid 114 is then rotated relative to the container body 112 thereby advancing the protrusions 166 through the respective second legs 194 of the channels 188. For example, the lid 114 may be rotated in a clockwise direction until the protrusions 166 abut the closed end 196 of the respective second leg 194 thereby locking the lid 114 to the container body 112.

Figure 15:
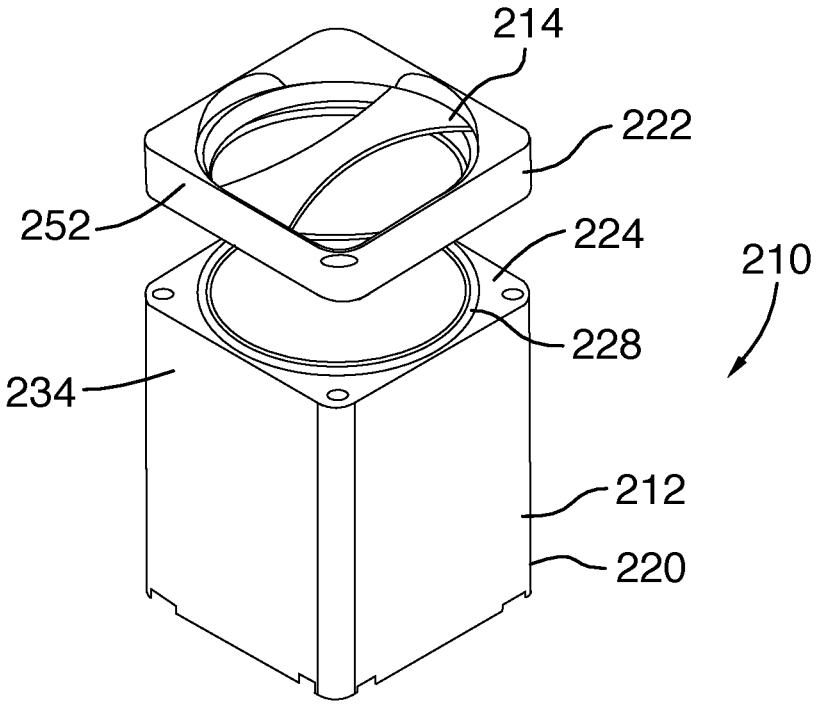
FIG. 15 is a perspective view of yet another exemplary storage container.
Figure 16:
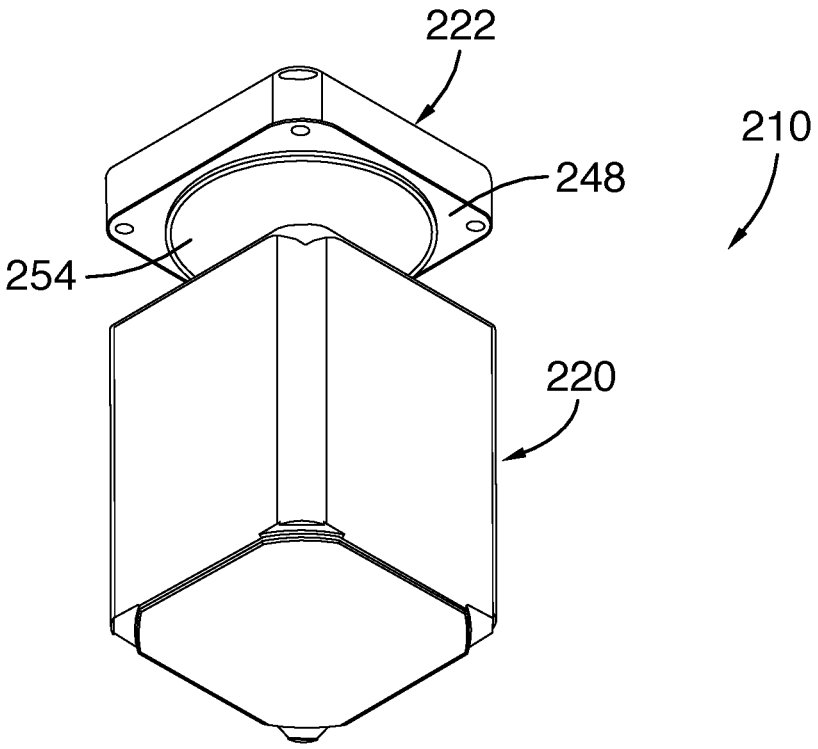
FIG. 16 is another perspective view of the storage container.

Turning now to FIGS. 15 and 16, an exemplary embodiment of the storage container is shown at 210. The storage container 210 is substantially the same as the above-referenced storage container 10, and consequently the same reference numerals but indexed by 200 are used to denote structures corresponding to similar structures in the storage containers. In addition, the foregoing description of the storage container 10 is equally applicable to the storage container 210 except as noted below.

The storage container 210 includes a container body 212 and a lid 214 removably attached to the container body 212. The container body 212 includes a first portion 220 for holding the coating material and a second portion 222 for attaching to the lid 214, which may be attached to the second portion 222 in a suitable manner, such as described above. The first portion 220 and the second portion 222 are formed as separate components that may be attached together. For example, the first portion 220 may be filled with the coating material and the lid 214 attached to the second portion 222, and then the first and second portions 220 and 222 may be permanently attached together in a suitable manner.

The second portion 222 is spaced from the first portion 220 in a longitudinal direction by a collar 224 defining a gap between the first and second portions 220 and 222. The collar 224 may be formed by a first collar 228 on the first portion 220 and a second collar 248 on the second portion that are aligned and coupled together to couple the first and second portions 220 and 222. The first collar 228 projects upward from the first portion 220 and defines an opening into a cavity 234 for receiving coating material, and the second collar 248 projections downward from an inner wall 252 of the second portion 222 and defines an opening 254.

Figure 17:
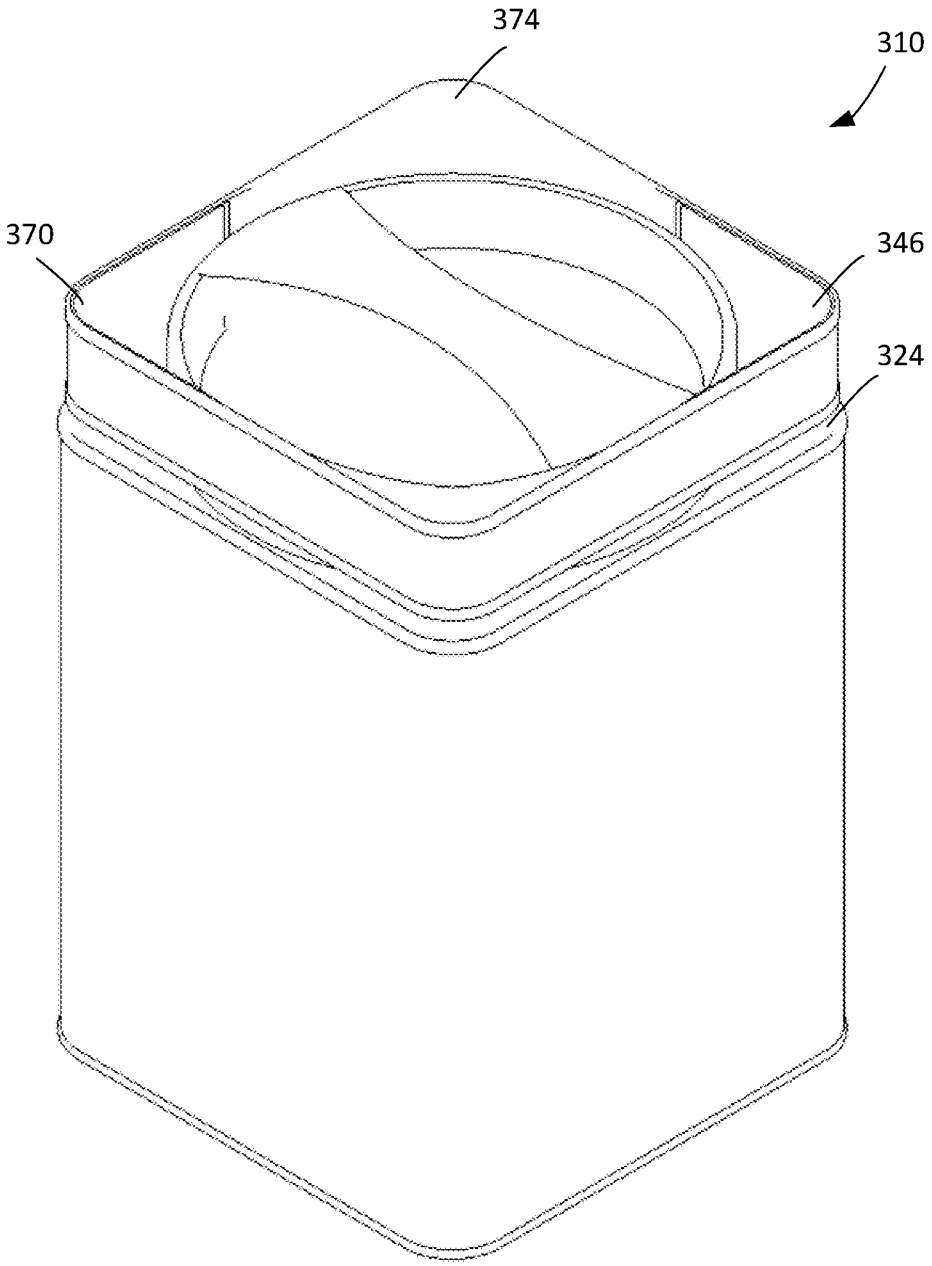
FIG. 17 is a perspective view of a further exemplary storage container.
Figure 18:
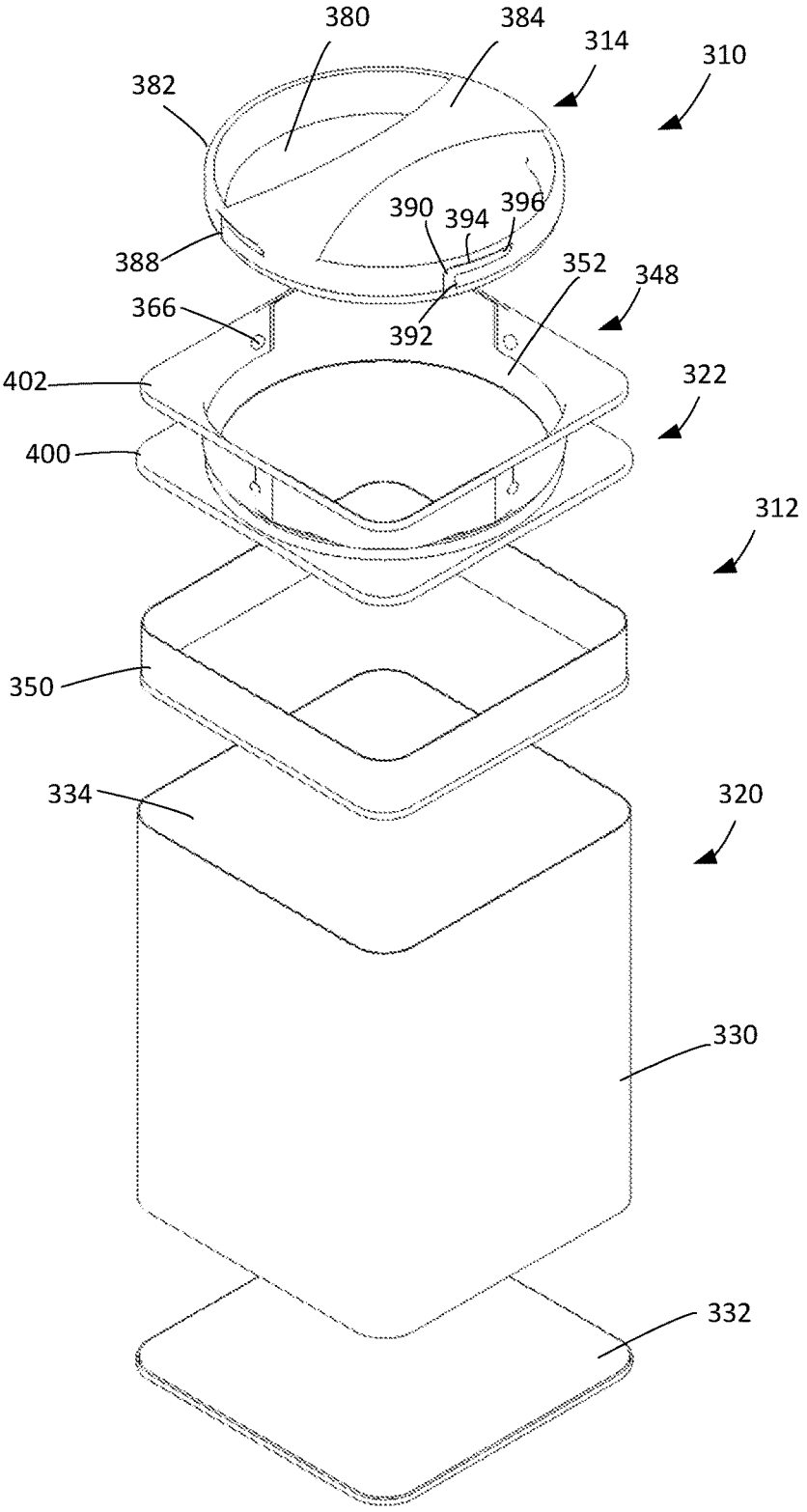
FIG. 18 is an exploded view of the storage container.
Figure 19:
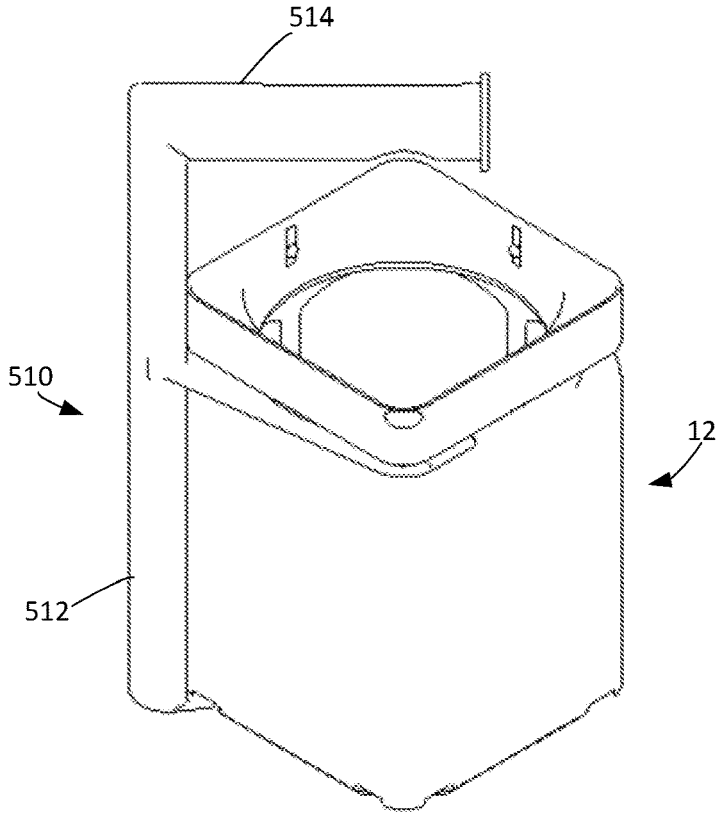
FIG. 19 is a perspective view of a handle attachment attached to the container body.
Figure 20:
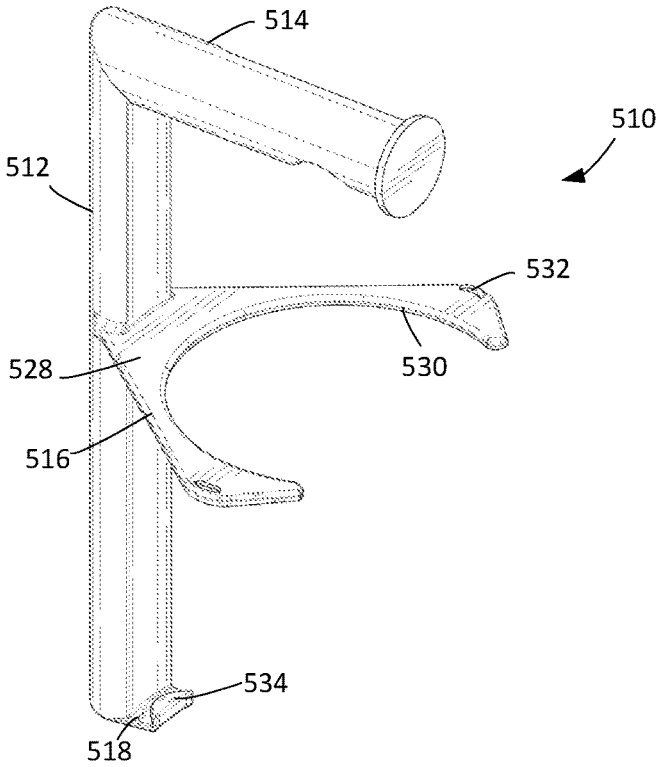
FIG. 20 is a perspective view of the handle attachment.
Figure 21:
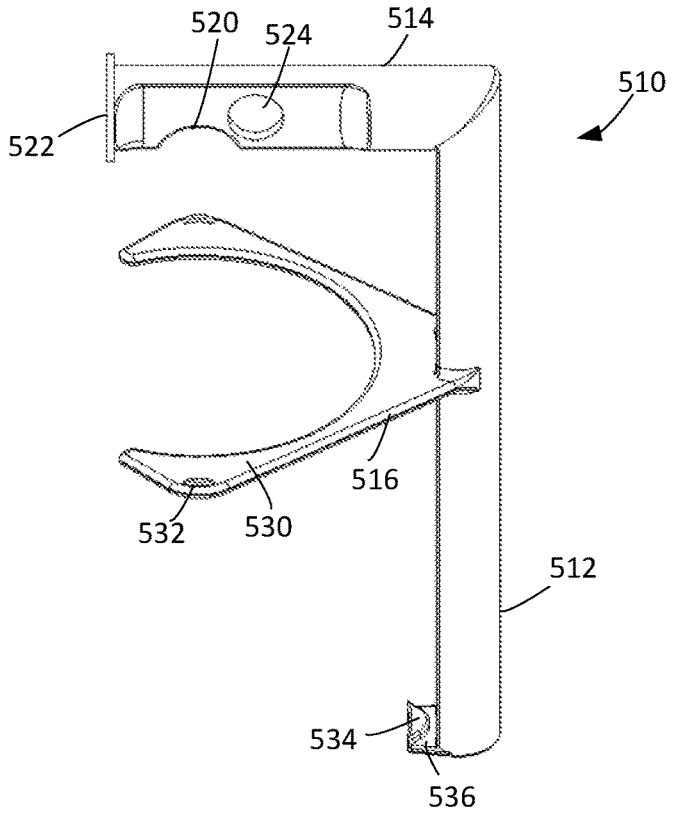
FIG. 21 is another perspective view of the handle attachment.
Figure 22:
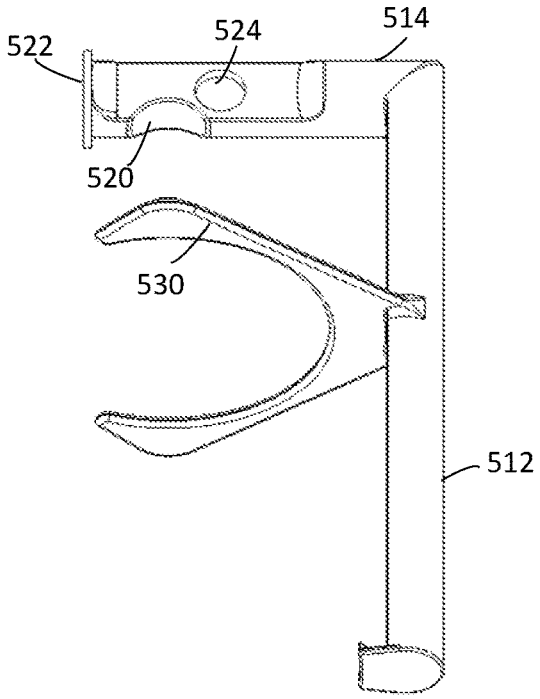
FIG. 22 is still another perspective view of the handle attachment.
Figure 23:
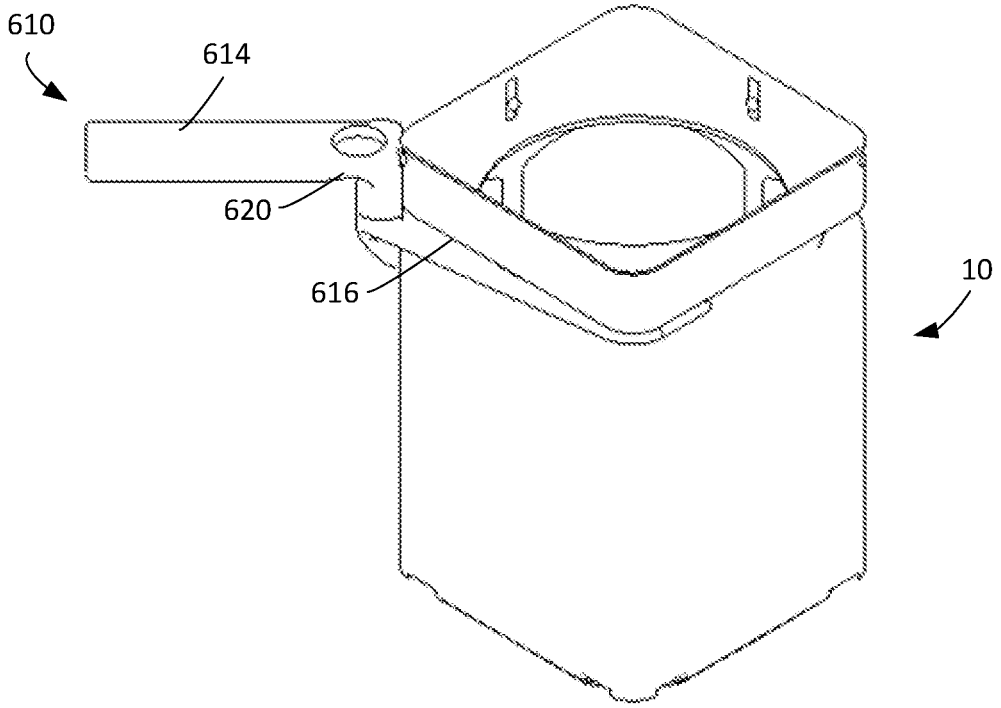
FIG. 23 is a perspective view of another handle attachment attached to the container body.
Figure 24:
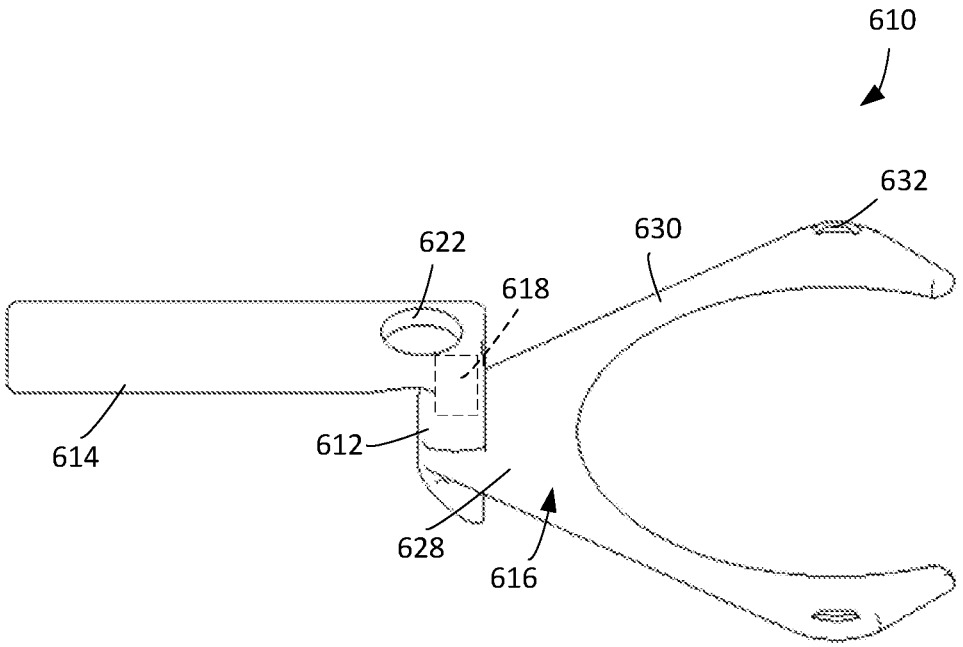
FIG. 24 is a perspective view of the handle attachment.
Figure 25:
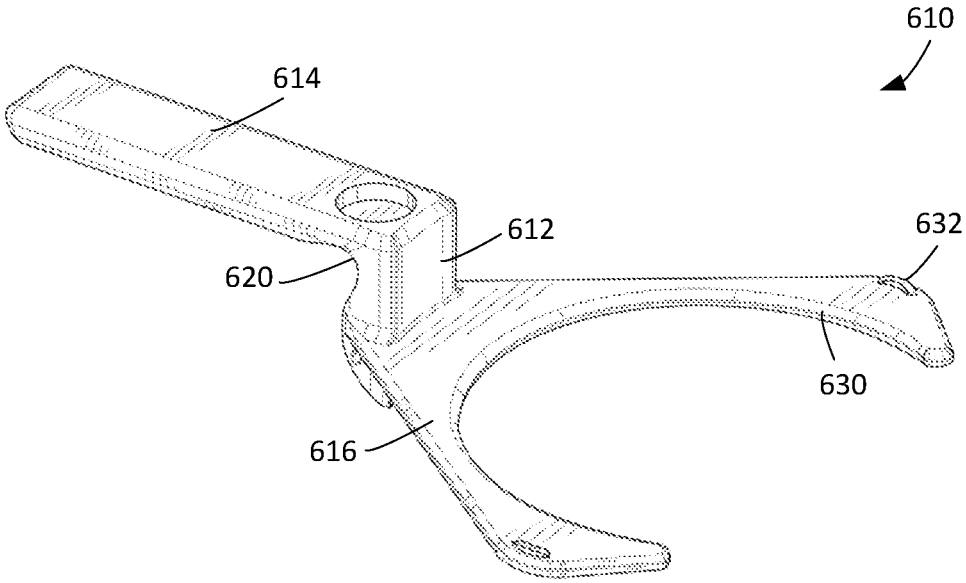
FIG. 25 is another perspective view of the handle attachment.
Figure 26:
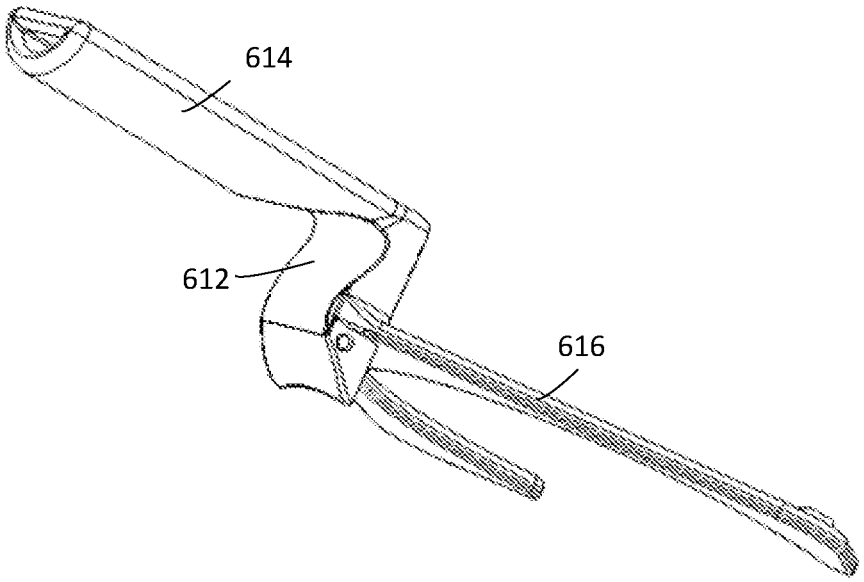
FIG. 26 is still another perspective view of the handle attachment.

Turning now to FIGS. 17 and 18, an exemplary embodiment of the storage container is shown at 310. The storage container 310 is substantially the same as the above-referenced storage container 10, and consequently the same reference numerals but indexed by 300 are used to denote structures corresponding to similar structures in the storage containers. In addition, the foregoing description of the storage container 10 is equally applicable to the storage container 310 except as noted below.

The storage container includes a container body 312 that may hold a suitable coating material, such as paints, stains, varnishes, chemicals, etc., and a lid 314 removably attached to the container body 312. The container body 12 and the lid 14 may be made out of a suitable material, such as metal, etc., and may be made in a suitable manner.

The container body 312 includes a first portion 320 for holding the coating material and a second portion 322 for attaching to the lid 314. The first portion 320 has a wall 330 with open top and bottom ends. The bottom end is closed by a bottom portion 332 coupled to the bottom of the wall 330. The wall 330 and bottom portion 332 define a cavity 334 for receiving the coating material.

The second portion 322 has an outer wall 350 that is substantially rectangular, and as shown substantially square, which is configured to surround an inner member 348 of the second portion 322. The inner member 348 includes an inner wall 352 that is substantially circular and that defines an opening 354 for access to the cavity 334 in the first portion 320, a base 400 projecting outward from a bottom of the inner wall 352 that is configured to attach to the open top of the wall 330, and a top portion 402 projecting outward from a top of the inner wall 352. The outer wall 350 has a height less than a height of the inner member 348 such that when the outer wall 350 is attached to the inner member 348, a gap 324 will be defined between a bottom of the outer wall 350 and the base 400.

The top portion 402 of the second portion 322 includes a lip 346 extending upward and a ledge may be provided that extends radially inwardly from a bottom of the inner wall 352 to define a seat for the lid 314. The second portion 322 also includes at least one protrusion 366 that extends radially inwardly from the inner wall 352 or other suitable location on the second portion 322, and as shown a plurality of circumferentially spaced radially inwardly extending protrusions 366. The plurality of circumferentially spaced radially inwardly extending protrusions 366 each may have a suitable shape, such as a generally cylindrical shape.

A pour spout 370 may be defined in a corner of the top portion 402, and as shown, a pour spout 370 is defined in two corners diagonal from one another. It will be appreciated that the container 310 could be designed to include a pour spout in each of the corners of the container 310. The pour spouts 370 are curved from the lip 346 toward the inner wall 350 to allow the coating material to be poured from the cavity 334 in the first portion 320 and to allow the coating material to drip back into the cavity 334. The remaining corners may include respective planar portions 374 below the lip 346.

The lid 314, which is substantially circular in shape, includes a base 380, an annular wall 382 extending upward from the base 380, and a handle 384 extending between sides of the annular wall 382 defining a cavity 386 between the handle 384 and the upper surface of the base 380 for a user's hand to be received. The lid 314 also includes at least one channel 388 in an outer surface of the annular wall 382 opening toward the base 380, and as shown a plurality of circumferentially spaced channels 388 corresponding in number to the plurality of circumferentially spaced protrusions 366. The embodiment shown includes four evenly spaced channels 388 corresponding to four evenly spaced protrusions 366. Each channel 388 includes a first or vertical leg 390 having an open end 392 that opens to the base 380 of the lid 314 and a second or horizontal leg 394 having a closed end 396 that extends from and is substantially perpendicular to the first leg 390. As shown, each channel 388 is substantially "L" shaped, with the first leg 390 having a length less than a length of the second leg 394.

Turning now to FIGS. 19-30, a plurality of functional attachments are shown that are removably attached to any of the above-described storage containers 10, 110, 210, and 310, but for the purposes of this description the storage container 10 will be referenced. The attachments each include an attachment portion that is attached to one or more locations on the storage containers and a functional portion assisting a user in performing a task.

Referring now to FIGS. 19-22, a handle attachment is illustrated at reference numeral 510. The handle attachment 510 includes a first or vertical bar 512, a second or horizontal bar 514 projecting from a top of the first bar 512 substantially perpendicular to the first bar 512, a first attachment portion 516, and a second attachment portion 518. The first attachment portion 516 projects from the first bar 512 below the second bar 514 substantially perpendicular to the first bar 512 for attaching to the anchor point 62, and a second attachment portion 518 projects from a bottom of the first bar 512 substantially perpendicular to the first bar 512 for attaching to the anchor point 42.

The first and second bars 512 and 514 may have any suitable shape, such as a substantially cylindrical shape. In the illustrated embodiment, the first bar 512 has a substantially flat side facing the container 10 to abut the outer surface of the container 10. The first and second bars 512 and 514 may have fixed lengths or may have adjustable lengths, for example via telescopic sections. The second bar 514 may include a notch 520, an end cap 522 at its end opposite the end attached to the first bar 512, and a slot 524 for receiving a magnet or another attachment, for example a peg for hanging a paintbrush. The notch 520 is centered over the container when attached for balanced hanging, for example on a ladder, and may be used as a finger grip when help by the user. The second bar 514 may additionally or alternatively include a vertical notched area that can provide a flat surface to accommodate a magnet. The second bar 514 is configured to be grasped by a user to transport and use the container 10, for example during application of the coating material when the lid 14 is removed. The second bar 514 is also configured to be hung from a suitable area, for example from a ladder.

The first attachment portion 516 has a base 528 attached to the first bar 512 and a pair of arms 530 that project away from the base 528. The arms 530 each have a curved inside surface to correspond to the circular outer surface of the inner wall 52 of the second portion 22 such that the combined inner surface of the arms 530 is semicircular in shape. Projecting upward from each arm 530 is a protrusion 532. Each protrusion is configured to engage one of the anchor points 62 of the second portion 22 to secure the handle attachment 510 to the container. The second attachment portion 518 similarly includes a protrusion 534 projecting upward therefrom for being received in the anchor point 42 defined by the channel in the bottom portion 32.

The protrusion 534 is spaced from the first bar 512 to define a gap 536 for receiving one of the projections 38 on the bottom portion 32 of the first portion 20.

To attach the handle attachment 510 to the container 10, the handle attachment 510 is advanced toward the container until the first bar 512 is proximate or abutting one of the flat sides of the container 10 and the first attachment portion 516 is received in the gap 26 with the inner surfaces of the arms 530 proximate or abutting the outer surface 60 of the inner wall 52. The container 10 and handle attachment 510 are then rotated relative to one another until the first bar 512 is at one of the corners 40 of the container body 12. During rotation, the protrusion 534 of the second attachment portion 518 enters the channel 42, which opens to adjacent sides of the wall 30, at the corner 40, and the projection 38 at the corner 40 is received in the gap 536 between the protrusion 534 and the first bar 512. Moreover, during rotation, the protrusions 532 move through the cavity 56 formed between the inner surface 58 of the outer wall 50 and the outer surface 60 of the inner wall 52 until the first bar 512 is at the corner 40 at which point the protrusions 532 are positioned at the anchor points 62. The interaction between the protrusions 532 and the anchor points 62, and the protrusion 534 and the projection 38 holds the handle attachment 510 relative to the container 10. To detach the handle attachment 510 from the container, the handle attachment 510 and container 10 are rotated relative to one another causing the protrusion 534 to exit the channel 42 and the protrusions 532 to move away from the anchor points 62 allowing the handle attachment 510 to be removed.

Referring now to FIGS. 23-26, a handle attachment is illustrated at reference numeral 610. The handle attachment includes a first or vertical bar 612, a second or horizontal bar 614 projecting from a top of the first bar 612 substantially perpendicular to the first bar 612, and an attachment portion 616. The attachment portion 616 projects from the first bar 612 below the second bar 614 substantially perpendicular to the first bar 612 and in an opposite direction from the second bar 614 for attaching to the anchor point 62.

The first and second bars 612 and 614 may have any suitable shape. In the illustrated embodiment, the first bar 612 has a substantially flat side facing the container 10 to abut the outer surface of the container 10 and the second bar 614 has a substantially flat side facing upward. The other surfaces may be curved for user comfort. The first and second bars 612 and 614 may have fixed lengths or may have adjustable lengths, for example via telescopic sections. The first and/or second attachment bars 612 or 614 may have a magnet disposed within it for holding a paintbrush to allow coating material to drip back into the container 10. As illustrated, a magnet 618 is disposed in the first bar 612. Additionally or alternatively, an opening 622 may be provided for receiving a magnet. It will be appreciated that other suitable attachments, such as clips, may be provided to hold a paintbrush. The second bar 614 may include a finger grip portion 620 and an opening extending therethrough for receiving a suitable attachment, such as a strap for wrapping around a user's wrist. The second bar 614 is configured to be grasped by a user to transport and utilize the container 10, for example during application of the coating material when the lid 14 is removed. When the handle attachment 610 is used as a cut bucket handle, the user may grasp the second bar 614 and position the user's thumb in the adjacent spout 70 providing for an ergonomic design.

The attachment portion 616 has a base 628 attached to the first bar 612 and a pair of arms 630 that project away from the base 628. The arms 630 each have a curved inside surface to correspond to the circular outer surface of the inner wall 52 of the second portion 22 such that the combined inner surface of the arms 630 is semicircular in shape. Projecting upward from each arm 630 is a protrusion 632. Each protrusion is configured to engage one of the anchor points 62 of the second portion 22 to secure handle the attachment 610 to the container 10.

To attach the handle attachment 610 to the container 10, the handle attachment 610 is advanced toward the container until the first bar 612 is proximate or abutting one of the flat sides of the container 10 and the first attachment portion 616 is received in the gap 26 with the inner surfaces of the arms 630 proximate or abutting the outer surface 60 of the inner wall 52. The container 10 and handle attachment 610 are then rotated relative to one another until the protrusions 632 move through the cavity 56 formed between the inner surface 58 of the outer wall 50 and the outer surface 60 of the inner wall 52 until the first bar 612 is at a corner 40 at which point the protrusions 632 are positioned at the anchor points 62. The interaction between the protrusions 632 and the anchor points 62 holds the handle attachment 610 relative to the container 10. To detach the handle attachment 610 from the container, the handle attachment 610 and container 10 are rotated relative to one another causing the protrusions 632 to move away from the anchor points 62 allowing the handle attachment 610 to be removed.

Figure 27:
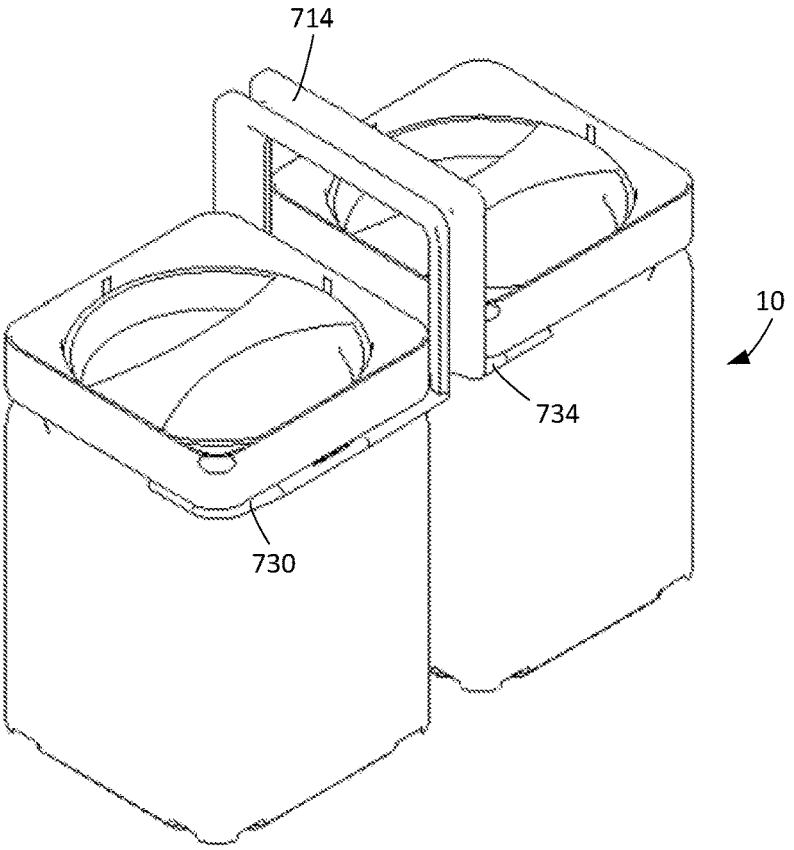
FIG. 27 is a perspective view of yet another handle attachment attached to a pair of storage containers.
Figure 28:
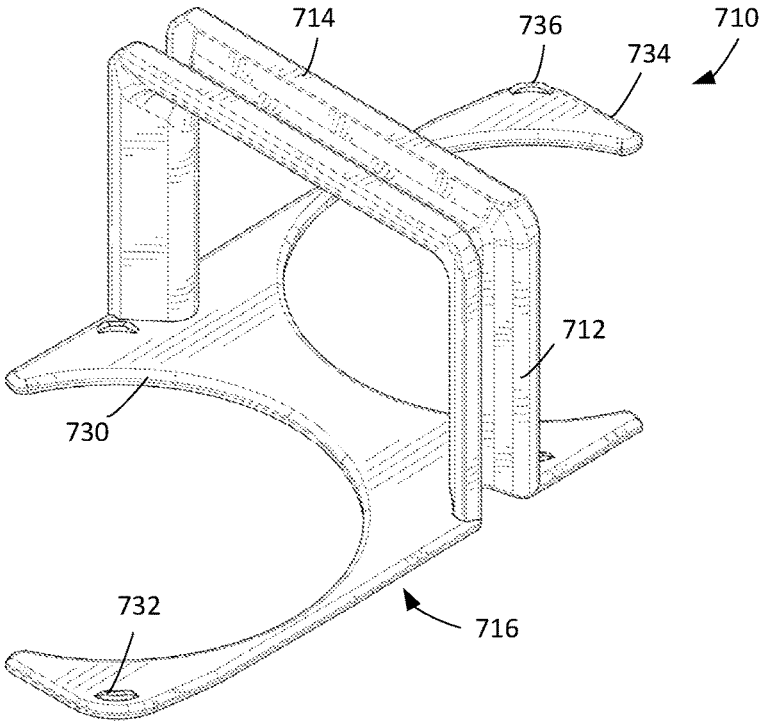
FIG. 28 is a perspective view of the handle attachment.

Referring now to FIGS. 27 and 28, a handle attachment is illustrated at reference numeral 710. The handle attachment includes a pair of first or vertical bars 712, a second or horizontal bar 714 extending between and projecting from tops of the first bars 712 substantially perpendicular to the first bars 712 to form a handle, and an attachment portion 716 projecting from bottoms of the first bars 712.

The first and second bars 712 and 714 may have any suitable shape, such as a substantially U-shaped cross-section. The first bars 712 may have fixed lengths or may have adjustable lengths, for example via telescopic sections. The second bar 714 is configured to be grasped by a user to transport a pair of containers. It will be appreciated that the handle attachment 710 may include slots for a suitable number of containers, and a handle attachment for carrying two containers may be coupled to another handle attachment for carrying two containers in a suitable manner.

The attachment portion 716 has a first pair of arms 730 and a second pair of arms 734 where adjacent ones of the arms are joined proximate an area below the handle. The arms 730 and 734 each have a curved inside surface to correspond to the circular outer surface of the inner wall 52 of the second portion 22 such that the combined inner surface of the arms 730 and the combined inner surface of the arms 734 is each semicircular in shape. The first and second pairs of arms 730 and 734 can be configured such that each pair of arms opens outward with the vertical bars 712 attached between the pairs of arms 730 and 734. Projecting upward from each arm 730 is a protrusion 732 and projecting upward from each arm 734 is a protrusion 736. Each protrusion is configured to engage one of the anchor points 62 of the second portion 22 of the respective container to secure the handle attachment 710 to the container 10.

To attach the handle attachment 710 to a first container 10, the handle attachment 710 and container are advanced toward one another with the flat side of the container facing the opening between the first pair of arms 730 until the first pair of arms 730 is received in the gap 26 with the inner surfaces of the arms 730 proximate or abutting the outer surface 60 of the inner wall 52. The container 10 and handle attachment 710 are then rotated relative to one another until the protrusions 732 move through the cavity 56 formed between the inner surface 58 of the outer wall 50 and the outer surface 60 of the inner wall 52 until the first bars 712 are at adjacent corners at which point the protrusions 732 are positioned at the anchor points 62. To attach the handle attachment 710 to a second container 10 via the second pair of arms 734, a similar process is performed. The interaction between the protrusions 732 and 736 and the anchor points 62 hold the handle attachment 710 relative to the containers 10. To detach the handle attachment 710 from the containers, the handle attachment 710 and containers 10 are rotated relative to one another causing the protrusions 732 and 736 to move away from the anchor points 62 allowing the handle attachment 710 to be removed.

Figure 29:
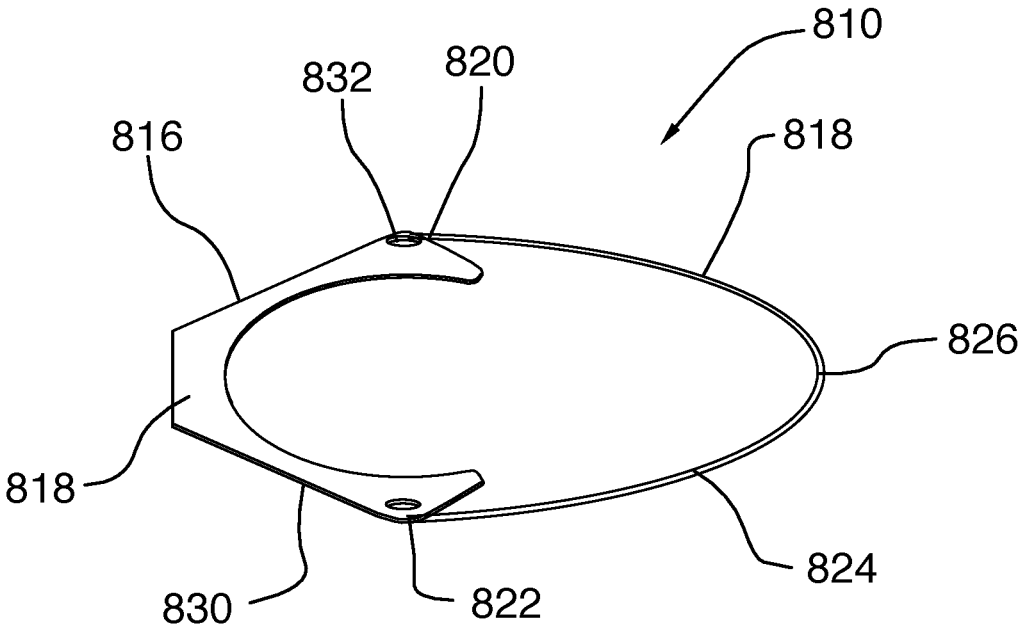
FIG. 29 is a perspective view of a bail attachment.

Referring now to FIG. 29, a bail attachment is illustrated at reference numeral 810. The bail attachment 810 includes an attachment portion 816 and a bail 818 rotatably attached to the attachment portion 816 in a suitable manner. The bail 818 may be made of a suitable material, such as metal, rubber, plastic, etc. The bail 818 includes a first end 820 attached to one side of the attachment portion 816, a second end 822 attached to the other side of the attachment portion 816, and a body 824 between the first and second ends 820 and 822. The bail 818 can additionally include an opening 826 in the body 824, as shown proximate a center of the bail 818, which is configured to receive a ladder hook to allow for hanging from a ladder for example. The bail 818 can be in a first position extending above the cavity 34 to allow the container 10 to be held by the bail 818, or a second position behind the rear of the container 10 to allow the container to be held by the bottom portion 32 and be supported by the bail 818. In the second position, for example, the user can grasp the container, for example with the user's fingers under the bottom portion 32 of the container and the user's palm against the rear of the container, and hook the user's thumb around the bail 818 to hold the container 10 against the user's hand.

The attachment portion 816 has a base 828 and a pair of arms 830 projecting away from the base that each have a curved inside surface to correspond to the circular outer surface of the inner wall 52 of the second portion 22 such that the combined inner surface of the arms 830 is semicircular in shape. Projecting upward from each arm 830 is a protrusion 832. Each protrusion is configured to engage one of the anchor points 62 of the second portion 22 to secure handle the attachment 810 to the container 10. The bail attachment 810 may be attached to the container 10 as described above, for example as described regarding the handle attachment 610.

Figure 30:
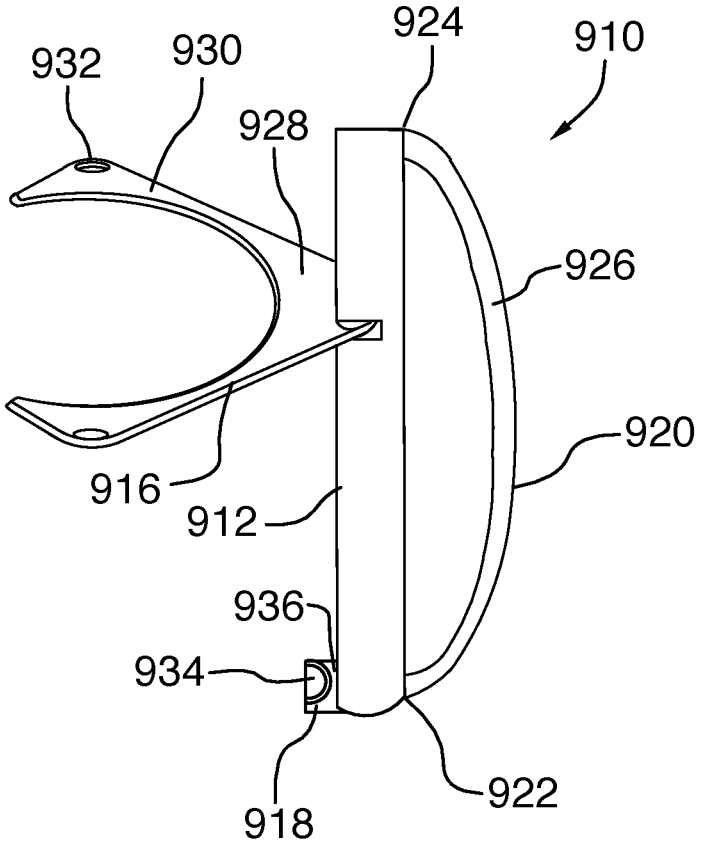
FIG. 30 is a perspective view of another handle attachment.

Referring now to FIG. 30, a handle attachment is illustrated at reference numeral 910. The handle attachment 910 includes a bar 912, a first attachment portion 916, a second attachment portion 918, and a handle 920. The first attachment portion 916 projects from the bar 912 below a top of the bar 912 and substantially perpendicular to the bar 912 for attaching to the anchor point 62, and the second attachment portion 918 projects from a bottom of the bar 912 substantially perpendicular to the bar 912 for attaching to the anchor point 42. The bar 912 may have any suitable shape, such as a substantially cylindrical shape. In the illustrated embodiment, the bar 912 has a substantially flat side facing the container 10 to abut the outer surface of the container 10.

The handle 920, which may be a flexible band, is attached to the bar 912 in a suitable manner. For example, the handle 920 may include a first end 922 rotatably attached to the top of the bar 912, a second end 924 rotatably attached to the bottom of the bar 912, and a substantially planar portion 926 between the first and second ends 922 and 924. The handle 920 may be movable between a first position spaced a first distance from the bar 912, a second position spaced a second distance from the bar 912 less than the first distance, for example to allow a user to grasp an optional bail as discussed above in FIG. 29, and a third position spaced a third distance from bar 912 a greater than the first distance to provide space for a user's hand between the bar 912 and the handle 920.

The first attachment portion 916 has a base 928 attached to the bar 912 and a pair of arms 930 that project away from the base 928. The arms 930 each have a curved inside surface to correspond to the circular outer surface of the inner wall 52 of the second portion 22 such that the combined inner surface of the arms 930 is semicircular in shape. Projecting upward from each arm 930 is a protrusion 932. Each protrusion is configured to engage one of the anchor points 62 of the second portion 22 to secure the handle attachment 910 to the container. The second attachment portion 918 similarly includes a protrusion 934 projecting upward therefrom for being received in the anchor point 42 defined by the channel in the bottom portion 32. The protrusion 934 is spaced from the bar 912 to define a gap 936 for receiving one of the projections 38 on the bottom portion 32 of the first portion 20. The handle attachment 910 may be attached to the container 10 as described above, for example as described regarding the handle attachment 510.

It will be appreciated that other suitable attachments may be attached to the container 10, for example a ladder hook attachment, a coating material tray attachment, etc. It will also be appreciated that the attachments may be molded as one piece or as separate pieces permanently or removably attached to one another.

Figure 31:
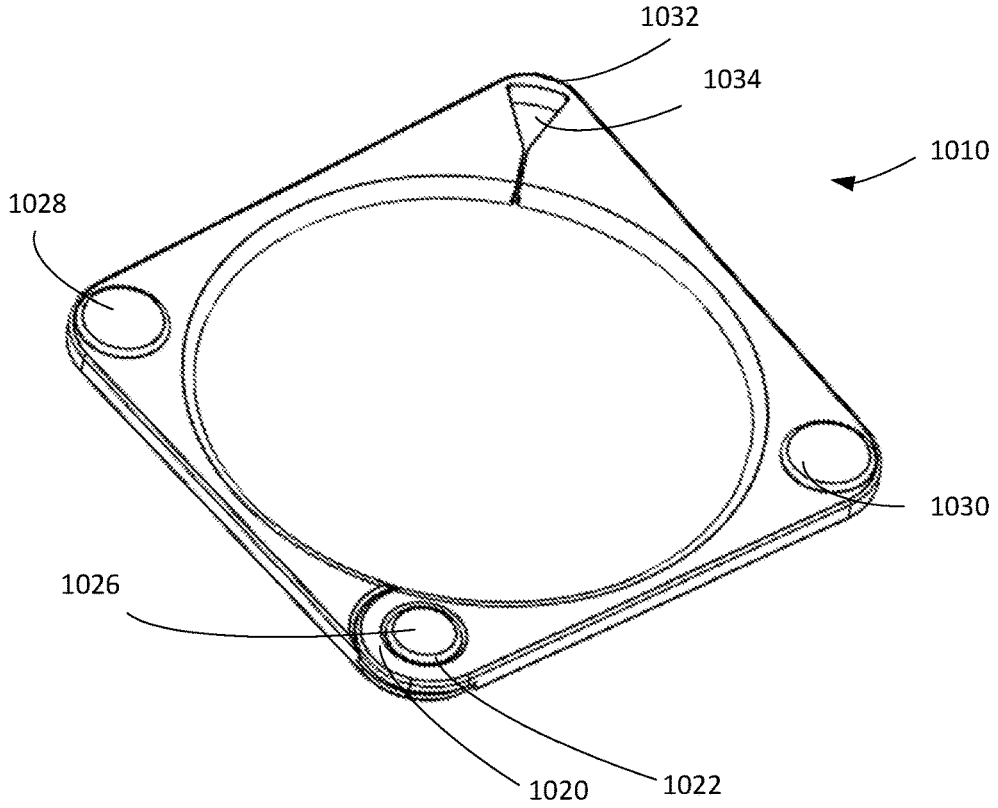
FIG. 31 is a perspective view of a handle attachment strap.
Figure 32:
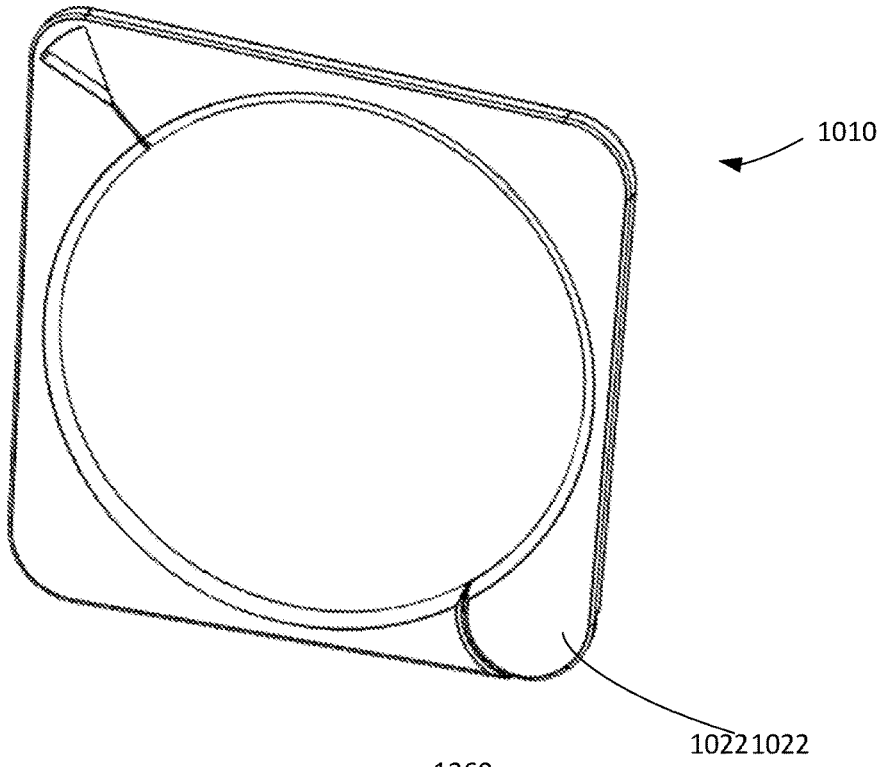
FIG. 32 is another perspective view of the handle attachment strap.
Figure 33:
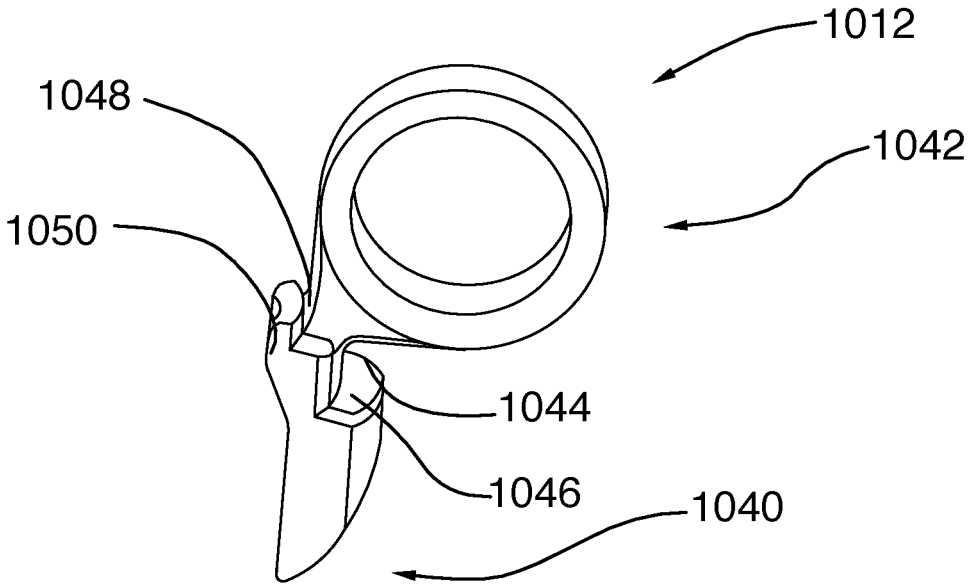
FIG. 33 is a perspective view of a handle attachment for use with the handle attachment strap.

Turning now to FIGS. 31-33 an attachment strap and a functional attachment are illustrated at 1010 and 1012 respectively. The attachment strap, referred to herein also as the handle attachment strap 1010 and the functional attachment, referred to herein also as the handle attachment 1012 may be removably attached to any of the above or below described storage containers. The handle attachment strap 1010 attaches to one or more locations on the storage containers and the handle attachment 1012 assists a user in performing a task. Although the handle attachment 1012 is shown as a finger loop, it will be appreciated that the above-described functional portions, such as handles, straps, cut bucket handles, bails, etc. may also be utilized.

Referring now to FIGS. 31 and 32, the handle attachment strap 1010 may be flexible, such as a plastic strap, and has an outer profile substantially matching the outer profile of the container and an inner profile substantially matching the profile of the collar of the container. For example the outer profile of the attachment strap 1010 is substantially square and the inner profile is substantially circular. The handle attachment strap 1010 has a first end 1020 with an opening 1022 or recess and a second end 1024 with a projection 1026 configured to be received in the opening 1022 or recess and to secure to the opening via a snap lock connection at one corner of the handle attachment strap 1010. The projection 1026 may extend above an upper surface of the handle attachment strap 1010 to engage in an anchor point, for example one of the anchor points 62 of the container, along with projections 1028 and 1030 on adjacent corners of the handle attachment strap 1010. The corner 1032 opposite the corner formed by the attachment of the first and second ends 1020 and 1024 includes an opening 1034 that opens to the inner profile to allow for flexing of the attachment strap 1010 during installation and that receives the handle attachment 1012. The attachment strap 1010 provides for a complete surrounding of the container to provide for a secure connection.

Referring now to FIG. 33, the handle attachment 1012 includes an attachment portion 1040 for attaching to a container and the handle attachment strap 1010, and a functional portion 1042, for example in the form of a loop, to assist the user in performing a task, such as lifting the container. The attachment portion 1040 includes a first slot 1044 on one side defined between a ledge 1046 and the functional portion 1042 that receives the corner 1032 of the handle attachment strap 1010, and a second slot 1048 on an opposite side defined between a ledge 1050 and the functional portion 1042 that receives the outer wall, for example the outer wall 50 of the container. As shown the first and second slots 1044 and 1048 extend in direction perpendicular to one another.

Figure 34:
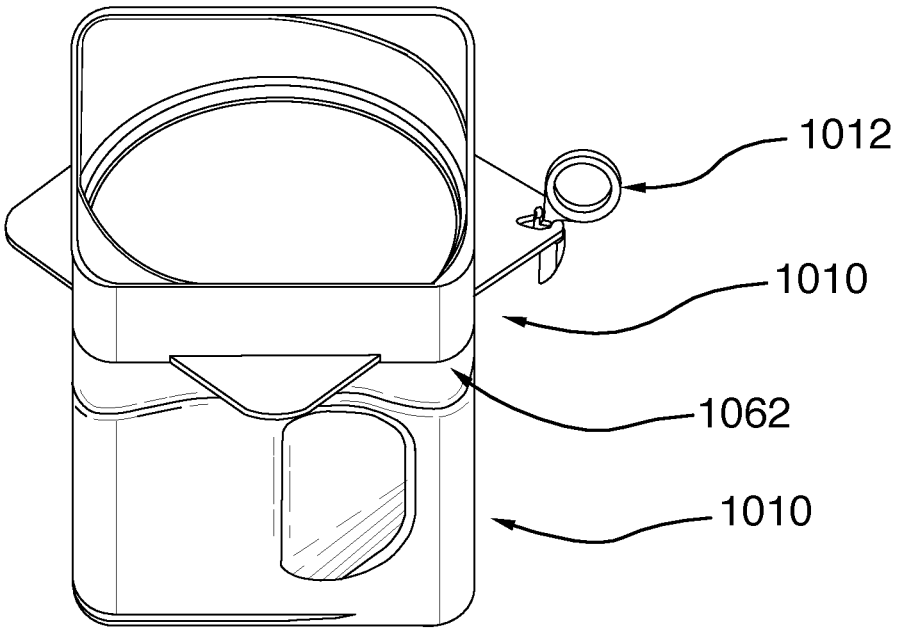
FIG. 34 is a perspective view of the handle attachment strap and handle attachment being attached to a container.
Figure 35:
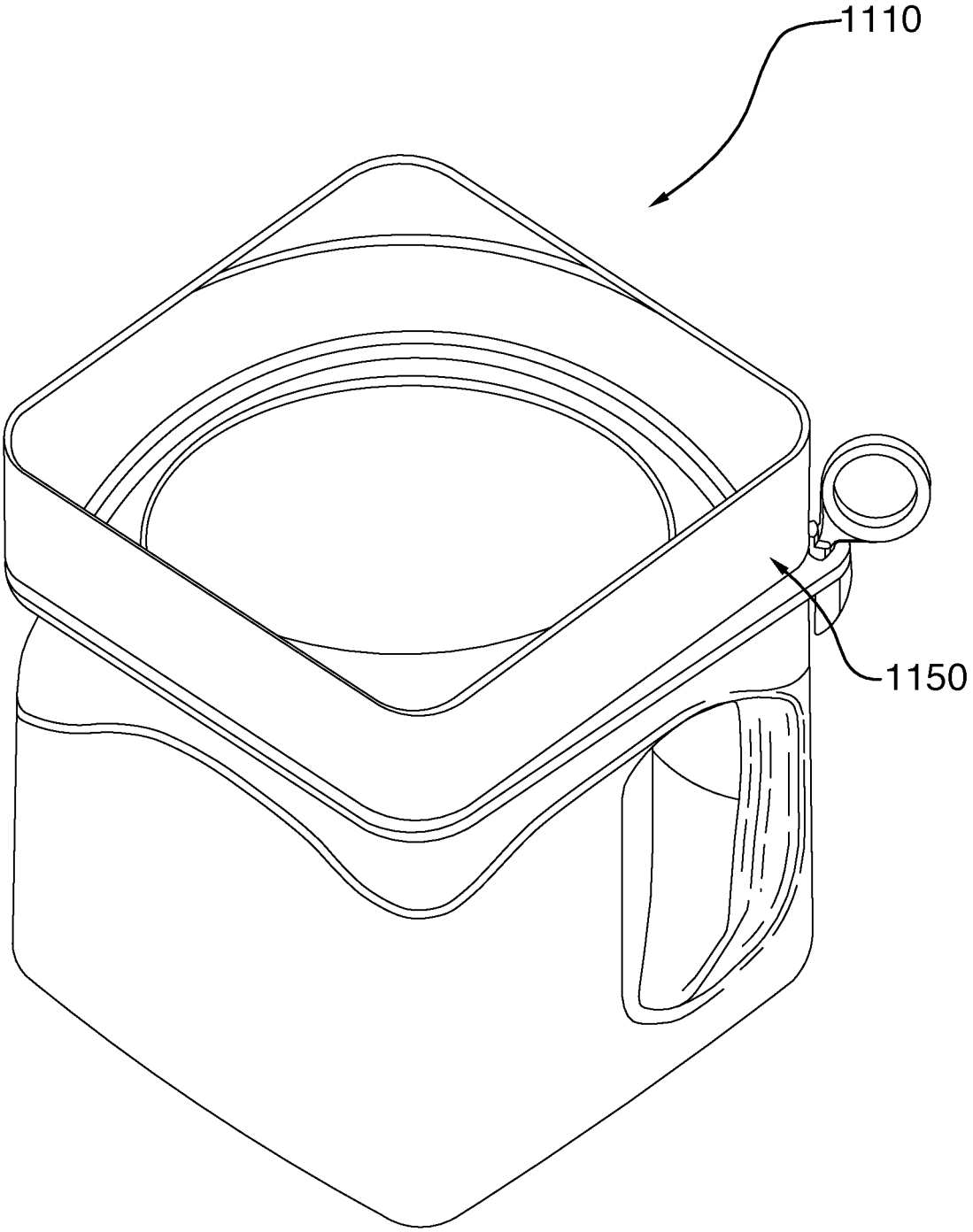
FIG. 35 is a perspective view of the container with the handle attachment strap and handle attachment strap attached thereto.

As shown in FIG. 34, to attach the handle attachment strap 1010 and handle attachment 1012 to a container, for example container 1110 discussed below, the first and second ends 1020 and 1024 of the attachment strap 1010 are moved away from one another to position the attachment strap 1010 around the collar of the container 1110 and then the projection 1026 is attached to the opening 1022 with the corners of the attachment strap 1010 being positioned away from the corners of the container 1110. The container 1110 and the attachment strap 1010 are then rotated relative to one another in a similar manner as the handle attachments described above until the projections 1026, 1028, and 1030 are received in the anchor points 1162 of the container 1110 as shown in FIG. 35. During the rotation, the second slot 1048 receives an outer wall 1150 of the container to secure the handle attachment 1012 to the container.

Figure 36:
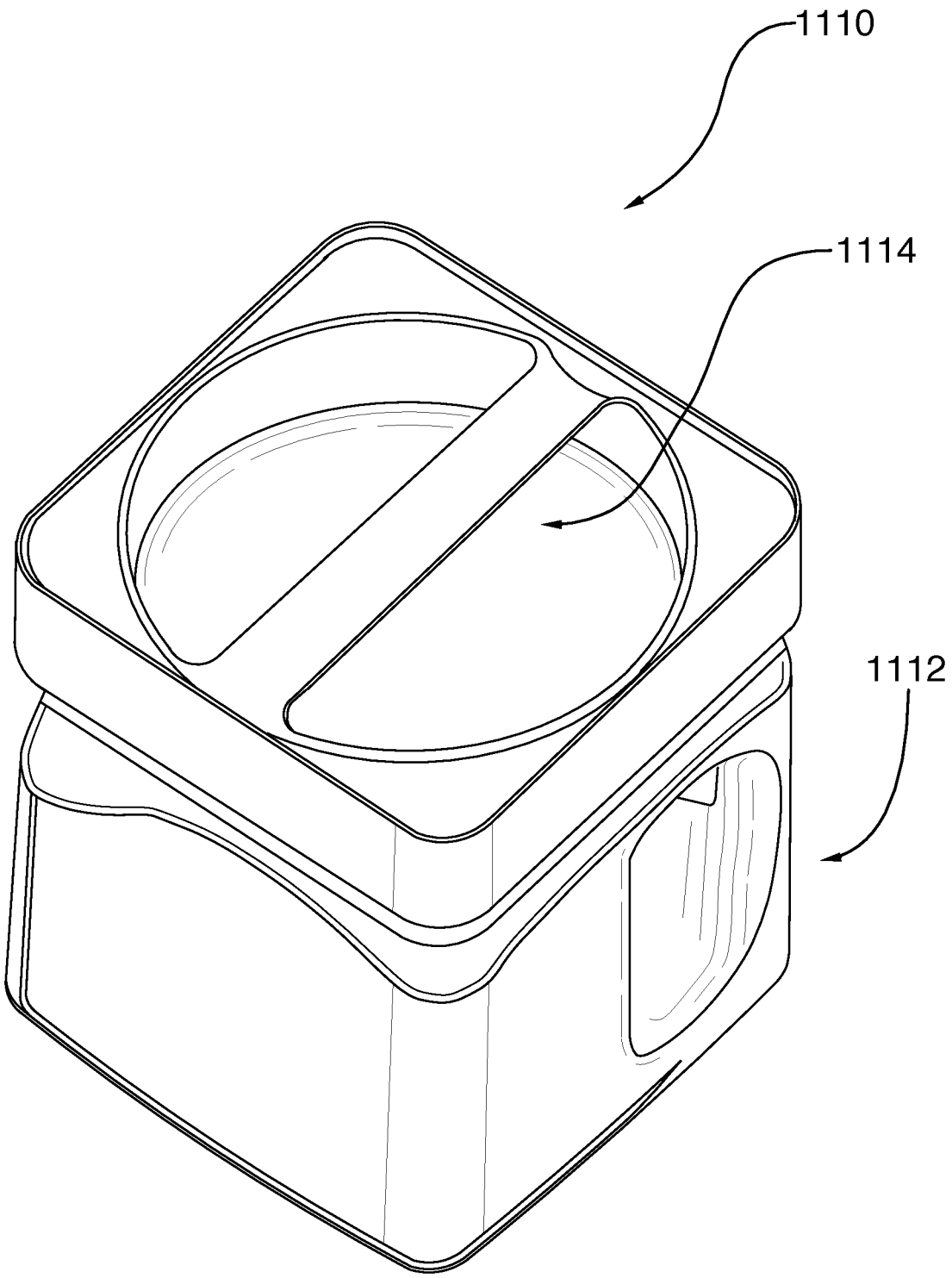
FIG. 36 is a perspective view of another exemplary storage container
Figure 37:
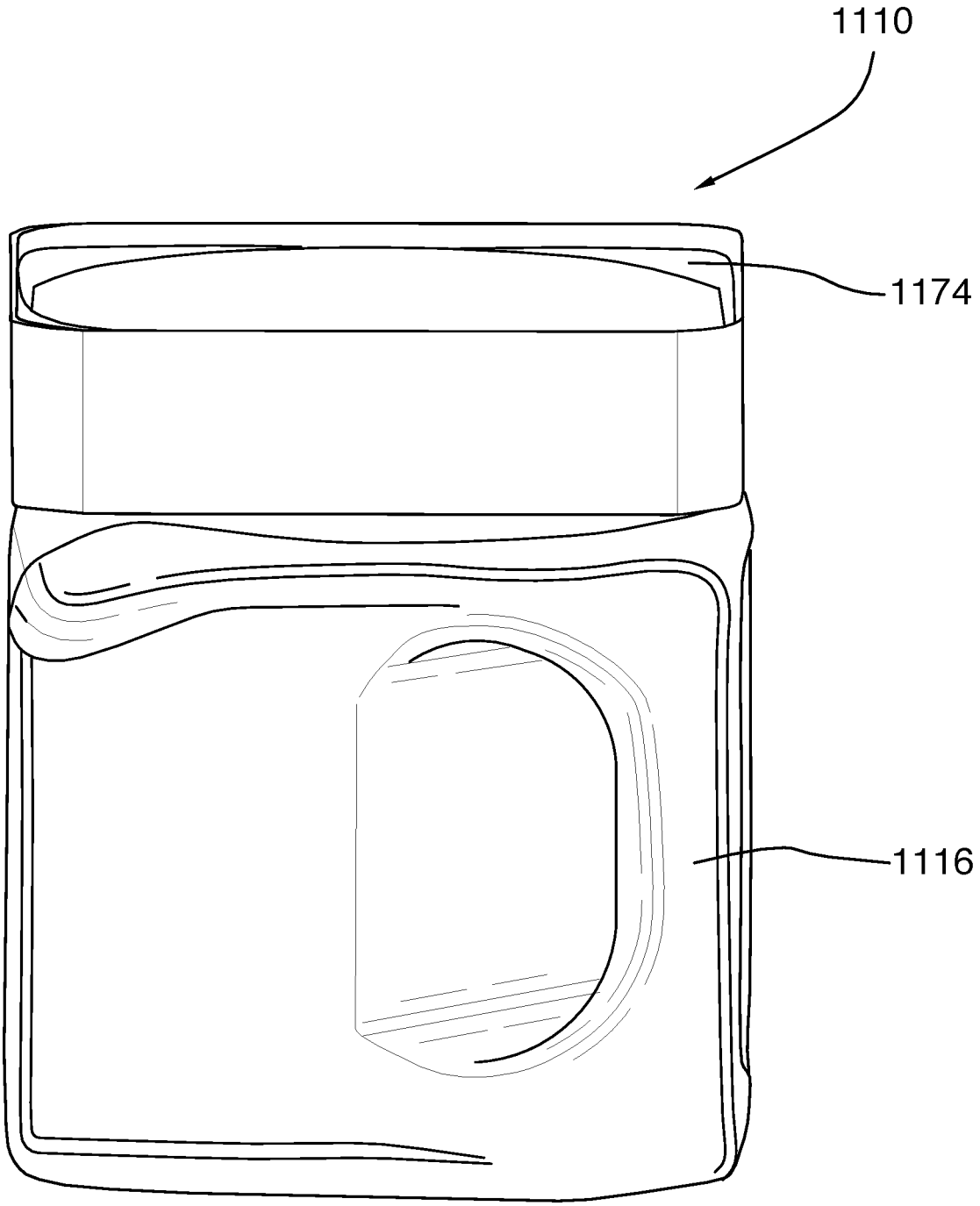
FIG. 37 is a side view of the storage container.
Figure 38:
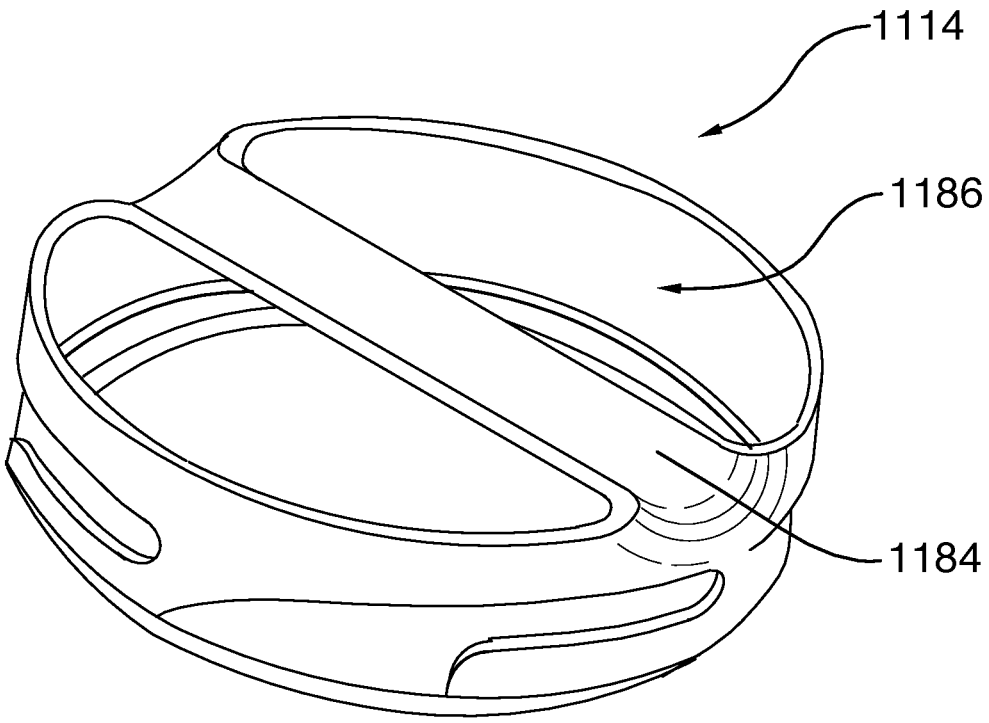
FIG. 38 is a perspective view of a lid of the storage container.
Figure 39:
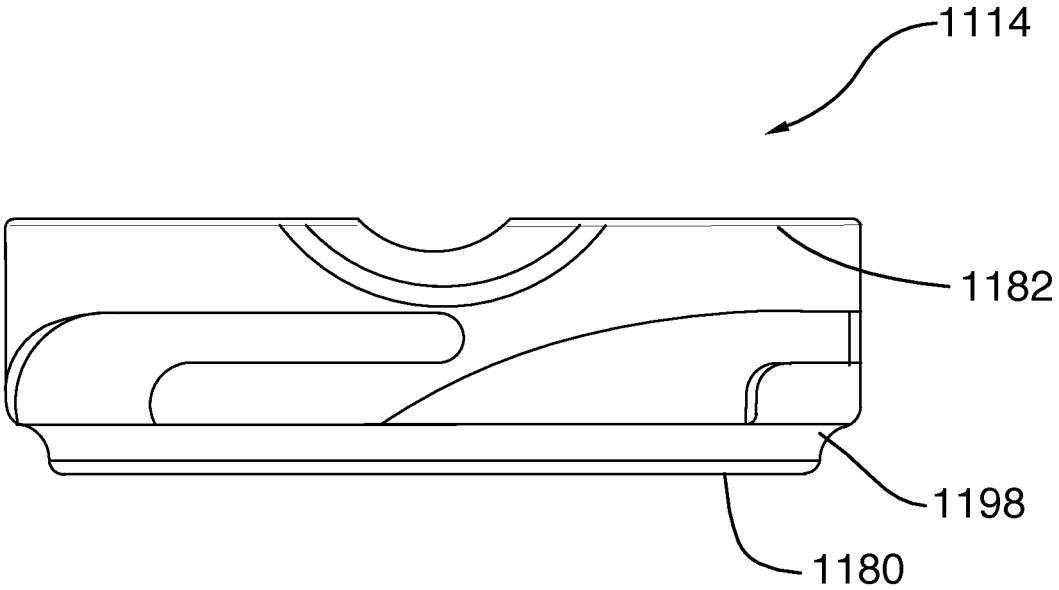
FIG. 39 is a side view of the lid.
Figure 40:
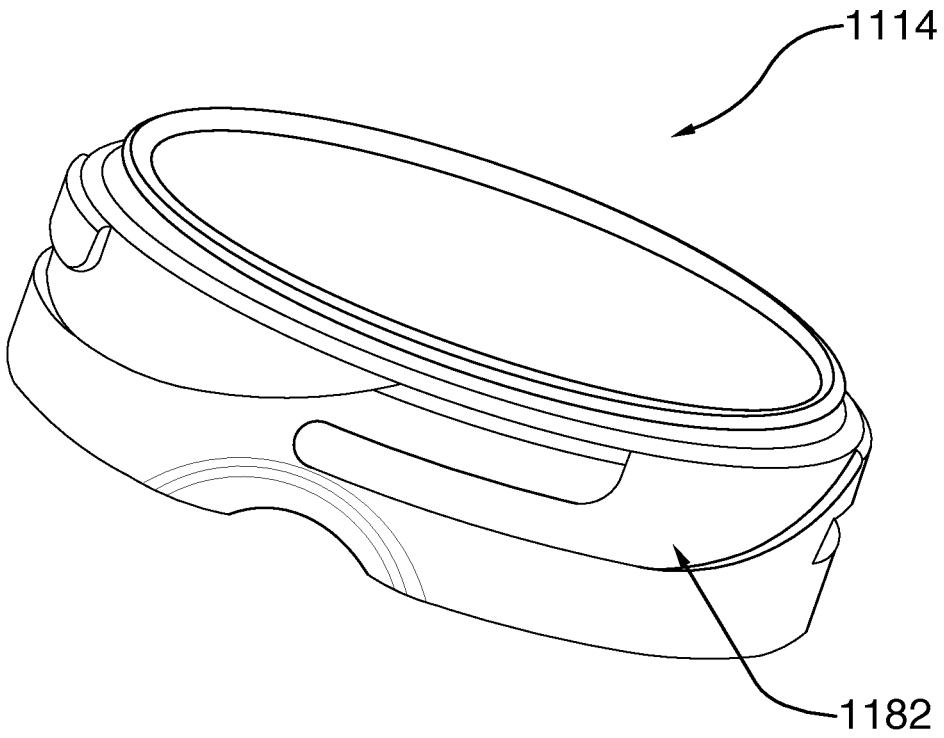
FIG. 40 is another perspective view of the lid.
Figure 41:
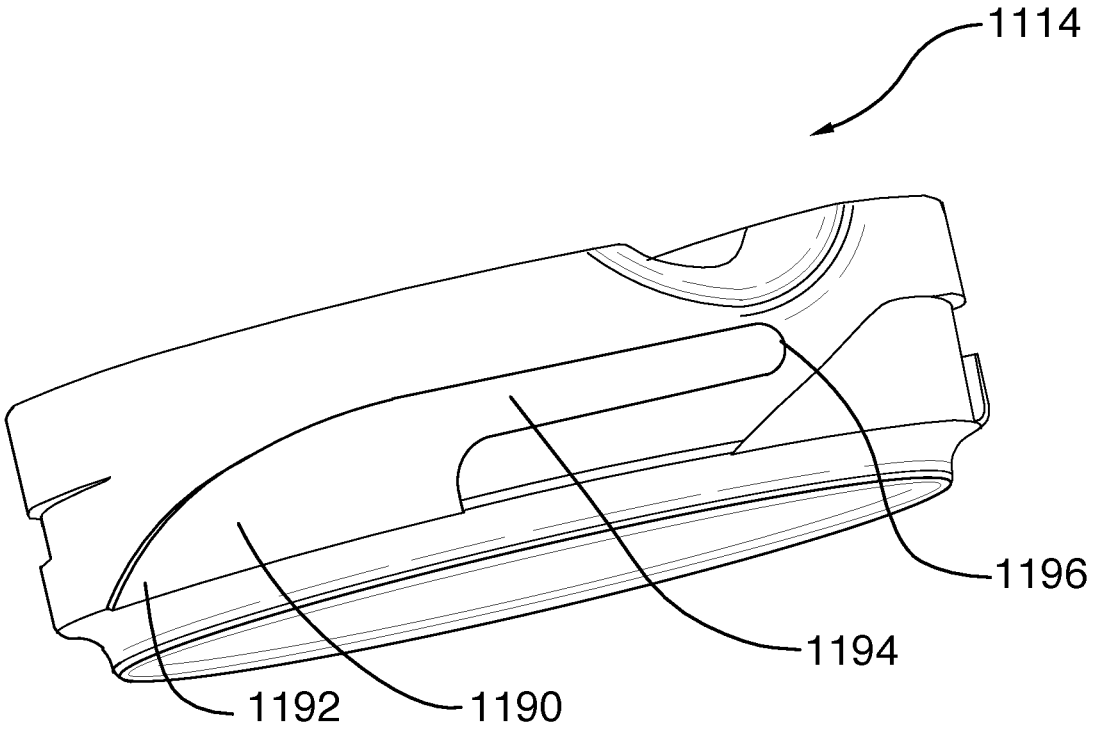
FIG. 41 is still another perspective view of the lid.
Figure 42:
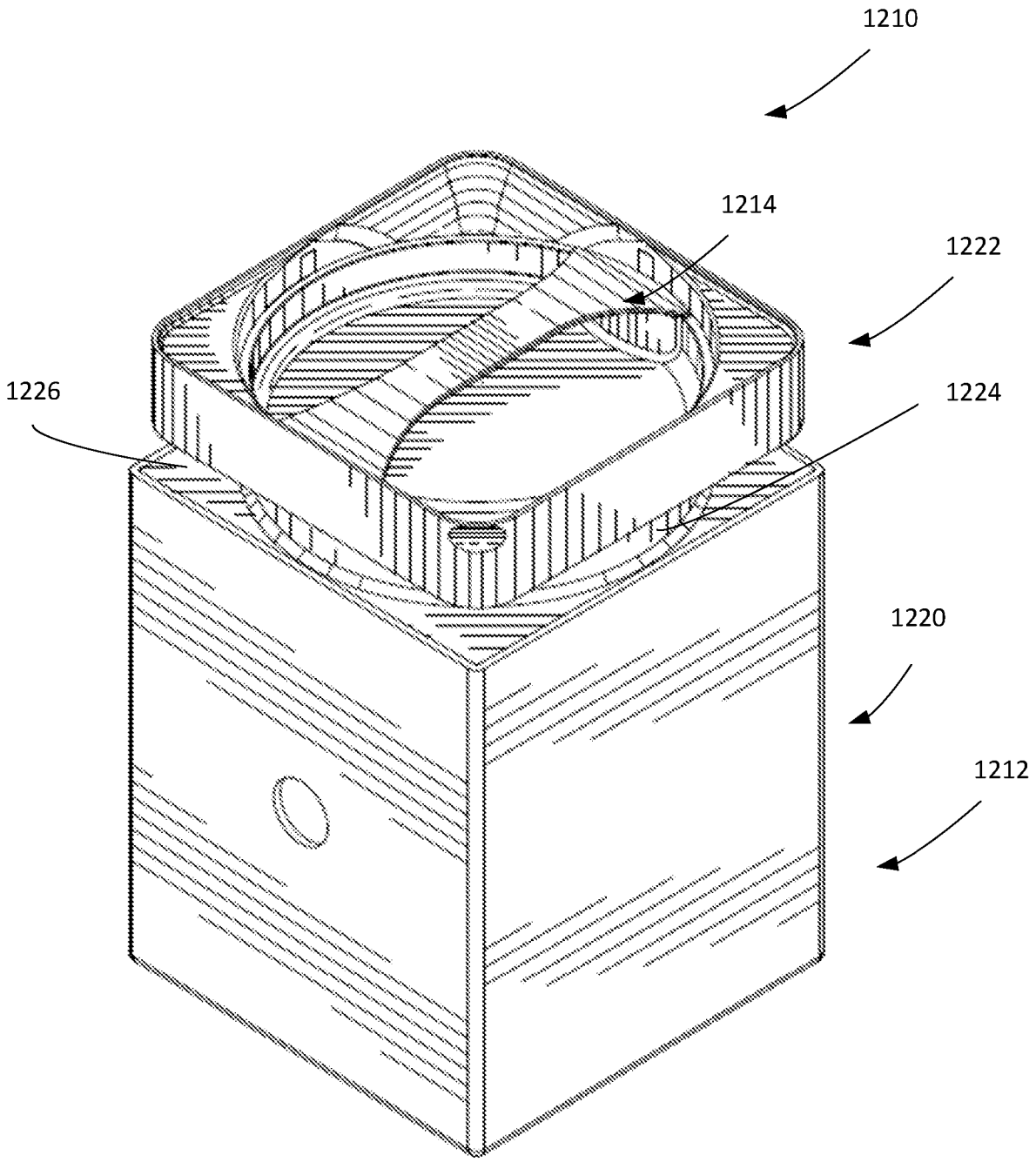
FIG. 42 is a perspective view of another exemplary storage container.

Turning now to FIGS. 36 and 37 an exemplary embodiment of the storage container is shown at 1110. The storage container 1110 is substantially the same as the above-referenced storage container 10, and consequently the same reference numerals but indexed by 1100 are used to denote structures corresponding to similar structures in the storage containers. In addition, the foregoing description of the storage container 10 is equally applicable to the storage container 1110 except as noted below.

The storage container 1110 includes a container body 1112 that may hold a suitable coating material, such as paints, stains, varnishes, chemicals, etc., and a lid 1114 removably attached to the container body 1112. The container body 1112 may be a suitable shape, such as a substantially rectangular shape, and as shown a substantially square shape, and the lid 1114 may be a suitable shape, such as a substantially circular shape as shown. The container body 1112 may include an integral handle 1116 for a user to grasp to transport the container body 1112.

Turning additionally to FIGS. 38-41, the lid 1114 will be described in detail. The lid 1114, which is substantially circular in shape, includes a base 1180, an annular wall 1182 extending upward from the base 1180, and a handle 1184 extending between sides of the annular wall 1182 defining a cavity 1186 between the handle 1184 and the upper surface of base 1180 for a user's hand to be received. The base 1180 may concave on its bottom side such that when the lid is removed and inverted, residual paint on the bottom side of the lid will collected toward the center of the concave portion to eliminate paint spill over the sides of the lid. The handle 1184 may have a suitable shape, for example, the handle 1184 may include substantially parallel sides or the handle 1184 may include concave sides providing an ergonomic gripping surface for the user's hand. The handle 1184 may be flush or substantially flush with a top of the annular wall 1182 to allow the handle 1184 to be placed on a surface upside down and lay flat and to provide support for a bottom of another container during stacking. The top of the lid may also be flush with planar portions 1174 of the container to assist with stacking.

The lid 1114 also includes at least one channel 1188 in an outer surface of the annular wall 1182 opening toward the base 1180, and as shown a plurality of circumferentially spaced channels 1188 corresponding in number to the plurality of circumferentially spaced protrusions, such as four evenly spaced channels 1188 corresponding to four evenly spaced protrusions. Each channel 1188 includes a first or vertical leg 1190 having an open end 1192 that opens toward the base 1180 of the lid 1114 and a second or horizontal leg 1194 having a closed end 1196 that extends from and is substantially perpendicular to the first leg 1190. In an embodiment, the lid 1114 may also include a groove 1198 in an outer surface thereof for receiving a suitable seal for sealing the lid 1114 to the container body 1112. Alternatively, the inner wall of the container body 1112 may include a groove for receiving a suitable seal for sealing the lid 1114 to the container body 1112.

Turning now to FIGS. 42-50 an exemplary embodiment of the storage container is shown at 1210. The storage container 1210 is substantially the same as the above-referenced storage container 10, and consequently the same reference numerals but indexed by 1200 are used to denote structures corresponding to similar structures in the storage containers. In addition, the foregoing description of the storage container 10 is equally applicable to the storage container 1210 except as noted below.

The storage container 1210 includes a container body 1212 that may hold a suitable coating material, such as paints, stains, varnishes, chemicals, etc., and a lid 1214 removably attached to the container body 1212. The container body 1212 may be a suitable shape, such as a substantially rectangular shape, and as shown a substantially square shape, and the lid 1214 may be a suitable shape, such as a substantially circular shape as shown. It will be appreciated that the container body 1212 may have other suitable shapes, such as other suitable polygonal shape, such as an octagonal shape. The lid 1214 may be made out of a suitable material, such as plastic, metal, etc., and may be made in a suitable manner, such as by injection molding, etc. The lid 1214 may be substantially the same as any of the above described lids, such as lid 14 or 1114 and thus will not be described in detail.

Turning additionally to FIGS. 43-47, the container body 1212 will be described in detail. The container body 1212 can be formed from separate portions, for example the container body 1212 includes a first portion 1220, a second portion 1222 for attaching to the lid 1214, and a third portion 1218 disposed in and extending above the first portion 1220 for attaching to the second portion 1222 and for holding the coating material. The first portion 1220 may be made out of a suitable corrugated structure, such as cardboard and may include a suitable coating such as a RPET laminate or UV varnish. In another embodiment the first portion 1220 may be made of a suitable plastic or metal. The second and third portions 1222 and 1218 may be made of a suitable material, such as plastic that may have the same properties or different properties from one another, for example the second portion 1222 may be more rigid than the third portion 1218. The first portion 1220 is configured to receive the third portion 1218 and provide structural rigidity to the container while the third portion 1218 holds a coating material and the second portion 1222 couples to the third portion to form the container 1210 that is similar to the above containers.

The second portion 1222 is spaced from the first portion 1220 in a longitudinal direction by a collar 1224 defining a gap 1226 between the first and second portions 1220 and 1222. The gap 1226 may extend around a periphery of the container 1210 and receive any suitable attachment, such as the attachments discussed above.

Figure 43:
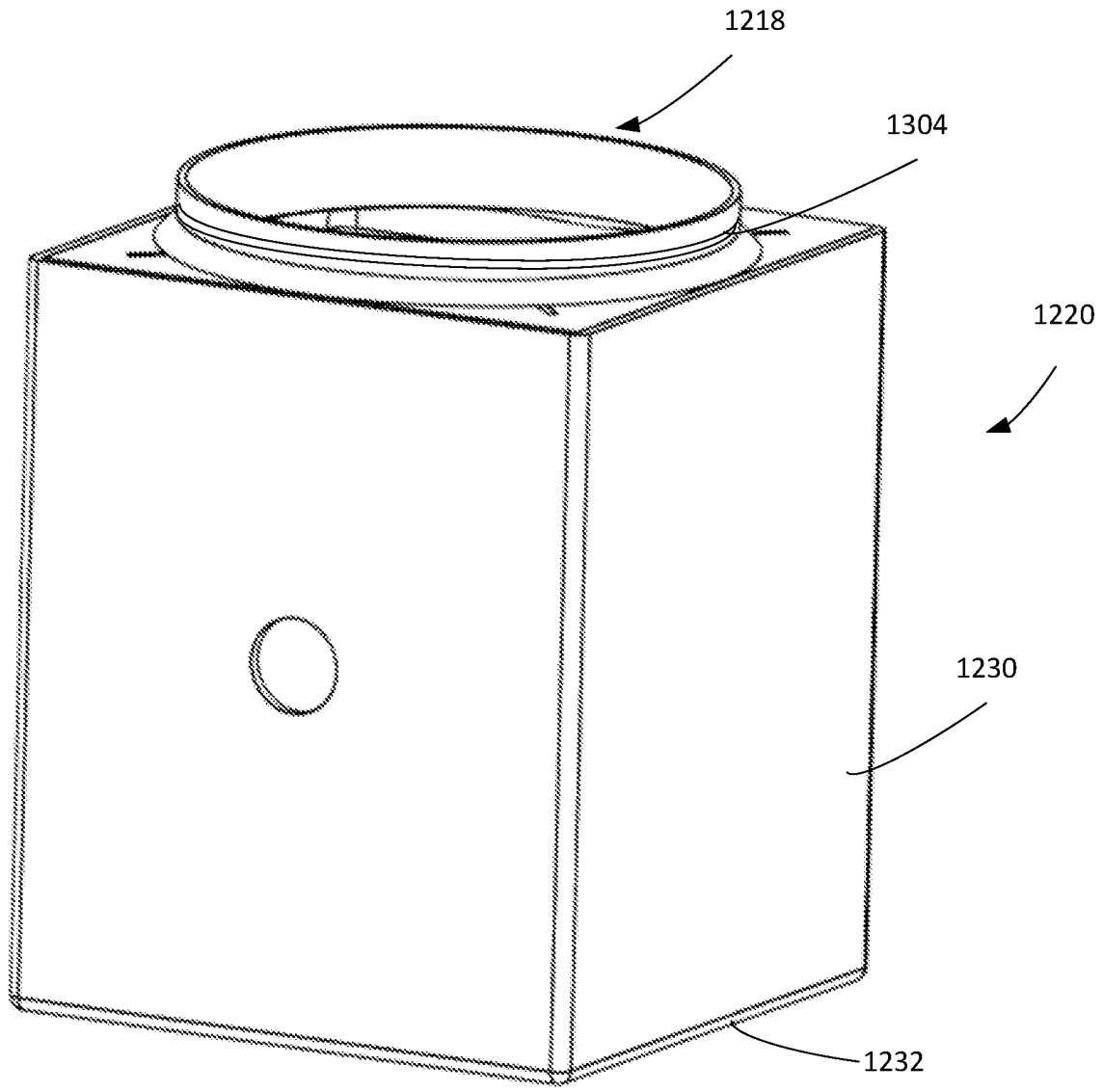
FIG. 43 is a perspective view of a first and third portion of the storage container.
Figure 44:
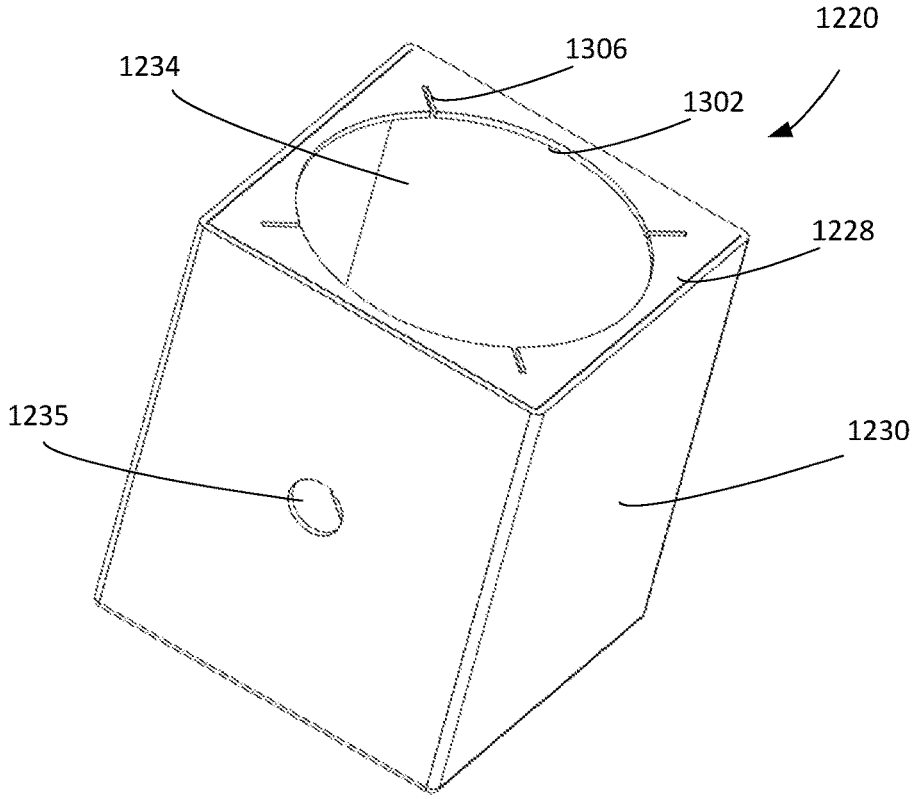
FIG. 44 is a perspective view of the first portion.
Figure 45:
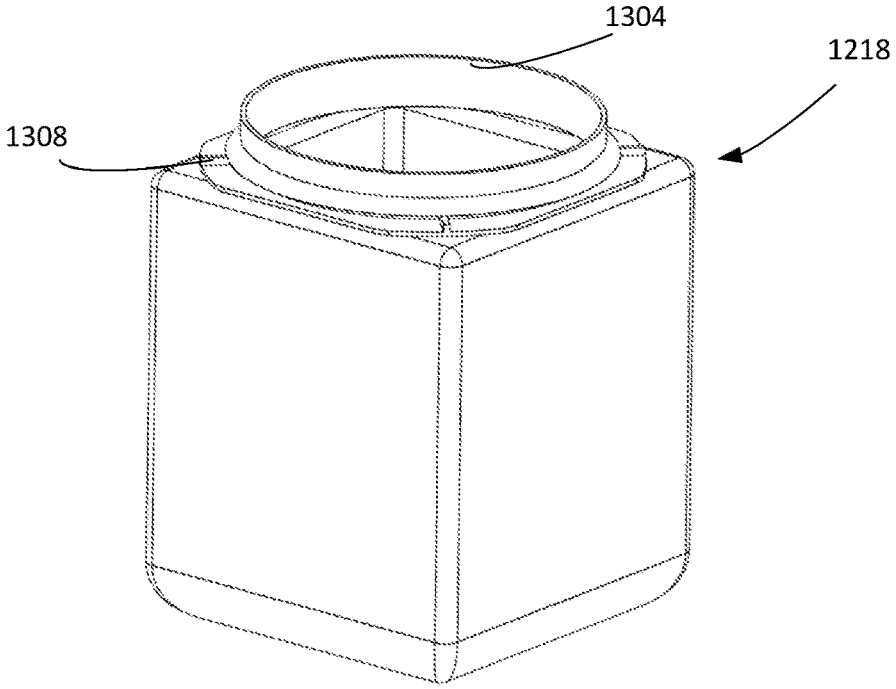
FIG. 45 is a perspective view of the third portion.

Referring additionally to FIGS. 43 and 44 The first portion 1220 is substantially rectangular in shape and includes a wall 1230 with an open top end and a closed bottom end that is closed by a bottom portion 1232 coupled to, formed with, or otherwise held in position relative to the bottom of the wall 1230. The wall 1230 and bottom portion 1232 define a cavity 1234 for receiving the third portion 1218. In an embodiment the wall 1230 can include an opening 1235 of any suitable shape and size allowing a user to view the color of the coating material in the transparent third portion 1218. The first portion can include a top portion 1228 coupled to, formed with, or otherwise held in position relative to the wall having an opening 1302 into the cavity 1234, for example a circular opening from which a collar 1304 of the third portion 1218 extends. Extending outward from the opening 1302, for example toward corners of the top portion 1228, are slits 1306 in the top portion that can provide for flexibility to allow for insertion of the third portion and that receive corresponding projections 1308 extending outward from the collar 1304 to prevent rotation of the third portion 1218 relative to the first portion 1220. An underside of the top portion 1228 can be abutted by a top portion of the third portion or otherwise prevent the third portion from being removed from the first portion.

Figure 46:
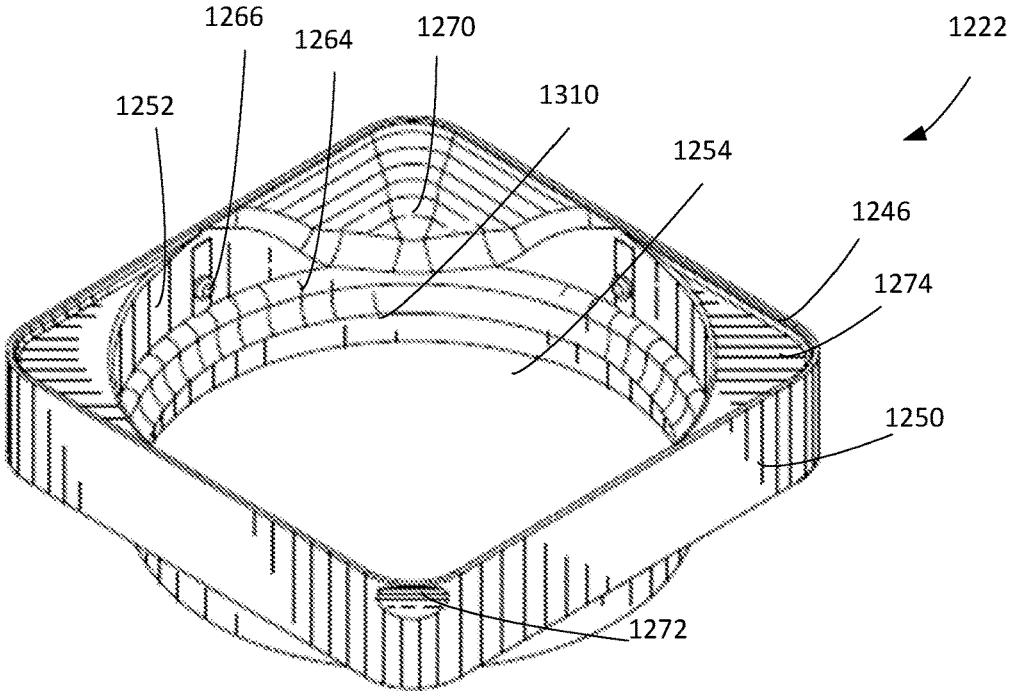
FIG. 46 is a perspective view of a second portion of the storage container.
Figure 47:
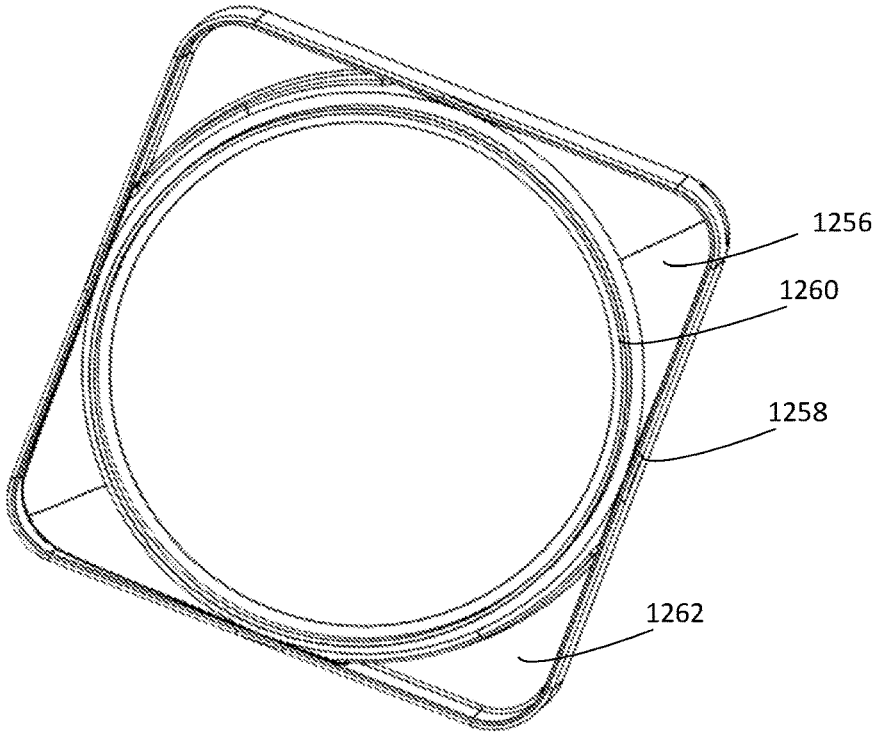
FIG. 47 is another perspective view of the second portion.

Referring additionally to FIGS. 46 and 47 and the second portion 1222 in detail, the second portion 1222 has an outer wall 1250 that is substantially rectangular, and as shown substantially square, an inner wall 1252 that is substantially circular and that defines an opening 1254 for access to the cavity in the third portion 1218, and the collar 1224 that extends downward from the inner wall 1252. The collar 1224 includes threads 1310 along an inner surface thereof for mating with corresponding threats 1312 on an outer surface of the collar 1304 of the third portion 1218 to removably secure the second portion 1222 to the third portion 1218. The opening 1254 is a suitably wide opening allowing for the container 1210 to be filled through the opening 1254, allowing the container 1210 to be tinted through the opening 1254, and allowing a user to insert an apparatus, such as a paintbrush into the opening 1254 for painting from the container 1210. A cavity 1256 is formed between an inner surface 1258 of the outer wall 1250 and an outer surface 1260 of the inner wall 1252 above the gap 1226. An anchor point or attachment zone 1262 for securing to one of the attachments is defined by interior corners of the outer wall 1250 in the cavity 1256.

The second portion 1222 also includes the lip 1246 extending upward around the outer wall 1250, and a ledge 1264 extending radially inwardly from the inner wall 1252 to define a seat for the lid 1214. The second portion 1222 also includes at least one protrusion 1266 that extends radially inwardly from the inner wall 1252 above the ledge 1264, and as shown a plurality of circumferentially spaced radially inwardly extending protrusions 1266. The plurality of circumferentially spaced radially inwardly extending protrusions 1266 each may have a suitable shape, such as a generally cylindrical shape for mating with the lid 1214.

A pour spout 1270 may be defined in a corner of the second portion 1222 in the area between the square outer wall 1250 and the circular inner wall 1252, and as shown, a pour spout 1270 is defined in two corners diagonal from one another. It will be appreciated that the container 1210 could be designed to include a pour spout in each of the corners of the container 1210. The pour spouts 1270 are curved from the lip 1246 to the ledge 1264 to allow the coating material to be poured from the cavity in the third portion 1218 and to allow the coating material to drip back into the cavity. A drip edge 1272 in the form of a recess in the outer wall 1250 may be provided at each corner with a spout 1270. The remaining corners may include respective planar portions 1274 extending outward from the top of the inner wall 1252 and below the lip 1246. In an embodiment, the container may include at the pour spout or other suitable area a plurality of scraper regions projecting therefrom oriented in a chevron pattern for scraping paint off of a painting apparatus.

Figure 48:
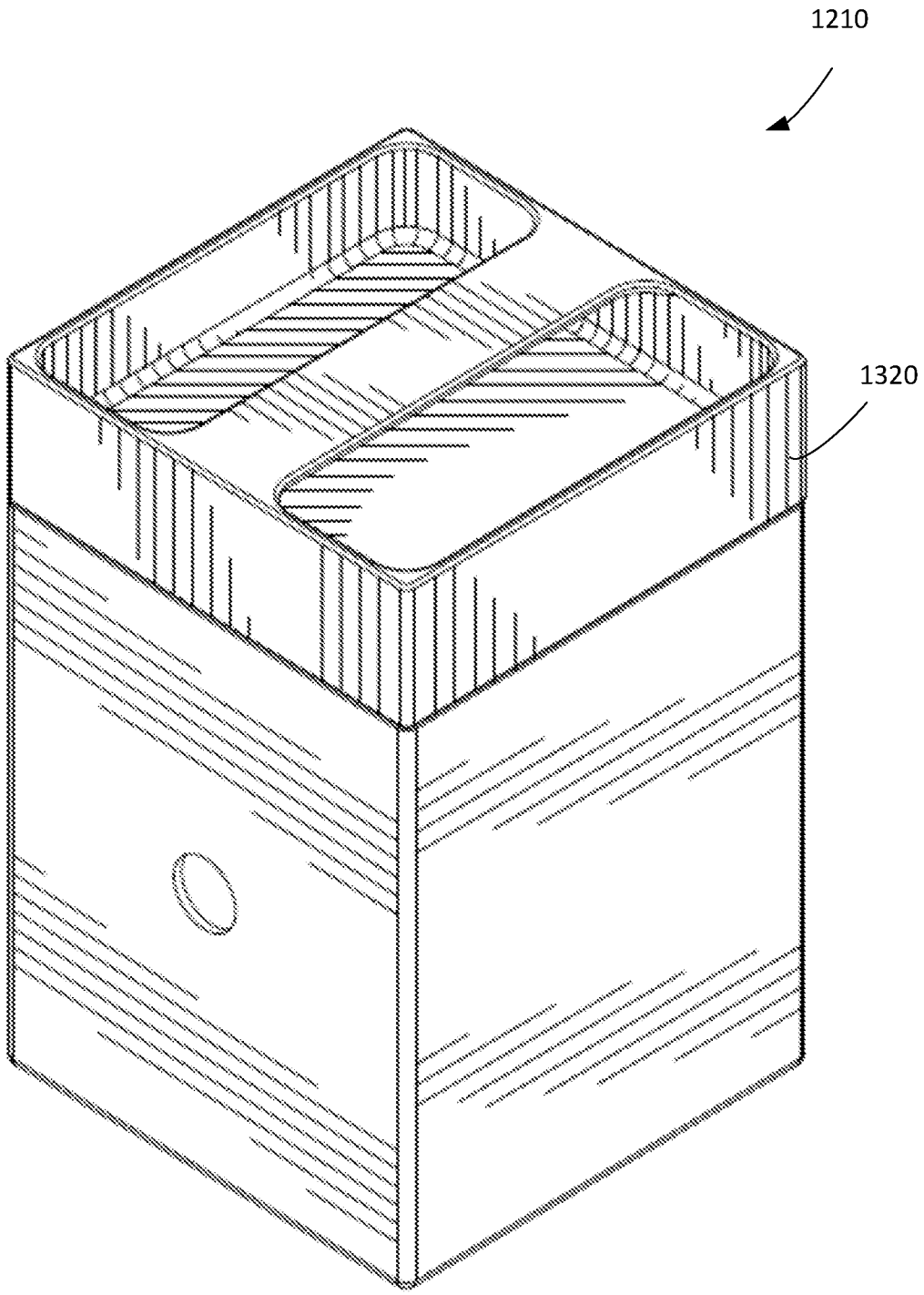
FIG. 48 is a perspective view of the container in a shipping configuration.
Figure 49:
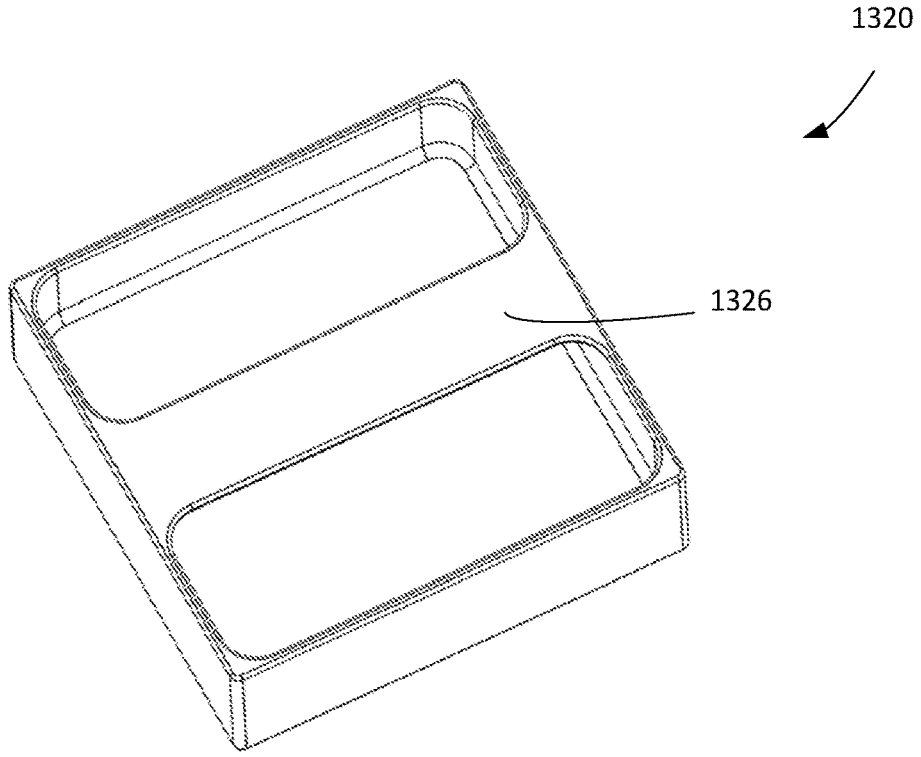
FIG. 49 is a perspective view of a shipping lid of the container.
Figure 50:
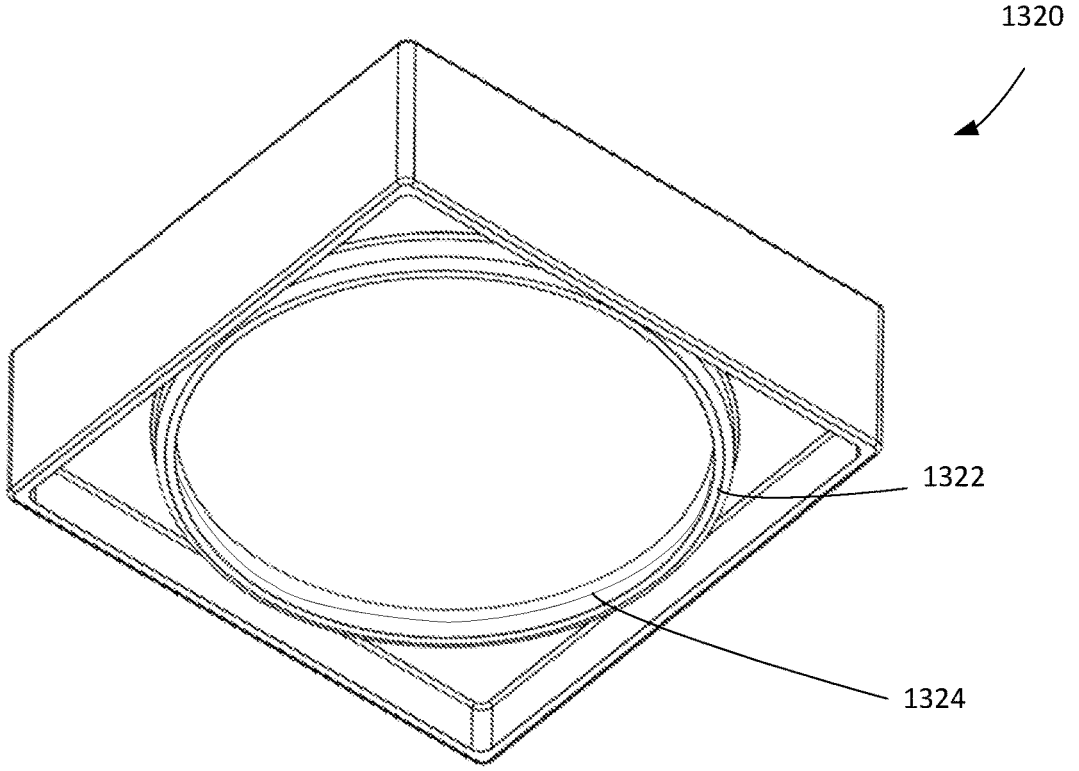
FIG. 50 is another perspective view of the shipping lid.

Turning now to FIGS. 48-50, the container 1210 is showing in its shipping and shaking configuration. As shown, the second portion 1222 is disconnected from the third portion 1218 and a shipping lid 1320 is attached to the third portion 1218. The shipping lid 1320 can be substantially the same in profile as the first portion 1220, such as a square profile such that when attached to the first portion 1220, the container can be placed in a shaking machine and the stresses on the container will be distributed. The shipping lid 1320 can also allow for stacking and allows the container to be plastic wrapped and shipped in its own container.

The shipping lid 1320 includes a circular projection 1322 projecting downward from a bottom of the lid that includes threads 1324 that mate with the threads 1312 on the outer surface of the collar 1304 of the third portion 1218 to removable couple the shipping lid 1320 to the third portion 1218 and thus also the first portion 1220. The shipping lid 1320 also includes a handle 1326 flush or substantially flush with an upper surface of the lid to allow a user to transport the container. The shipping lid may be made of a suitable material, such as plastic.

In a store, the shipping lid 1320 may be removed from the third portion 1218 to allow the coating material therein to be tinted, then replaced to allow the container to be placed in a shaking machine. The shipping lid 1320 may then be removed, either in store or by the user at a desired location, and replaced with the second portion 1222 to allow for use. The second portion 1222 may be reused with different containers, the shipping lid 1320 may be reused or recycled, and the first and third portions 1220 and 1218 may be reused or recycled, thereby providing an eco-friendly painting container.

Figure 51:
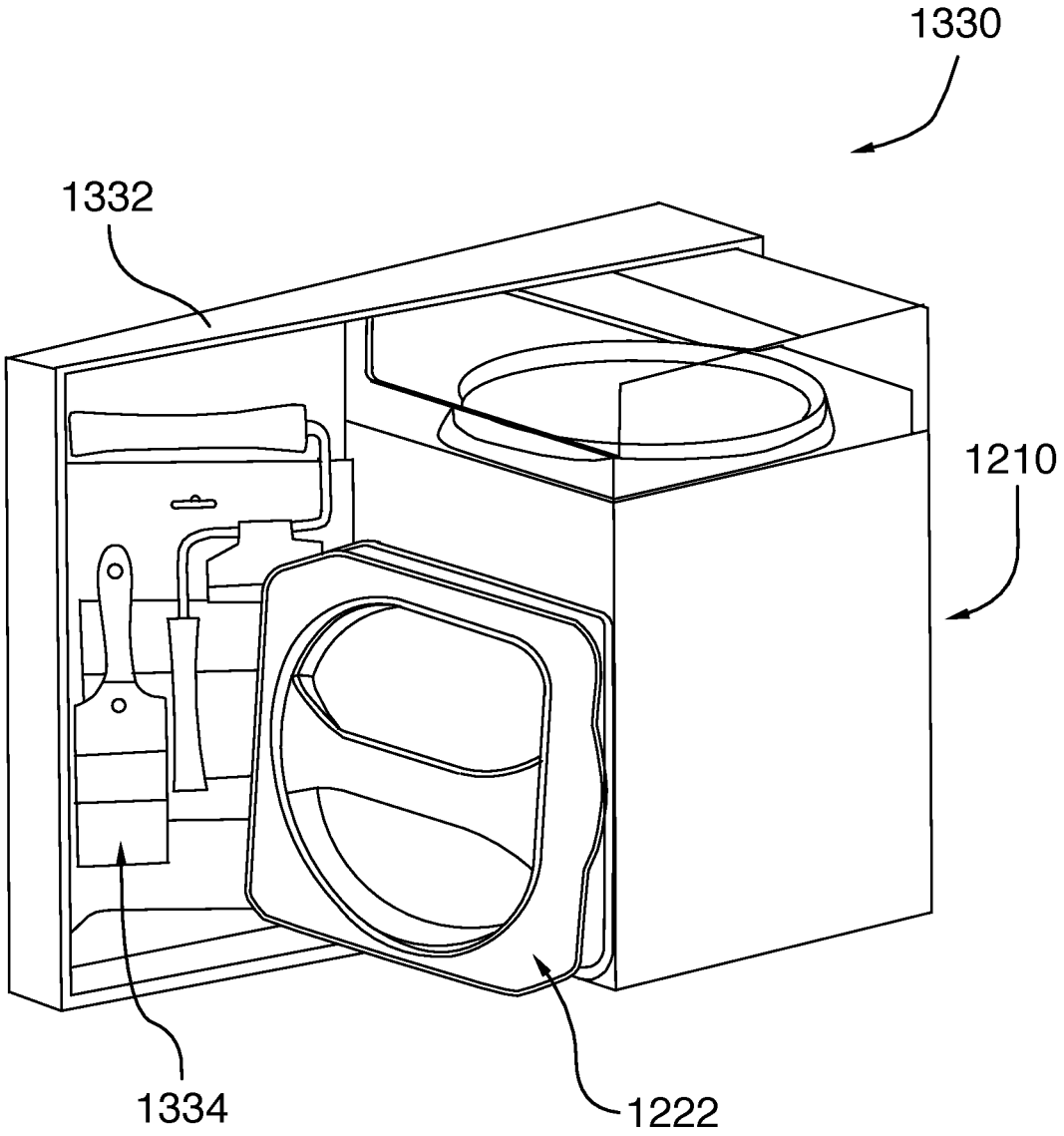
FIG. 51 is a perspective view of an exemplary paint kit.

Turning additionally to FIG. 51, a paint kit 1330 may be provided that is ecommerce and eco-friendly. The kid 1330 includes a box 1332, such as an open topped cardboard box that receives the container 1210 in its shipping and shaking configuration with the shipping lid 1320 attached, the second portion 1220, and one or more accessories 1334, such as a roller, a roller cover, a brush, a stir stick, etc., that all may be nested in the box 1332.

Turning additionally to FIGS. 52-55, the box 1332 of the paint kit 1330 may include a back portion or a flap 1350 that includes foldable portions and/or perforated regions or the like to allow the box 1332 to be used during painting. For example, the flap 1350 may include perforated regions that allow for functional attachments 1352 and 1354 to be removed.

Figure 53:
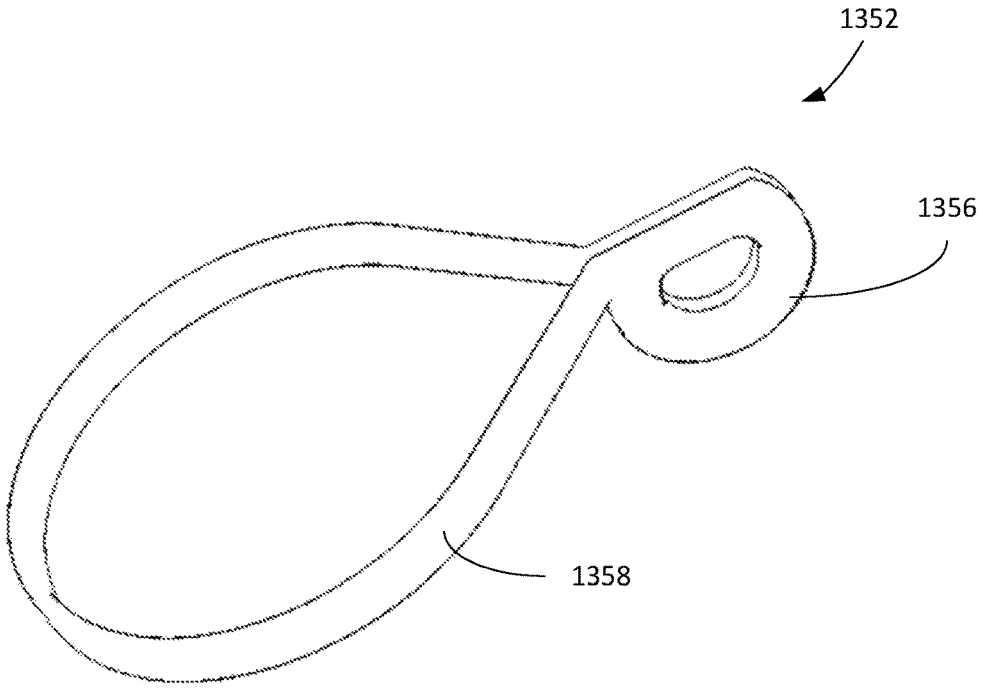
FIG. 53 is a perspective view of an exemplary functional attachment.

As shown in FIG. 53, the functional attachment 1352 may include a pair of ears 1356 that can be attached to one another to serve as a finger loop, and an attachment portion 1358 that is positioned around the collar 1224 of the second portion 1222 to allow the container 1210 to be transported via the functional attachment 1352. The ears 1356 may be attached to one another in a suitable manner either before or after the second portion 1222 is attached to the third portion 1218.

Figure 54:
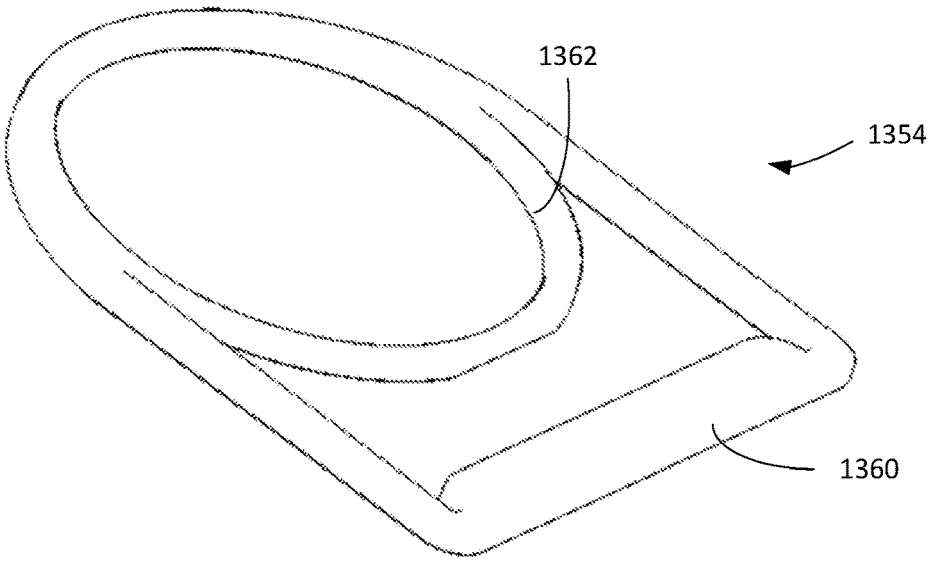
FIG. 54 is a perspective view of another exemplary functional attachment.

As shown in FIG. 54, the functional attachment 1354 may include a handle portion 1360 attached to an attachment portion 1362 that is positioned around the collar 1224 prior to the second portion 1222 being attached to the third portion 1218. After attachment, the handle portion 1360 can be bent or rotated relative to the attachment portion 1362 to allow for carrying of the container.

Figure 52:
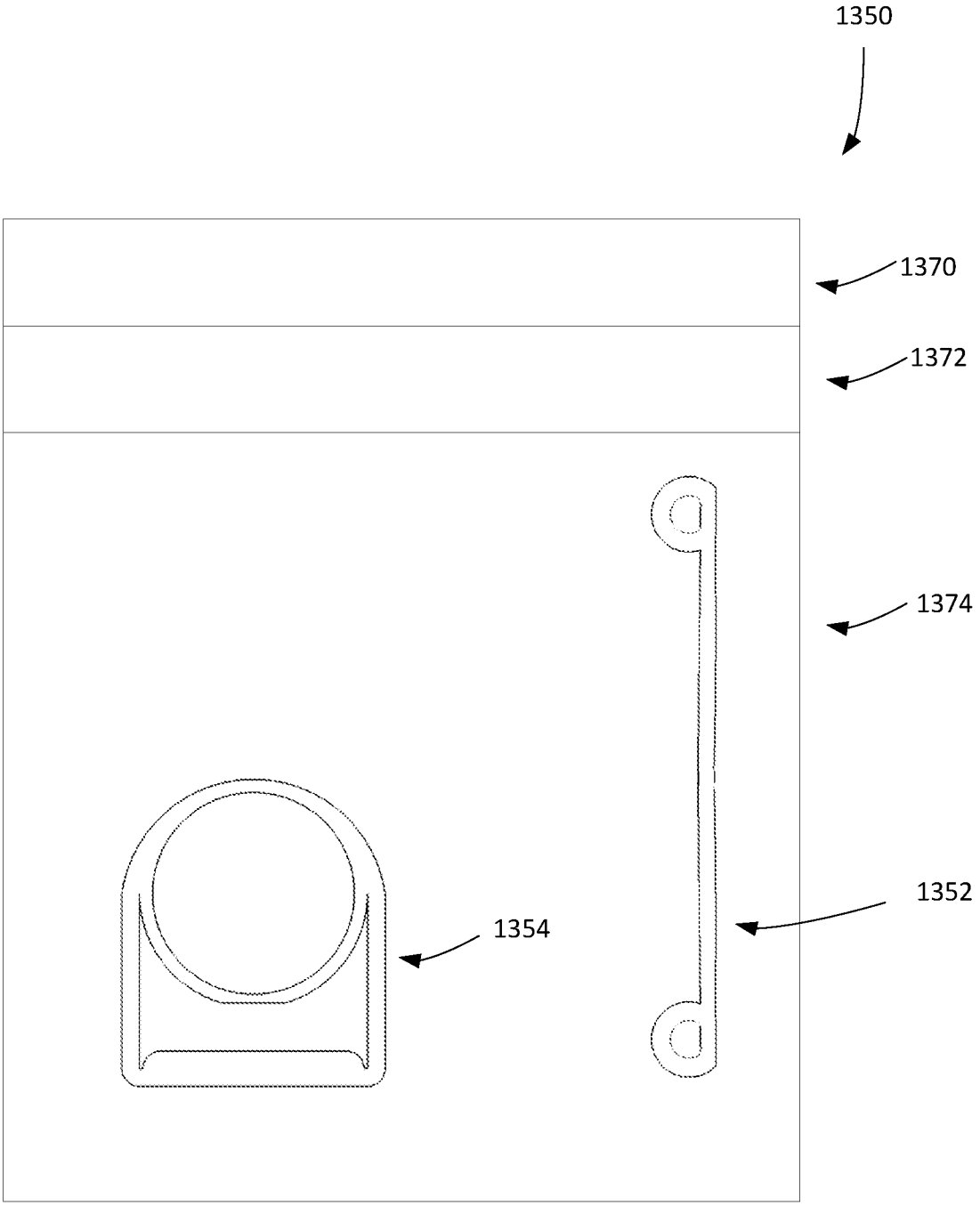
FIG. 52 is a top view of a back portion of an exemplary box of a kit.
Figure 55:
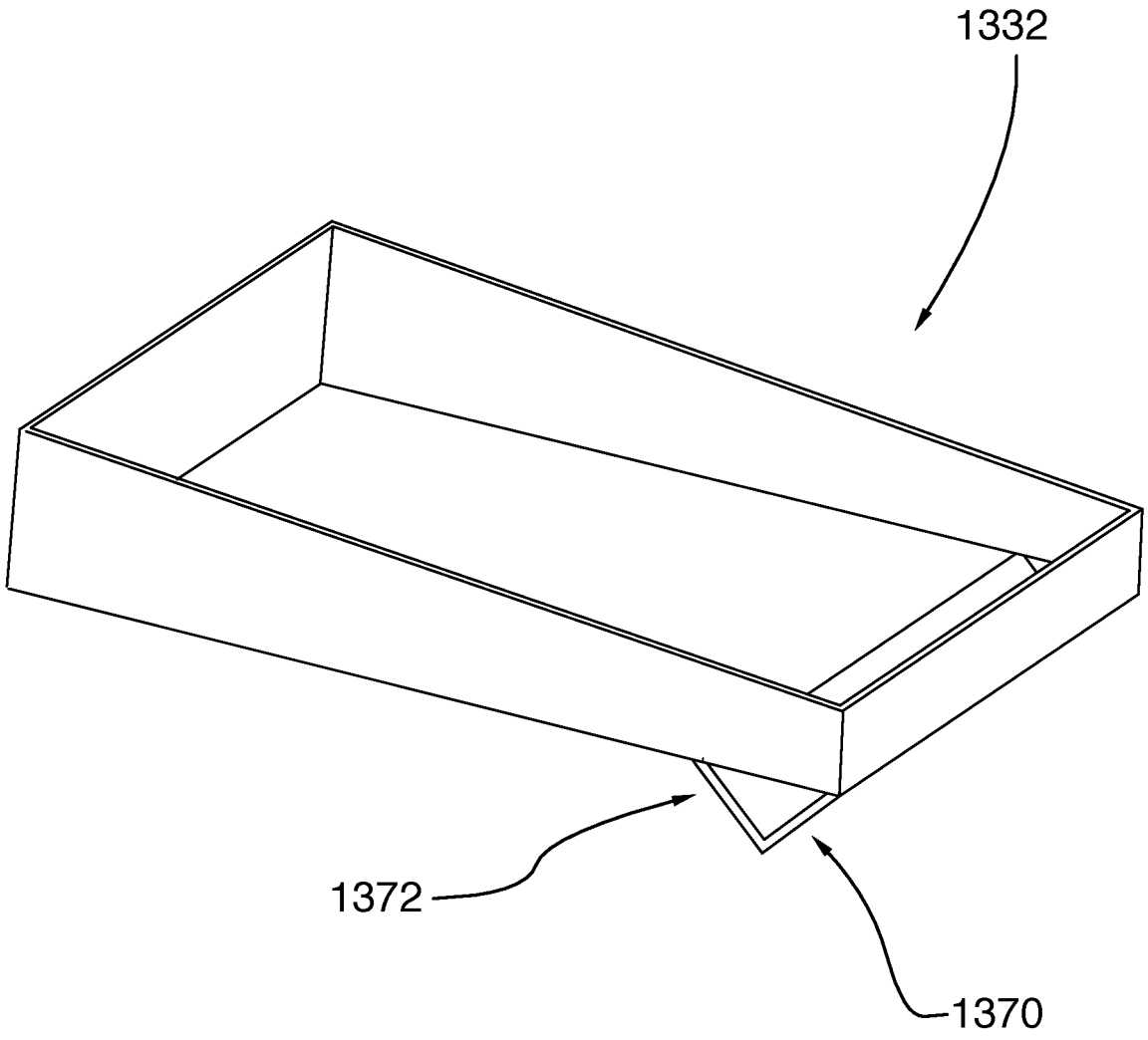
FIG. 55 is a perspective view of the box of a kit.

As shown in FIGS. 52 and 55, the flap 1350 includes a first portion 1370, a second portion 1372, and a third portion 1374 that includes the functional attachments 1352 and 1354. The third portion 1374 may be removed, for example due to perforations between the second and third portion 1372 and 1374, and then the first and second portions 1370 and 1372 can be folded relative to the box 1332 to for a tray, such as a tray for paint. A disposable paint tray liner may optionally be positioned in the box 1332 for holding the paint.

Turning now to FIGS. 56-62 an exemplary embodiment of the storage container is shown at 1410. The storage container 1410 is substantially the same as the above-referenced storage container 10, and consequently the same reference numerals but indexed by 1400 are used to denote structures corresponding to similar structures in the storage containers. In addition, the foregoing description of the storage container 10 is equally applicable to the storage container 1410 except as noted below.

The storage container 1410 includes a container body 1412 and a lid 1414 removably attached to the container body 1412. The container body 1412 may be a suitable shape, such as a substantially rectangular shape, and as shown a substantially square shape, and the lid 1414 may be a suitable shape, such as a substantially square shape as shown. The body and lid may be made of a suitable material, such as plastic, metal, etc. Although described as holding a suitable coating material, it will be appreciated the container may be used with other liquids, such as beverages.

The storage container 1410 includes a first portion 1420 and a second portion 1422. The second portion 1422 has an outer wall 1450 that is substantially rectangular, and as shown substantially square, an inner wall 1452 that is substantially square and that defines an opening 1454 for access to the cavity that is substantially square providing a non-rounded pour point. Projecting radially inward from a top of the outer wall 1450 are a plurality of tabs 1502 for securing the lid 1414 as described below. As shown, the second portion 1422 includes four tabs 1502 projecting inward from each side of the container. The tabs 1502 can be rounded and define with adjacent corners of the second portion areas 1504 for receiving corners of the lid 1414 during attachment/removal. A pour spout 1470 may be defined in a corner of the second portion 1422, and as shown, a pour spout 1270 is defined in all corners of the container.

Figure 56:
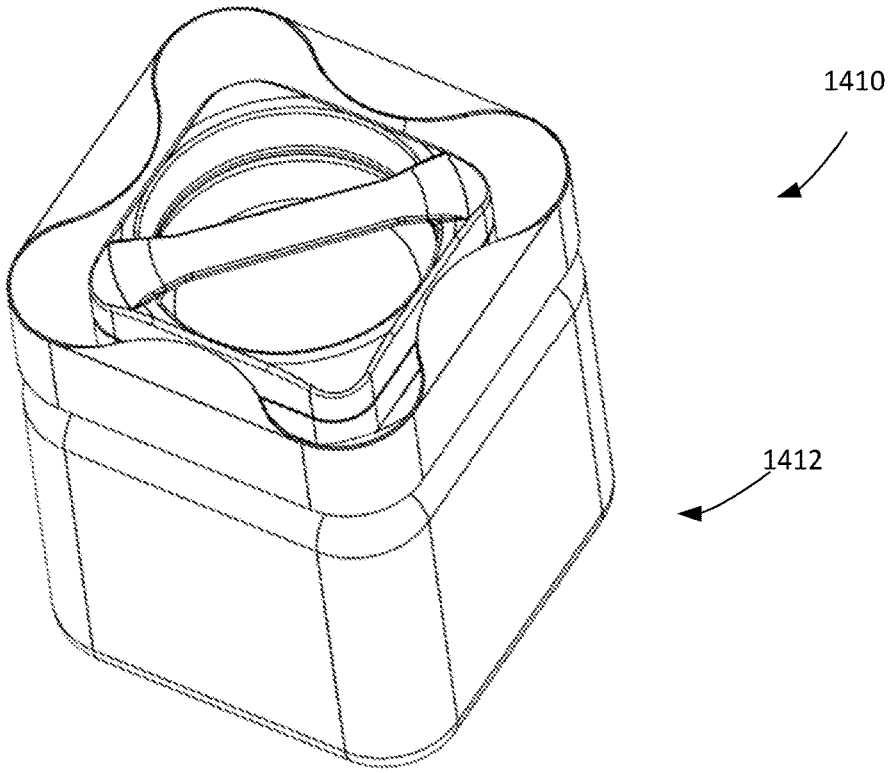
FIG. 56 is a perspective view of another exemplary container in a locked position.
Figure 57:
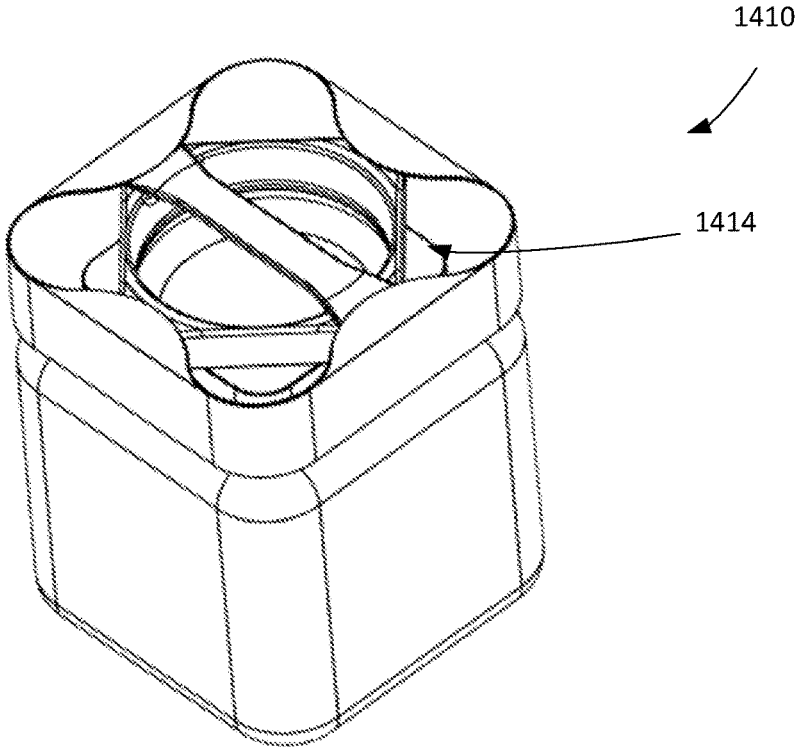
FIG. 57 is a perspective view of the container in an unlocked position.
Figure 58:
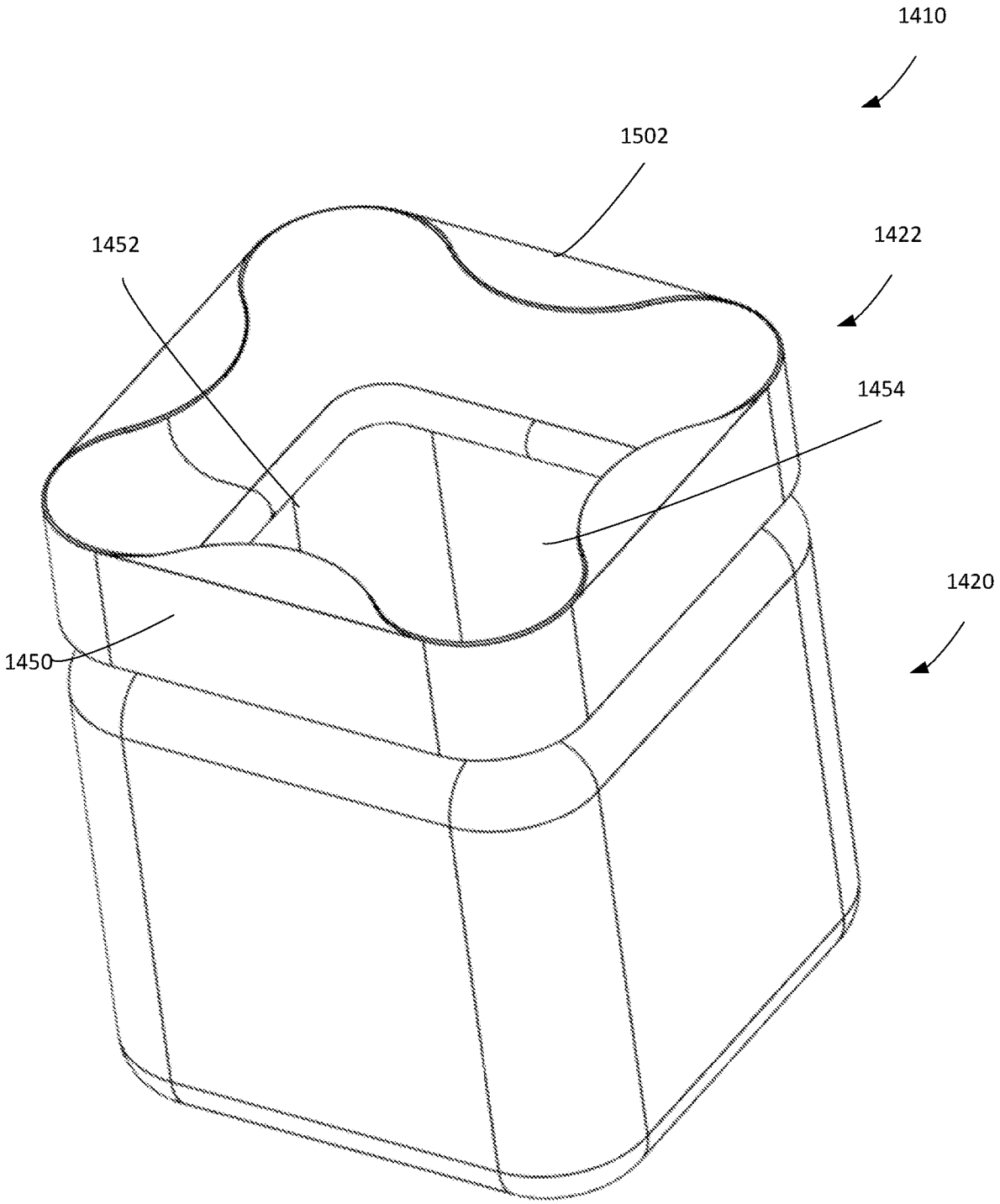
FIG. 58 is a perspective view of the container.
Figure 59:
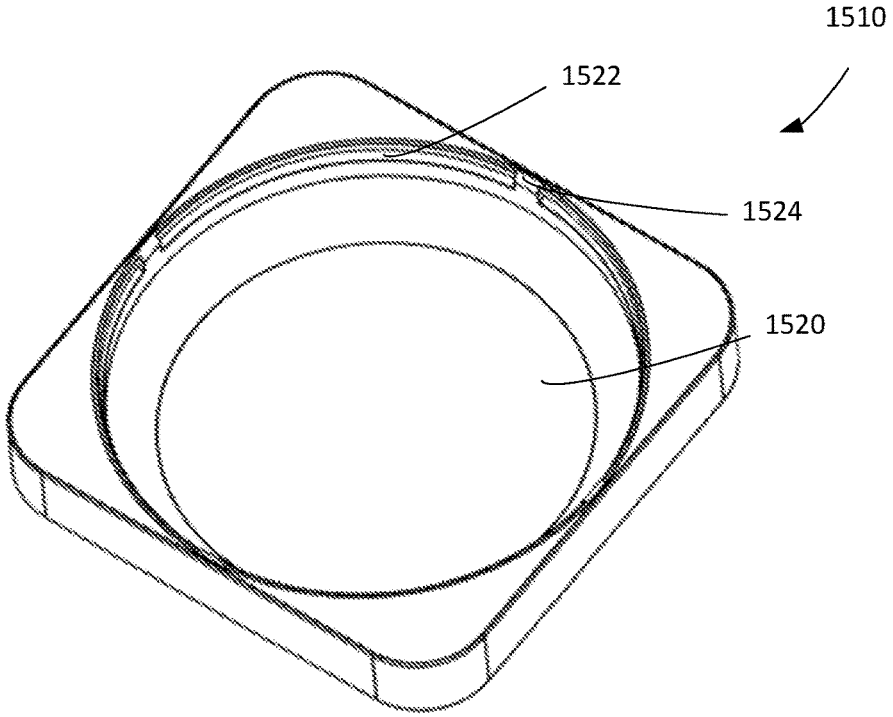
FIG. 59 is a perspective view of a lower portion of a lid of the container.
Figure 60:
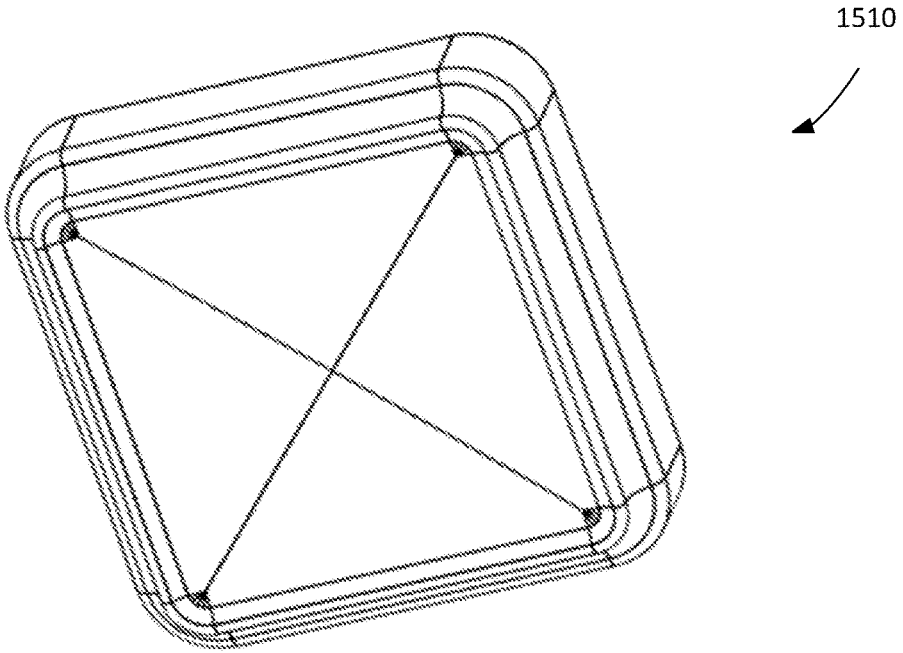
FIG. 60 is another perspective view of the lower portion.
Figure 61:
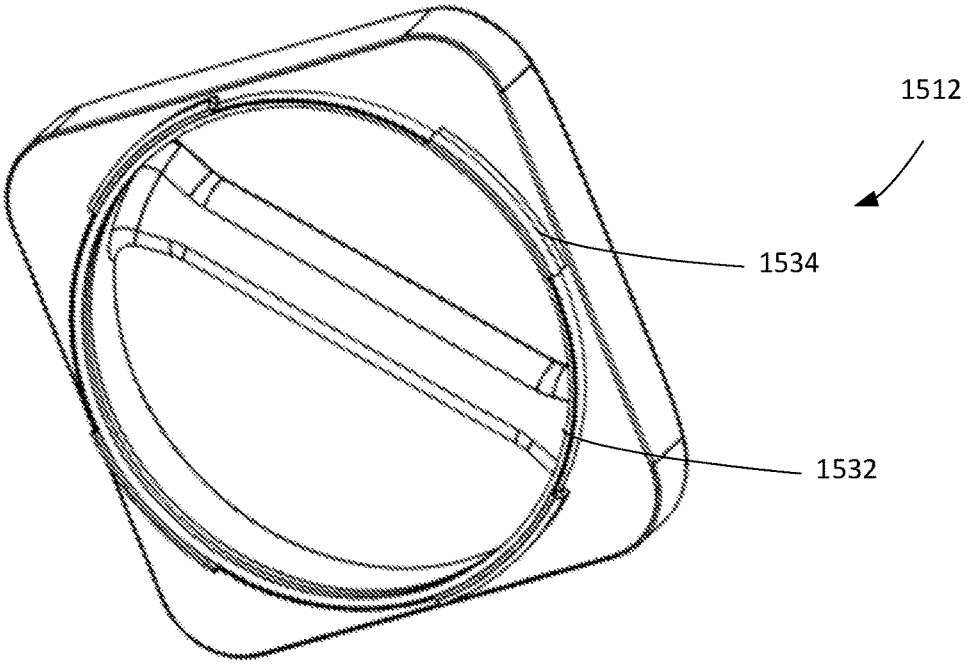
FIG. 61 is a perspective view of an upper portion of the lid.
Figure 62:
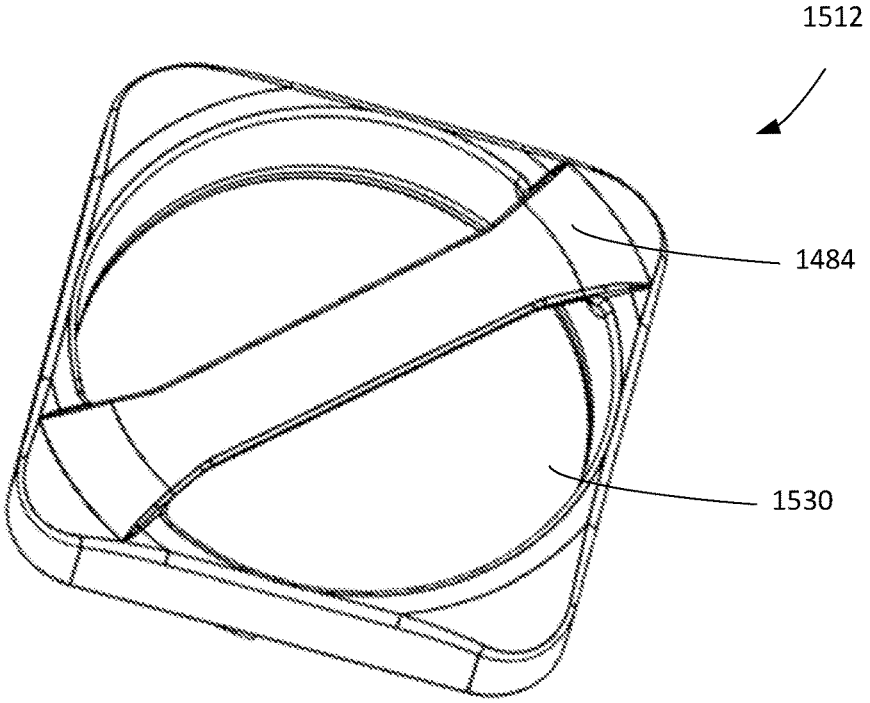
FIG. 62 is another perspective view of the upper portion.

Referring additionally to FIGS. 59-62, the lid 1414 can include a lower portion 1510 configured to be received in and seal to the opening 1454 and an upper portion 1512 configured to rotate relative to the lower portion 1510 to lock the lid to the container as shown in FIG. 57 and unlock the lid as shown in FIG. 56.

The lower portion 1510 of the lid 1414 includes a recess 1520 having a circular channel 1522 with circumferentially spaced stops 1524 for limiting rotation of the upper portion 1512, for example to a ninety degree rotation where the upper portion 1512 is in the locked position shown in FIG. 57. The lower portion 1510 may be concave on its bottom side such that when the lid is removed and inverted, residual paint on the bottom side of the lid will collected toward the center of the concave portion to eliminate paint spill over the sides of the lid.

The upper portion 1512 has a substantially rectangular outer profile, and as shown a substantially square outer profile, and a substantially circular inner profile defining a through passage 1530 forming an area for a user's hand with the recess 1520. The upper portion 1512 includes an annular projection 1532 extending downward from a bottom thereof having a plurality of circumferentially spaced tabs 1534 configured to engage in the channel 1522 to secure the upper portion 1512 to the lower portion 1510. The tabs 1534 have ends that are configured to abut the stops 1524 when the upper portion is in the locked and unlocked position. The upper portion 1512 also includes a handle 1484 extending across the through passage that may have a suitable shape, for example, the handle may include substantially parallel sides or the handle may include concave sides providing an ergonomic gripping surface for the user's hand. The handle 1184 may be flush or substantially flush with a top of upper portion 1512 to allow the handle to be placed on a surface upside down and lay flat.

To close the container 1410, the lid 1414 is lowered with the corners of the lid 1414 aligned with the corners of the container 1410 until the lid 1414 is below the tabs 1502. The lid 1414 can then be moved to close the opening 1454 as shown in FIG. 56, and then the upper portion 1512 rotated relative to the lower portion 1510 so that the corners of the upper portion 1512 are positioned under and abutting a respective table 1502 locking the container as shown in FIG. 57.

In an embodiment, the above described container bodies can include one or more nodules or ears, for example projecting from opposite sides of the container body. The nodules are configured to couple to a bail-type handle to facilitate carrying or lifting of the container. The bail-type handle can be removably attached in an embodiment and can include a connector that can be used to attach to a ladder or other stepping device and/or connect to a bail hook. In another embodiment, the lid may be connected to the container with a threaded connection.

Although described for use with a coating, it will be appreciated that the container may hold any suitable substance/material.

The aforementioned systems, components, (e.g., containers, lids, among others), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

While the embodiments discussed herein have been related to the apparatus, systems and methods discussed above, these embodiments are intended to be exemplary and are not intended to limit the applicability of these embodiments to only those discussions set forth herein.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A storage container for storing a material, the storage container comprising:

a lid; and a container body having:

a first portion having a wall with a closed bottom portion defining a first cavity for the material; and a second portion to which the lid is configured to be attached, the second portion being spaced from the first portion in a longitudinal direction by a collar defining a gap between the first and second portions, and the second portion having an outer wall and an inner wall defining an opening for accessing the first cavity and being radially inwardly spaced from the outer wall, and a ledge extending radially inwardly from a bottom of the inner wall to define a seat for the lid, wherein a second cavity is formed between an inner surface of the outer wall and an outer surface of the inner wall above the gap, wherein one or more anchor points are defined by interior corners of the outer wall in the second cavity for receiving a handle attachment strap, and wherein the first portion, second portion, and collar are integrally formed.

2. The storage container according to claim 1, wherein the outer wall is polygonal in shape, and the inner wall is circular in shape.

3. The storage container according to claim 2, wherein a pour spout is defined in at least one corner of the second portion between the inner and outer walls.

4. The storage container according to claim 3, wherein the pour spout defined in at least one corner includes a pour spout defined in two corners diagonal from one another.

5. The storage container according to claim 3, wherein a drip edge in the form of a recess in the outer wall is provided at each corner with a spout.

6. The storage container according claim 1, wherein the lid is configured to be attached to the second portion below a top of the wall providing a recessed closure.

7. The storage container according to claim 1, wherein the lid includes a base, an annular wall extending upward from the base, and a handle extending between sides of the annular wall defining a third cavity between the handle and the base.

8. The storage container according to claim 7, wherein the lid includes at least two channels on an outer surface of the annular wall and the container body includes at least two protrusions projecting radially inwardly from the wall, or wherein the lid includes at least two protrusions projecting radially outwardly from the annular wall and the container body includes at least two channels in the wall, wherein the at least two protrusions are configured to be received in a respective one of the at least two channels.

9. The storage container according to claim 1, wherein the lid includes at least two channels on an outer surface thereof, and the container body includes at least two protrusions configured to be received in a respective one of the at least two channels to secure the lid to the container body.

10. The storage container according to claim 9, wherein the lid includes a plurality of evenly circumferentially spaced channels and the container body includes a plurality of evenly circumferentially spaced protrusions.

11. The storage container according to claim 1 in combination with an attachment configured to be removably coupled to the storage container in the gap between the first and second portions, wherein the attachment includes a handle attachment strap configured to be removably coupled to the second portion, and a functional attachment separate from the handle attachment strap configured to be removably coupled to the handle attachment strap.

12. The storage container in combination with the attachment according to claim 11, wherein the handle attachment strap has a first end with an opening and a second end with a projection configured to be received in the opening for removably coupling the first and second ends, and wherein the handle attachment strap includes one or more other projections extending above an upper surface of the handle attachment strap to engage in respective ones of the one or more anchor points in the second portion.

13. A storage assembly comprising:

a storage container including a lid and a container body having a first portion and a second portion to which the lid is configured to be attached, the second portion being spaced from the first portion in a longitudinal direction by a collar defining a gap between the first and second portions, the first portion defining a cavity for the material and the second portion having a wall defining an opening for accessing the cavity; and an attachment configured to be removably coupled to the storage container in the gap between the first and second portions, the attachment including a handle attachment strap configured to be coupled to the second portion, and a functional attachment being a separate item from the handle attachment strap and configured to be removably coupled to the handle attachment strap, the handle attachment strap having first and second ends configured to be removably coupled to one another and one or more other projections extending above an upper surface of the handle attachment strap to engage in respective anchor points in the second portion, the first end of the handle attachment strap having an opening and the second end of the handle attachment strap having a projection configured to be received in the opening for removably coupling the first and second ends.

14. The storage assembly according to claim 13, wherein the functional attachment includes an attachment portion for removably coupling to the container and the handle attachment strap, and a functional portion.

15. The storage assembly according to claim 14, wherein the functional portion is a finger loop.

* * * * *